US008840220B2

(12) United States Patent
Taniguchi et al.

(10) Patent No.: US 8,840,220 B2
(45) Date of Patent: Sep. 23, 2014

(54) INK JET PRINTING APPARATUS AND INK TANK

(75) Inventors: Suguru Taniguchi, Kawasaki (JP); Kenjiro Watanabe, Tokyo (JP); Masashi Ogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 13/040,839

(22) Filed: Mar. 4, 2011

(65) Prior Publication Data

US 2011/0227972 A1 Sep. 22, 2011

(30) Foreign Application Priority Data

Mar. 17, 2010 (JP) ..... 2010-061148

(51) Int. Cl.
*B41J 29/393* (2006.01)
*B41J 2/175* (2006.01)

(52) U.S. Cl.
CPC ..... *B41J 2/1752* (2013.01); *B41J 2/17546* (2013.01)
USPC ..... 347/19; 347/7; 347/84; 347/85; 347/86

(58) Field of Classification Search
CPC ..... B41J 2/17546
USPC ..... 347/7
See application file for complete search history.

(56) References Cited

U.S. PATENT DOCUMENTS

| | | | | |
|---|---|---|---|---|
| 7,354,144 | B2 | 4/2008 | Hatasa et al. | |
| 7,651,207 | B2 | 1/2010 | Hatasa et al. | |
| 8,419,174 | B2 | 4/2013 | Ma | |
| 2002/0140750 | A1* | 10/2002 | Yoshiyama et al. | 347/7 |
| 2003/0127597 | A1* | 7/2003 | Nakamura et al. | 250/341.1 |
| 2004/0200957 | A1* | 10/2004 | Teng et al. | 250/231.13 |
| 2005/0219303 | A1* | 10/2005 | Matsumoto et al. | 347/19 |
| 2006/0290722 | A1 | 12/2006 | Kitagawa et al. | |
| 2006/0290729 | A1 | 12/2006 | Hatasa et al. | |
| 2007/0268325 | A1 | 11/2007 | Watanabe | |
| 2010/0141715 | A1* | 6/2010 | Swartz et al. | 347/86 |

FOREIGN PATENT DOCUMENTS

| | | |
|---|---|---|
| CN | 1636741 A | 7/2005 |
| CN | 1883953 A | 12/2006 |

(Continued)

OTHER PUBLICATIONS

Notification of the First Office Action—Chinese Patent Appln. No. 201110064467.9, State Intellectual Property Office of the People's Republic of China, May 2, 2013.

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

Provided is an ink jet printing apparatus that receives light from the light emitting part of the ink tank in the light receiving part; on the basis of a result of the light reception, determines an attachment position of the ink tank; and controls the light from the light emitting part to inform the ink tank state, wherein the light emitting part has a plurality of light emitting elements that can respectively emit lights having different peak emission wavelengths. A peak sensitivity wavelength of the light receiving part is in the range not less than 760 nm and not more than 1100 nm; at least one of the plurality of light emitting elements has a peak emission wavelength in the range not less than 760 nm, and at least one has a peak emission wavelength in the range of 400 to 760 nm.

15 Claims, 45 Drawing Sheets

(56) References Cited

FOREIGN PATENT DOCUMENTS

| | | | |
|---|---|---|---|
| CN | 101073951 | A | 11/2007 |
| CN | 101491975 | A | 7/2009 |
| JP | 2000-280487 | A | 10/2000 |
| JP | 2005-088284 | A | 4/2005 |
| JP | 2006-181717 | A | 7/2006 |
| JP | 2009-006680 | A | 1/2009 |

* cited by examiner

| TANK LIGHTING \ DETECTION POSITION | Left | Center | Right |
|---|---|---|---|
| K | - | (1) | (4) |
| Y | (2) | (3) | (7) |
| M | (5) | (6) | - |
| C | (8) | - | - |
| PGK | - | (9) | - |

FIG.23A

| DETECTION POSITION | BG |
|---|---|
| K | (10) |
| Y | (11) |
| M | (12) |
| C | - |
| PGK | (13) |

FIG.23B

| TANK LIGHTING \ DETECTION POSITION | Left | Center | Right |
|---|---|---|---|
| K | - | (1)-(10) | (4)-(11) |
| Y | (2)-(10) | (3)-(11) | (7)-(12) |
| M | (5)-(11) | (6)-(12) | - |
| C | (8)-(12) | - | - |
| PGK | - | (9)-(13) | - |

FIG.23C

205 CARRIAGE
1 INK TANK
101
210
K PGK Y M C

| TANK LIGHTING \ DETECTION POSITION | Left | Center | Right |
|---|---|---|---|
| K | - | (1) | (4) |
| Y | (2) | (3) | (7) |
| M | (5) | (6) | (22) |
| C | (8) | (21) | - |
| PGK | - | (9) | - |

FIG.30A

| DETECTION POSITION | BG |
|---|---|
| K | (10) |
| Y | (11) |
| M | (12) |
| C | (14) |
| PGK | (13) |

FIG.30B

| TANK LIGHTING \ DETECTION POSITION | Left | Center | Right |
|---|---|---|---|
| K | - | (1)-(10) | (4)-(11) |
| Y | (2)-(10) | (3)-(11) | (7)-(12) |
| M | (5)-(11) | (6)-(12) | (22)-(14) |
| C | (8)-(12) | (21)-(14) | - |
| PGK | - | (9)-(13) | - |

FIG.30C

205 CARRIAGE
1 INK TANK
101
210
K PGK Y M C

| | | | |
|---|---|---|---|
| 0 | 0 | 0 | OFF (FIRST/SECOND LIGHT EMITTING ELEMENTS) |
| 1 | 0 | 0 | ON (FIRST/SECOND LIGHT EMITTING ELEMENTS) |
| 0 | 0 | 1 | READ |
| 1 | 0 | 1 | WRITE |
| 0 | 1 | 1 | CALL |

| | | | | |
|---|---|---|---|---|
| 0 | 0 | 0 | 0 | OFF (FIRST LIGHT EMITTING ELEMENT) |
| 1 | 0 | 0 | 0 | ON (FIRST LIGHT EMITTING ELEMENT) |
| 0 | 1 | 0 | 0 | OFF (SECOND LIGHT EMITTING ELEMENT) |
| 1 | 1 | 0 | 0 | ON (SECOND LIGHT EMITTING ELEMENT) |
| 0 | 0 | 1 | 0 | OFF (THIRD LIGHT EMITTING ELEMENT) |
| 1 | 0 | 1 | 0 | ON (THIRD LIGHT EMITTING ELEMENT) |
| 0 | 1 | 1 | 0 | READ |
| 1 | 1 | 1 | 0 | WRITE |
| 0 | 0 | 0 | 1 | CALL |

| | | | | | | |
|---|---|---|---|---|---|---|
| PGK-OFF | 0 | 0 | 0 | 0 | 0 | 0 |
| PGK-ON | 0 | 0 | 0 | 1 | 0 | 0 |
| ALL-OFF | 0 | 0 | 1 | 0 | 0 | 0 |
| ALL-ON | 0 | 0 | 1 | 1 | 0 | 0 |
| PGK-CALL | 0 | 0 | 0 | 0 | 0 | 1 |

COMMAND FOR CONTROL PART ON INK TANK 1PGK

| | | | | | | |
|---|---|---|---|---|---|---|
| C-OFF | 1 | 0 | 0 | 0 | 0 | 0 |
| C-ON | 1 | 0 | 0 | 1 | 0 | 0 |
| ALL-OFF | 0 | 0 | 1 | 0 | 0 | 0 |
| ALL-ON | 0 | 0 | 1 | 1 | 0 | 0 |
| C-CALL | 1 | 0 | 0 | 0 | 0 | 1 |

COMMAND FOR CONTROL PART ON INK TANK 1C

| | | | | | | |
|---|---|---|---|---|---|---|
| M-OFF | 0 | 1 | 0 | 0 | 0 | 0 |
| M-ON | 0 | 1 | 0 | 1 | 0 | 0 |
| ALL-OFF | 0 | 0 | 1 | 0 | 0 | 0 |
| ALL-ON | 0 | 0 | 1 | 1 | 0 | 0 |
| M-CALL | 0 | 1 | 0 | 0 | 0 | 1 |

COMMAND FOR CONTROL PART ON INK TANK 1M

| | | | | | | |
|---|---|---|---|---|---|---|
| Y-OFF | 1 | 1 | 0 | 0 | 0 | 0 |
| Y-ON | 1 | 1 | 0 | 1 | 0 | 0 |
| ALL-OFF | 0 | 0 | 1 | 0 | 0 | 0 |
| ALL-ON | 0 | 0 | 1 | 1 | 0 | 0 |
| Y-CALL | 1 | 1 | 0 | 0 | 0 | 1 |

COMMAND FOR CONTROL PART ON INK TANK 1Y

| | | | | | | |
|---|---|---|---|---|---|---|
| K-OFF | 1 | 1 | 1 | 0 | 0 | 0 |
| K-ON | 1 | 1 | 1 | 1 | 0 | 0 |
| ALL-OFF | 0 | 0 | 1 | 0 | 0 | 0 |
| ALL-ON | 0 | 0 | 1 | 1 | 0 | 0 |
| K-CALL | 1 | 1 | 1 | 0 | 0 | 1 |

COMMAND FOR CONTROL PART ON INK TANK 1K

INK JET PRINTING APPARATUS AND INK TANK

BACKGROUND OF THE INVENTION

1. Field of the Invention

The present invention relates to an ink jet printing apparatus and an ink tank used in the ink jet printing apparatus.

2. Description of the Related Art

In a printing apparatus of an inkjet type, such as an inkjet printer, for example, in order to perform color printing, a plurality of ink tanks are used. Such plurality of ink tanks may be configured to be individually attachable to a tank attachment part such as a carriage. Also, in this configuration, so-called incorrect attachment may occur, in which an ink tank is attached at an incorrect attachment position. Accordingly, it is preferable to provide a determination function that determines whether or not an attachment position of an ink tank is correct.

Japanese Patent Laid-Open No. 2006-181717 describes that, as processing for determining whether or not an attachment position of an ink tank is correct, a light emitting part provided on the ink tank and a light receiving part provided on a printer main body side are used to perform optical checking processing. Also, the optical checking processing enables incorrect attachment of the ink tank to be determined.

As described in Japanese Patent Laid-Open No. 2006-181717, when the ink tank is attached to a carriage of a printer, the light emitting part provided on the ink tank and the light receiving part provided in the printer are covered by a main body cover. However, depending on use environment of the printer, outside light may enter from a gap of the cover, such as one on a feed tray or discharge tray side. If, in such an environment where the outside light enters, the above-described optical checking processing is preformed in a situation where an amount of the outside light is large, the light receiving part detects the relatively intense light, which may cause a determination error. Also, in the case where the optical checking processing is configured to be performed with the main body cover being opened, it is thought that the determination error due to the outside light is further likely to occur. Accordingly, it is preferable to reduce the influence of the outside light in the optical checking processing.

It is also preferable in such a printer to simply inform a user of pieces of information on a state of the ink tank, such as a remaining amount of ink in the ink tank and a result of the determination of a correct/incorrect attachment position by the optical checking processing.

SUMMARY OF THE INVENTION

An object of the present invention is to provide an ink jet printing apparatus and an ink tank that enable determination error due to outside light in determination of a correct/incorrect attachment position to be reduced and state information on the ink tank to be simply informed to a user.

In a first aspect of the present invention, there is provided an ink jet printing apparatus comprising: an ink tank having at least a first light emitting element and a second light emitting element; a carriage to which a plurality of the ink tanks are detachably attached; a light receiving part for receiving light from the first light emitting element; a determining unit configured to determine whether or not an attachment position of the ink tank is correct, on the basis of a light reception state of the light receiving part, wherein light is emitted to the light receiving part from the first light emitting element of the ink tank attached to the carriage; and an informing unit configured to provide information relating to a state of the ink tank by light from the second light emitting element, wherein a peak sensitivity wavelength range of the light receiving part is within a range not less than 760 nm and not more than 1100 nm, a peak emission wavelength of the first emitting element is within a range not less than 760 nm, and a peak emission wavelength of the second emitting element is within a range not less than 400 nm and not more than 760 nm.

In a second aspect of the present invention, there is provided an ink jet printing apparatus comprising: a plurality of ink tanks each of which is provided with a light emitting part having a plurality of light emitting elements and a drive control part for controlling driving of the light emitting part; and a printing apparatus main body that is provided with an apparatus side control part electrically connected to each of the drive control part through a common wiring, wherein the ink tank is provided with a memory part that stores ink information showing a type of ink contained in the ink tank, and the printing apparatus main body comprising: a carriage that is provided with an attachment part for each type of ink to which the ink tank is detachably attached and is moved in a reciprocated manner in a direction in which a plurality of the attachment parts are arranged; a light receiving part that is arranged so that a positional relation of the light receiving part with each of the plurality of attachment parts changes according to the movement of the carriage and is adapted to receive light from the light emitting part; and an ink remaining amount detecting unit for detecting an ink remaining amount in the ink tank, wherein the drive control part of each of the plurality of ink tanks causes the light emitting element of the light emitting part in a case that the drive control part receives lighting command which specifies the type of ink shown by the ink information stored in the memory part, from the apparatus side control part, and the apparatus side control part sends the common wiring the lighting command for the drive control part of the ink tank containing the type of ink that is specified accordingly to a position of the carriage, and causes an attachment position determining unit to determine whether or not the ink tank containing the type of ink specified by the lighting command is attached in the correct attachment part based on a light receiving result by the light receiving part in association with sending the lighting command, and causes an ink tank state informing unit, which provides information by controlling lighting of light from the light emitting part, to provide information based on a determination result by the attachment position determining unit and detection result by the ink remaining amount detecting unit, wherein a peak sensitivity wavelength range of the light receiving part is within a range not less than 760 nm and not more than 1100 nm, a peak emission wavelength of at least one of the plurality of emitting elements is within a range not less than 760 nm, and a peak emission wavelength of at least one of the plurality of emitting elements is within a range not less than 400 nm and not more than 760 nm.

In a third aspect of the present invention, there is provided an ink tank attached to a carriage of an ink jet printing apparatus main body that is provided with the carriage to which a plurality of the ink tank are detachably attached, the ink tank comprising at least a first light emitting element and a second light emitting element, Wherein the ink jet printing apparatus main body including: a light receiving part for receiving light from the first light emitting element; a determining unit configured to determine whether or not an attachment position of the ink tank is correct, on the basis of a light reception state of the light receiving part, wherein light is emitted to the light receiving part from the first light emitting element of the ink tank attached to the carriage; and an informing unit configured to provide information relating to a state of the ink tank by light from the second light emitting element, and wherein a peak sensitivity wavelength range of the light receiving part is within a range not less than 760 nm and not more than 1100 nm, a peak emission wavelength of the first emitting element is within a range not less than 760 nm, and a peak emission wavelength of the second emitting element is within a range not less than 400 nm and not more than 760 nm.

In a fourth aspect of the present invention, there is provided an ink tank attached to a carriage of an ink jet printing apparatus main body that is provided with the carriage that is provided with an attachment part for each type of ink to which the ink tank is detachably attached and is moved in a reciprocated manner in a direction in which a plurality of the attachment parts are arranged, the ink tank comprising: a light emitting part having a plurality of light emitting elements; a drive control part for controlling driving of the light emitting part; and a memory part that stores ink information showing a type of ink contained in the ink tank, wherein the ink jet printing apparatus main body including: an apparatus side control part electrically connected to each of the drive control part through a common wiring; and a light receiving part that is arranged so that a positional relation of the light receiving part with each of the plurality of attachment parts changes according to the movement of the carriage and is adapted to receive light from the light emitting part, wherein the drive control part causes the light emitting element of the light emitting part in a case that the drive control part receives lighting command which specifies the type of ink shown by the ink information stored in the memory part, from the apparatus side control part, and the apparatus side control part sends the common wiring the lighting command for the drive control part of the ink tank containing the type of ink that is specified accordingly to a position of the carriage, and causes an attachment position determining unit to determine whether or not the ink tank containing the type of ink specified by the lighting command is attached in the correct attachment part based on a light receiving result by the light receiving part in association with sending the lighting command, and causes an ink tank state informing unit, which provides information by controlling lighting of light from the light emitting part, to provide information based on a determination result by the attachment position determining unit and detection result by the ink remaining amount detecting unit, and wherein a peak sensitivity wavelength range of the light receiving part is within a range not less than 760 nm and not more than 1100 nm, a peak emission wavelength of at least one of the plurality of emitting elements is within a range not less than 760 nm, and a peak emission wavelength of at least one of the plurality of emitting elements is within a range not less than 400 nm and not more than 760 nm.

According to the above configuration, determination error due to outside light in correct/incorrect determination of an attachment position can be reduced, and also state information on the ink tank can be simply informed to a user.

Further features of the present invention will become apparent from the following description of exemplary embodiments (with reference to the attached drawings).

BRIEF DESCRIPTION OF THE DRAWINGS

FIGS. 23A to 23C illustrate tables used in attached tank correct/incorrect processing in S11 of FIG. 21;

FIGS. 30A to 30C illustrate tables used in attached tank correct/incorrect determination processing in the second embodiment;

DESCRIPTION OF THE EMBODIMENTS

Figure 1A:
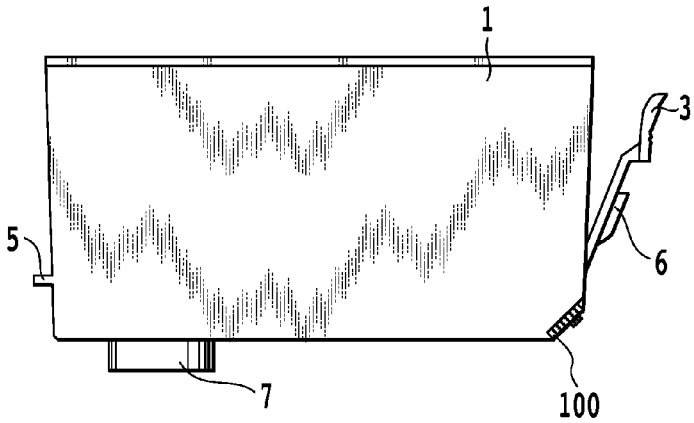
FIGS. 1A, 1B and 1C are a side view, front view, and bottom view of an ink tank according to a first embodiment of the present invention, respectively.

Embodiments of the present invention will hereinafter be described in detail with reference to the drawings.

<First Embodiment>

In the following, according to the section order described below, the first embodiment of the present invention is described.

1. Mechanical configuration
1.1 Ink tank
1.2 Ink tank attachment part
1.3 Printing apparatus (printer) main body
2. Configuration of control system
2.1 Overall configuration
2.2 Configuration of connection part
2.3 Control procedure <1. Mechanical Configuration>

<1.1 Ink Tank>

Figure 1B:
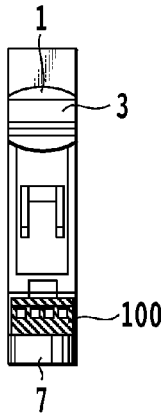
Figure 1C:
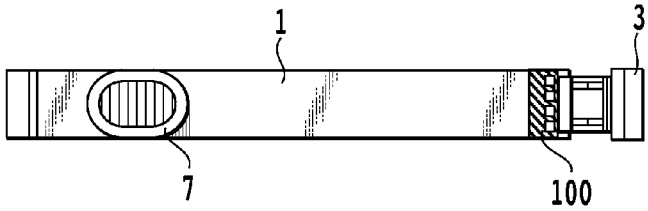

FIGS. 1A, 1B and 1C are a side view, front view, and bottom view of an ink tank serving as a liquid storage container according to the first embodiment of the present invention. Note that, in the description herein, a front face of the ink tank refers to a face on the side where an operation lever (hereinafter referred to as a "support member") used when a user attaches/detaches the ink tank is provided, and information (light emission of a light emitting part) can be provided to the user.

In FIGS. 1A, 1B and 1C, the ink tank 1 of the present embodiment has the support member 3 that is supported by a lower part on the front side. The support member 3 is formed from resin integrally with an outer case of the ink tank 1, and configured to be able to be displaced around a supporting part when an operation for attachment/detachment to/from an after-mentioned tank holder, or another operation is performed. On a back side and the front side of the ink tank 1, a first engaging part 5 and a second engaging part 6 (in the present embodiment, integrated with the support member 3) that can engage with locking parts on the tank holder side are respectively provided, and on the basis of the engagement of them, an attachment state of the ink tank 1 to the tank holder is ensured. On a bottom face of the ink tank 1, there is provided an ink supply port 7 for, at the time of attachment to the tank holder, supplying ink with being connected to an ink introduction port of an after-mentioned printing head. In a part making a connection between the bottom face and the front face (in this example, on slope face), a substrate is provided. A shape of the substrate may be a chip or plate shape; however, in the following, the substrate is described as a board 100.

An inside of the ink tank 1 is divided into: an ink storage chamber that is positioned on the front side where the support member 3 and the board 100 are provided; and a negative pressure generating member containing chamber that is positioned on the back side and communicatively connected to the ink supply port 7, and both of them are communicatively connected to each other through a communicative connection port. In the ink storage chamber, ink is directly stored, whereas in the negative pressure generating member containing chamber, an ink absorber (hereinafter referred to as a porous member) such as a sponge or fiber assembly that impregnates and holds the ink is provided. Also, the ink tank 1 can be manufactured by preparing a main body of the ink tank 1 arranged with the after-mentioned board and then injecting ink. An ink injection port for carrying out the procedure can be formed, for example on an upper face of the ink storage chamber 11. Then, after the ink injection, the injection port can be sealed by a sealing member (not illustrated). Note that an internal configuration of the ink tank 1 is not limited to such a configuration in which the containing chamber for the porous member and the storage chamber directly storing ink are separated. For example, an internal space of the ink tank may be substantially entirely filled with the porous member. Also, as a negative pressure generating unit, the porous member is not used, but a unit configured to directly fill ink in a bag-like member formed with an elastic material such as rubber that generates tension in a direction of expanding a volume, and utilize the tension generated by the bag-like member to make negative pressure act on the inside ink is also possible. Further, the negative pressure generating unit may be a unit configured to: form at least a part of an ink storage space with use of a flexible member; store ink only in the part of the space; and make spring force act on the flexible member to generate negative pressure. Even in either case, the ink tank can be manufactured by the ink injection as described above. Also, even in either case, there is provided an air communicative connection part for, in order to release negative pressure in the ink storage space, which increases as ink is supplied to the printing head, and keep the negative pressure within a preferable predetermined range, introducing outside air into the ink storage space. The air communicative connection part can also be used to inject ink.

The bottom of the ink storage chamber is provided with a detection target (not illustrated) at a site that can, when the ink tank 1 is attached to the printer main body (ink jet printing apparatus main body), face to an ink remaining amount detecting sensor (to be described later) provided on the main body side. In the present embodiment, the ink remaining amount detecting sensor 214 (see FIG. 8) is an optical sensor that is configured by combining a light emitting element and a light receiving element. Also, the detection target is made of a transparent or translucent material, and is of a prism shape having a slope part, of which a shape, angle, and the like are set such that when ink is not stored, light from the light emitting part can be appropriately reflected and returned to the light receiving part (to be described later).

Figure 2A:
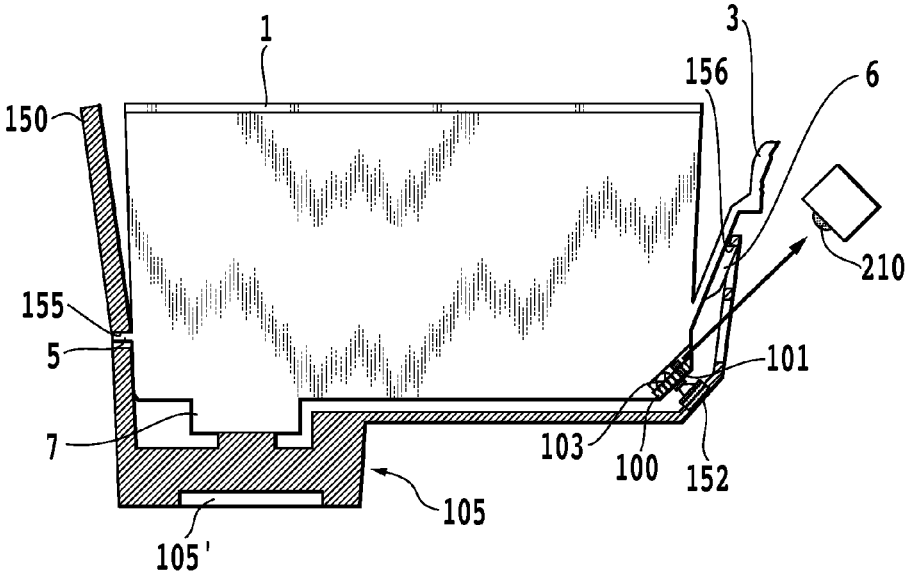
FIGS. 2A and 2B are schematic side views for explaining an outline of functions of a board placed on the ink tank according to the first embodiment of the present invention.
Figure 2B:
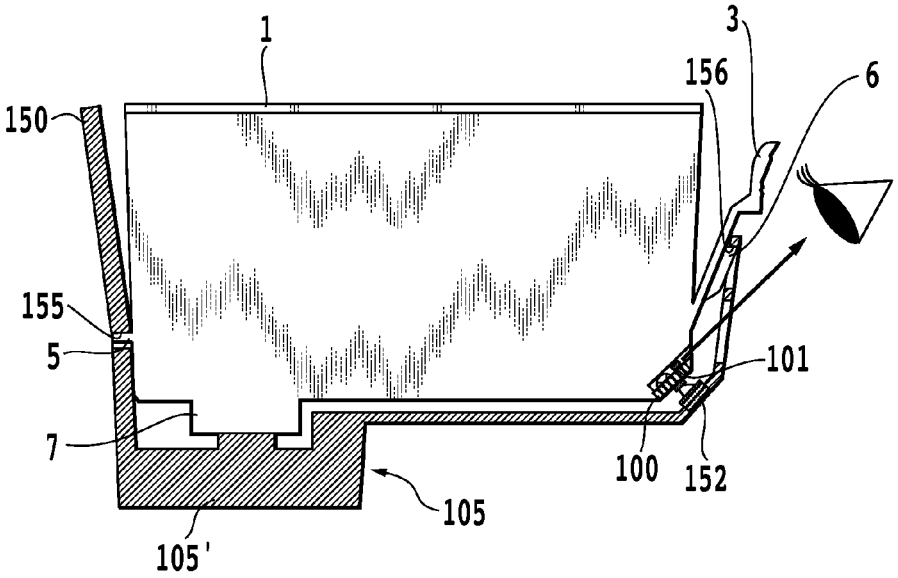
Figure 3A:
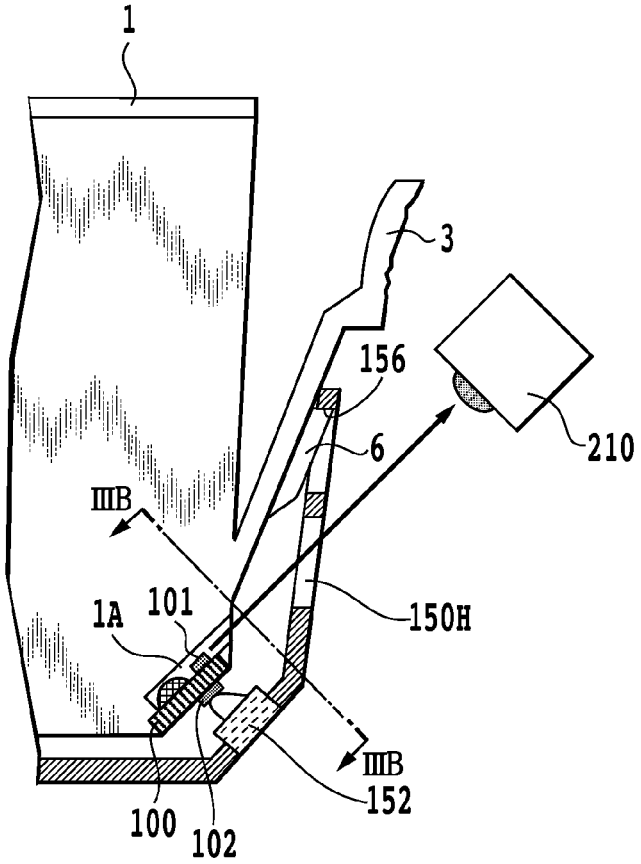
FIGS. 3A and 3B are an enlarged view of a main part in FIGS. 2A and 2B and an arrow view in an III*b* direction in the enlarged view, respectively.
Figure 3B:
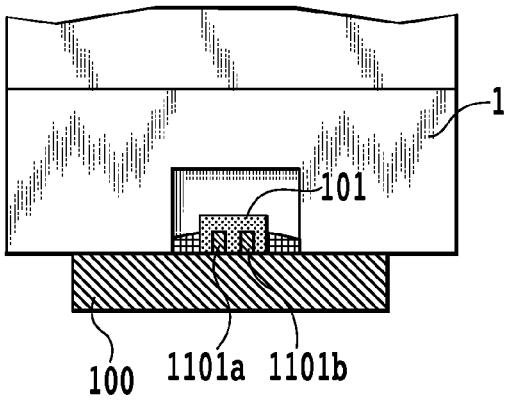
Figure 4A:
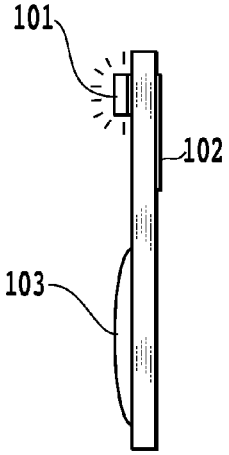
FIGS. 4A, 4B and 4C are respectively a side view, and front views illustrating an example of the control board attached to the ink tank according to the first embodiment.
Figure 4B:
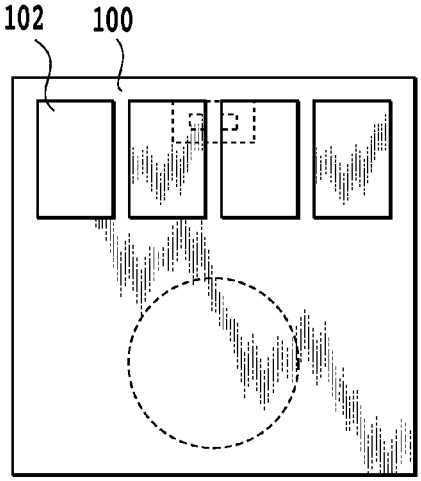
Figure 4C:
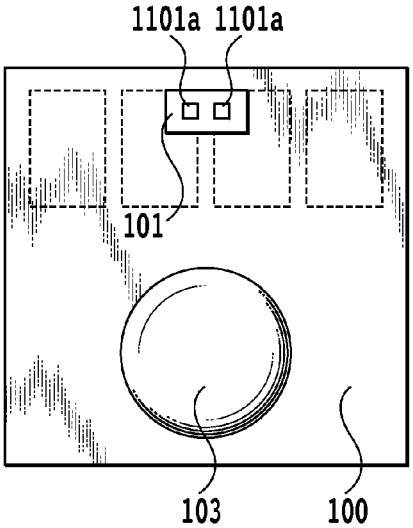
Figure 4D:
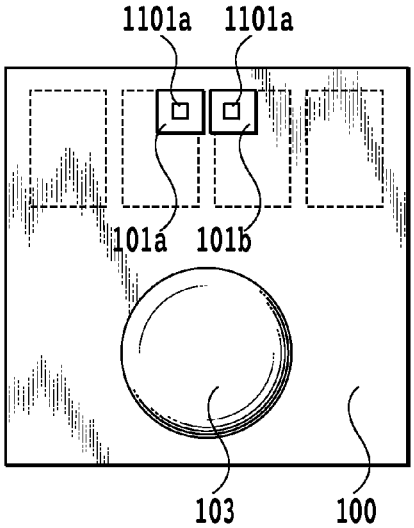
FIG. 4D is a front view of a board according to another embodiment.

With reference to FIGS. 2A to 4D, a configuration and functions of the board 100 are described. Here, FIGS. 2A and 2B are schematic side views for explaining an outline of the functions of the board arranged on the ink tank that is applicable in the present invention. FIGS. 3A and 3B are an enlarged view of a main part in FIGS. 2A and 2B and an arrow view of a cross section in an IVb direction in the enlarged view, respectively. FIGS. 4A to 4C are respectively a side view, front view, and back view illustrating an example of the board 100 attached to the ink tank according to the first embodiment. FIG. 4D is a back view of the board 100 attached to the ink tank as an example provided with after-described two light emitting parts.

As illustrated in FIGS. 2A and 2B, the first engaging part 5 and second engaging part 6 of the ink tank 1 respectively engage with a first locking part 155 and second locking part 156 of a holder 150 integrated with a printing head unit 105 provided with a printing head 105'. Based on this, the ink tank 1 is attached and fixed to the holder 150. Also, at this time, a connector 152 that is provided in the holder 150 and serves as a printer main body side contact point, and an electrode pad 102 (FIG. 4B) that is provided on the ink tank 1 and serves as a tank side contact point of the board 100 are brought into contact with each other, and thereby an electrical connection can be made.

On a back face opposite to a face where the electrode pad 102 is provided, a light emitting part 101 and a control circuit 103 that controls the light emitting part 101 are provided. The control circuit 103 serving as a tank side control part performs control of light emission/extinction of the light emitting part 101 according to an electrical signal supplied from the connector 152 through the pad 102. As illustrated in FIGS. 4A to 4C, regarding the light emitting part 101, in the one package light emitting part 101, a plurality of light emitting elements respectively having different peak emission wavelengths, specifically, a first light emitting element 1101*a* and a second light emitting element 1101*b* are provided. Note that, in the present embodiment, as the type of the light emitting element, an LED (Light Emitting Diode) is taken as an example to provide the description; however, the type is not limited to this, but any light emitting body such as an LD (Laser. Diode) can be used.

Note that FIG. 4A illustrates a state where the control circuit 103 is mounted on the board 100 and then covered by a protecting sealant. Also, in the case of mounting on the board 100 a memory element that stores pieces of information such as ink information indicating the type of ink stored in the ink tank and ink amount information (information indicating an ink use amount or ink remaining amount), the memory element can also be mounted at the same position and covered by the sealant. Note that the type of ink is based on discrimination by difference in color; however, inks that have the same color but different materials, components, or the like, for example, on the basis of difference between pigment and dye or between lightness and concentration, or other difference, the discrimination can be further made.

As described above, the board 100 is placed in the part (on the slope face) that makes the connection between the bottom face and front face of the ink tank 1. Accordingly, as illustrated in FIG. 3A, when the light emitting part 101 emits light, part of the light is emitted outside from the front side of the ink tank 1 along the slope face.

By using the board 100 having such arrangement, as will be described in detail later, not only the printer (and therefore a host device such as a computer connected with the printer), but even user can also be presented with the pieces of predetermined information associated with the ink tank 1 with use of the light emitting part 101. Also, the light emitted from the light emitting part 101 is received in a light receiving part 210. The light receiving part 210 is positioned at the end within a carriage scanning range on the printer main body side, and as illustrated in FIG. 3A, arranged at a position where the light emitted in an upper right direction can be received. Note that, in the present embodiment, the arrangement position of the light receiving part 210 in the printer is, as will be described later with FIG. 7B, at the end of the carriage scanning range; however, the arrangement position of the light receiving part 210 is not limited to this. For example, the light receiving part 210 may be arranged near the center of the carriage scanning range.

Also, as illustrated in FIGS. 3A and 3B, in the part of the ink tank 1 facing to the face of the board 100 where the light emitting part 101 and the control circuit 103 are provided, in order that the light emitted by the light emitting part 101 may efficiently reach the light receiving part 210 or user's view field, at least a space 1A can be formed along a light axis (arrow). Also, for the same purpose, by appropriately setting the placement position and shape of the support member 3, the light axis can be prevented from being blocked. Further, the holder 150 is provided with a hole (or a light transmissive part) 150H for ensuring the light axis.

<1.2 Ink Tank Attachment Part>

Figure 5:
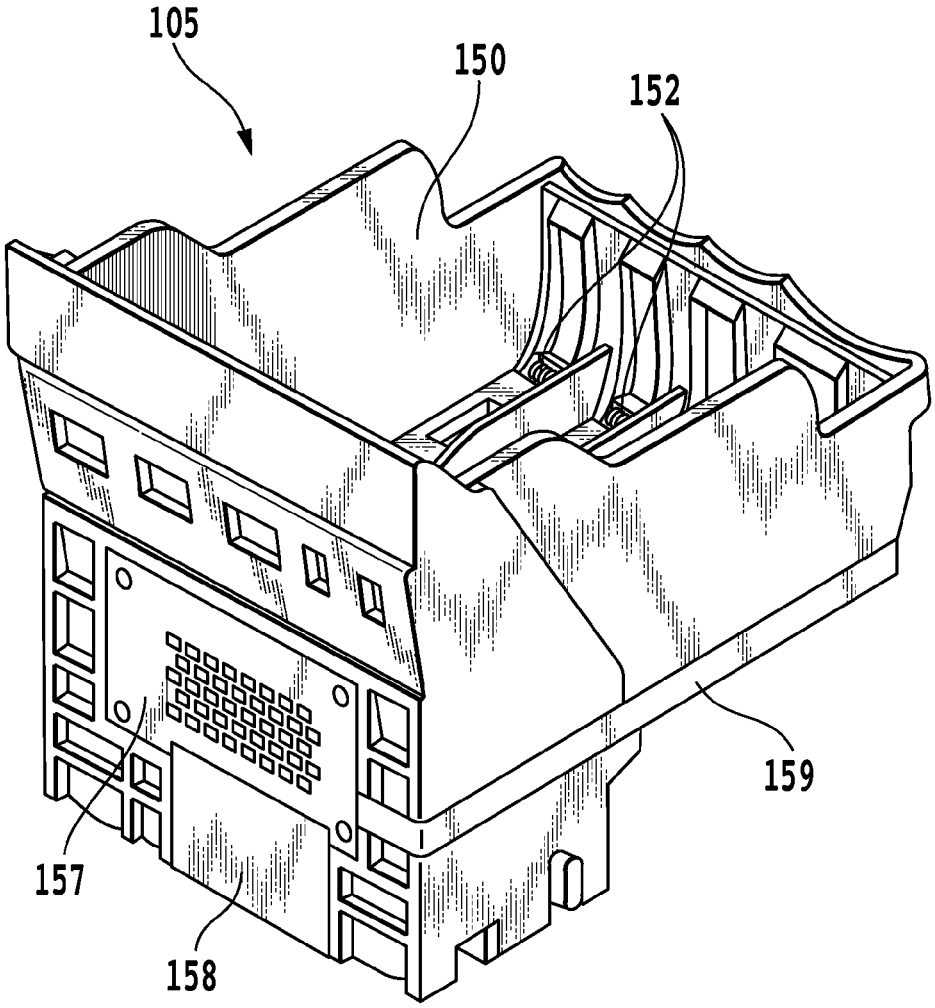
FIG. 5 is a perspective view illustrating an example of a printing head unit having a holder to be attached with the ink tank according to the first embodiment.

FIG. 5 is a perspective view illustrating an example of the printing head unit that is configured to be attachable/detachable with the ink tank according to the first embodiment. In the present embodiment, the carriage of the printer main body is provided with the print head unit so as to be attachable/detachable, and the printing head unit is detachably attached with respective ink tanks.

The printing head unit 105 roughly includes: the holder 150 that individually detachably holds a plurality of ink tanks; and the printing head 105' (not illustrated in FIG. 5) that is arranged on the bottom side of the holder. The holder 150 is provided with ink tank attachment parts for respective ink types, and in the case of the present embodiment, provided with attachment parts respectively for five types of ink tanks for dye black (hereinafter also referred to as K), pigment black (hereinafter also referred to as PGK), yellow (hereinafter also referred to as Y), magenta (hereinafter also referred to as M), and cyan (hereinafter also referred to as C). The ink tanks 1 are respectively attached to the holder 150, and thereby the ink introduction port 107 on the printing head side, positioned at the bottom of the holder, and the ink supply port 7 on the ink tank side are connected to each other to form an ink communication path between them.

The printing head 105' is provided with an electro-thermal transducing element in a liquid path constituting a nozzle; gives an electric pulse serving as a printing signal to the element to give thermal energy to ink; and utilizes pressure upon foaming (boiling) generated by phase change of the ink to eject the ink. The electro-thermal transducing element of the printing head 105' is driven in such a way that the printing signal is transmitted to a drive circuit of the printing head through a wiring part 158 provided in the printing head unit. That is, the printing head unit 105 is provided with: an electric contact part 157 that is connected to an electric contact part (unillustrated) for signal transmission provided in an aftermentioned carriage 203; and the above wiring part 158 that makes a connection between the electric contact part and the drive circuit of the printing head. Also, from the electric contact part 157, an extended wiring part 159 reaching the connector 152 is also provided.

When the ink tank 1 is attached to the printing head unit 105, the ink tank 1 is handled above the holder 150, and placed on the bottom face of the holder with the protrusion-like first engaging part 5 provided on the ink tank back side being inserted into the through-hole-like first locking part 155 provided on the holder back side. When a front side edge of an upper face of the ink tank 1 is pressed downward in this state, the ink tank 1 rotationally moves with using an engagement part between the first engaging part 5 and the first locking part 155 as a rotational movement supporting point, and the front side of the ink tank 1 is displaced downward. In this process, with a side face of the second engaging part 6 provided on the support member 3 on the front side of the ink tank 1 being pressed by the second locking part 156 provided on the holder front side, the support member 3 is also displaced anticlockwise in FIG. 1A. Then, when an upper face of the second engaging part 6 reaches below the second locking part 156, the support member 3 is displaced by elastic force thereof clockwise in FIG. 1A, which is an opposite direction, and the second engaging part 6 is locked by the second locking part 156. In this state, the second locking part 155 elastically biases the ink tank 1 in a horizontal direction through the support member 3, and thereby the back face of the ink tank 1 comes into abutting contact with the back face of the holder 150. Also, upward displacement of the ink tank 1 is suppressed by the first locking part 155 with which the first engaging part 5 engages and the second locking part 156 with which the second engaging part 6 engages. This is an attachment completion state of the Ink tank 1, and at this time, the ink supply port 7 and the ink introduction port 107, and the pad 102 and the connector 152 are respectively in connecting states.

Figure 6B:
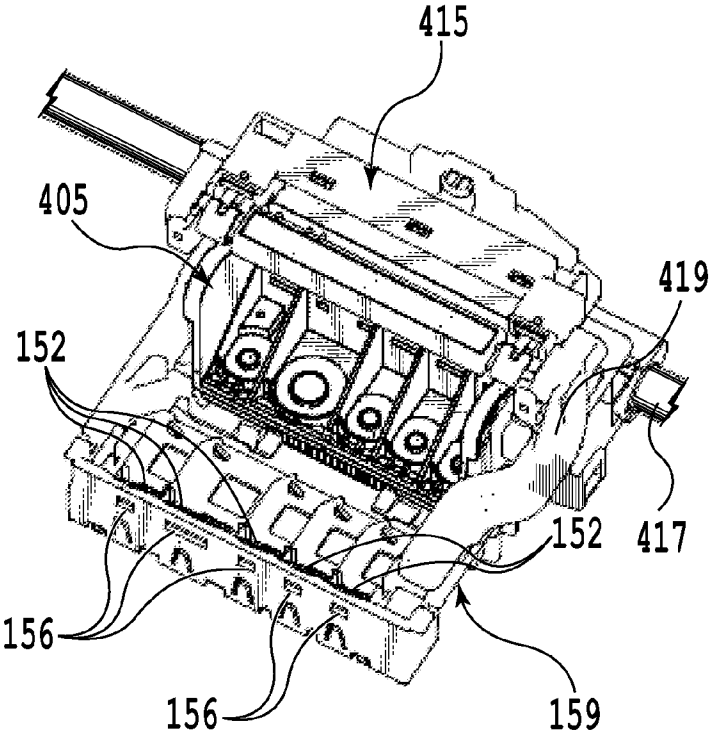
FIGS. 6A and 6B are perspective views illustrating another example of an ink tank attachment part according to the first embodiment.
Figure 6A:
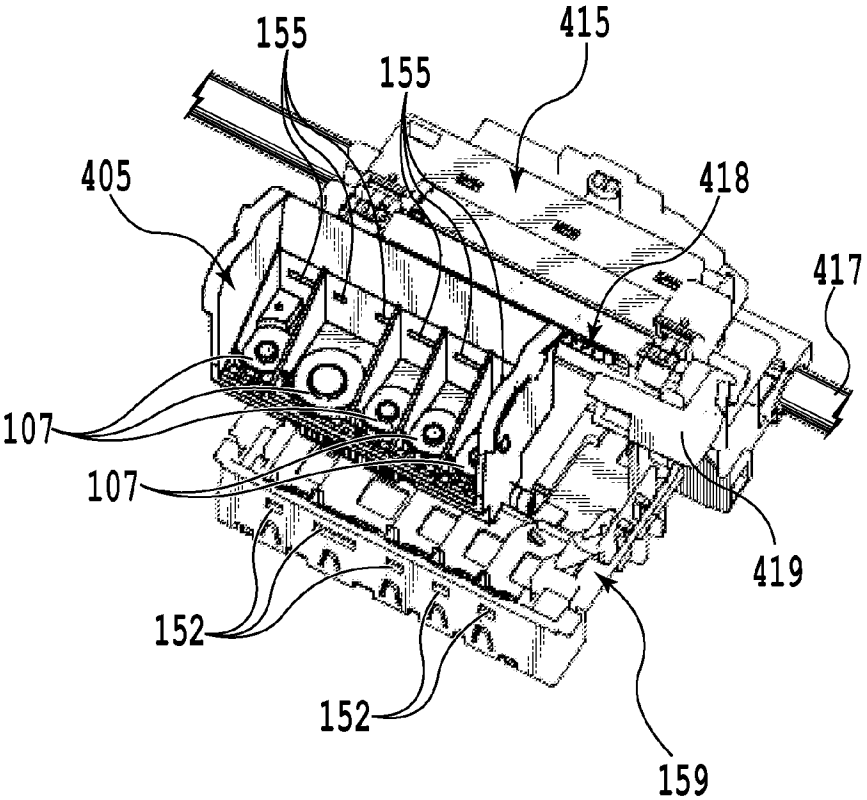

A configuration of the ink tank attachment part according to the present invention is not limited to one illustrated in FIG. 5. FIGS. 6A and 65 are referenced to describe this. FIG. 6A is a perspective view of the carriage in which the printing head unit that receives supply of ink from the ink tank to perform printing operation is in a separation state, and FIG. 65 is a perspective view illustrating the carriage in a state where the printing head unit is attached. The printing head unit 405 according to this example is different from the holder 150 as in the above example, which fixes and holds the entire ink tank, and as illustrated in FIG. 6A, does not have the holder part corresponding to the ink tank front side, and the second locking part, connector, and the like placed in the holder part. The rest are almost the same as those in the above example, in which on a bottom face, on a back side, and on a back face of the back side, the ink introduction port 107 connected to the ink supply port 7, the first locking part 155, and the electric contact part for signal transmission (not illustrated) are present. On the other hand, the carriage 415 that is movable along a shaft 417 has a configuration replacing an aftermentioned carriage 205, and as illustrated in FIGS. 6A and 6B, in addition to a lever 419 for attaching and fixing the printing head unit 405 and an electric contact part 418 connected to a printing head side electric contact part, the holder part corresponding to the front side of the ink tank 1 is provided in the carriage main body 415. That is, the second locking part 156, connector 152, and wiring part 159 to the connector are placed on the carriage side. In such a configuration, in the state where the printing head unit 405 is attached as illustrated in FIG. 6B, the whole of the attachment part for the ink tank 1 is configured in the carriage 415. In the example illustrated in FIGS. 6A and 6B, as illustrated in FIG. 6B, sequentially from the left in the diagram, the respective ink tank attachment parts for K, PGK, Y, M, and C are configured. Also, through the same attachment operation as that in the configuration of FIG. 5, the connections between the ink supply port 7 and the ink introduction port 107 and between the pad 102 and the connector 152 are made to complete the attachment operation.

<1.3 Printing Apparatus (Printer) Main Body>

Figure 7A:
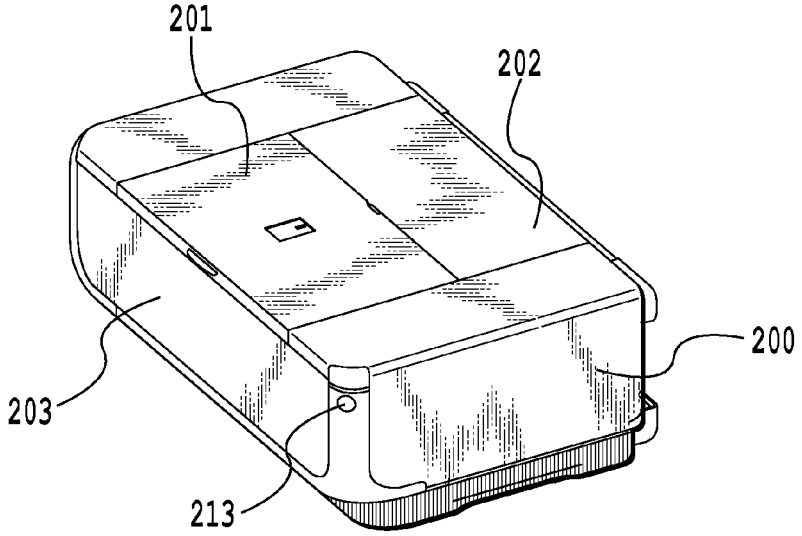
FIG. 7A is a diagram illustrating an appearance of an inkjet printer that is attached with the ink tanks of the above first embodiment to perform printing.

FIG. 7A is a diagram illustrating an appearance of an inkjet printer 200 that is attached with the above-described ink tanks 1 to perform printing, and FIG. 73 is a perspective view illustrating a state where the main body cover 201 and the like illustrated in FIG. 7A are opened.

As illustrated in FIG. 7A, in the printer 200 of the present embodiment, a main part of the printer such as a mechanism in which the carriage mounted with the printing heads and ink tanks moves for scanning to perform printing is provided with: the printer main body that is covered by the main body cover 201 and the other case parts; discharge trays 203 that are respectively provided on front and back sides of the printer main body; and an automatic sheet feeder (ASP) 202. Also, there is provided an operation part 213 provided with: an indicator for displaying a state of the printer in both of states where the main body cover is closed and opened; a power switch; and a reset switch.

Figure 7B:
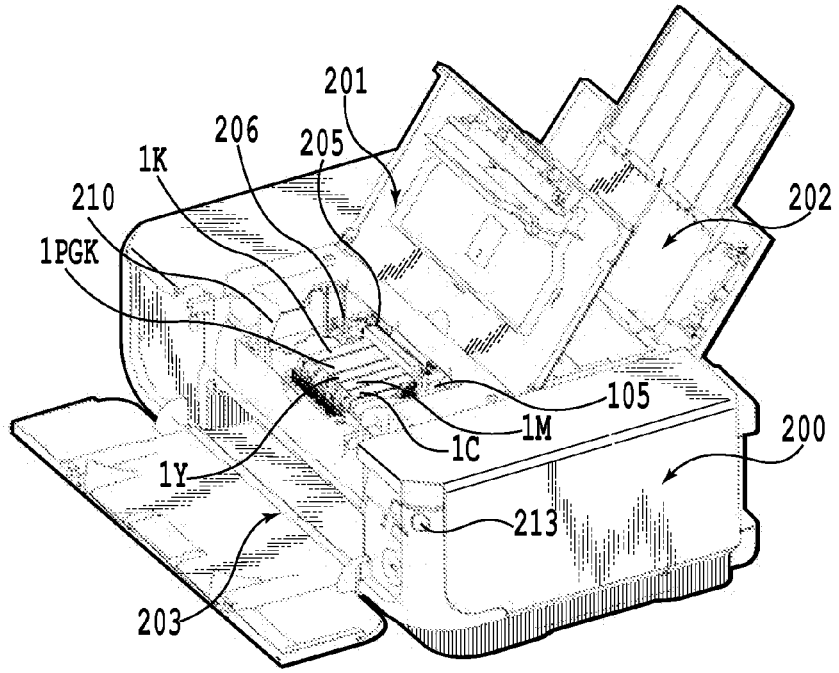
FIG. 7B is a perspective view illustrating the ink jet printer with a main body cover 201 illustrated in FIG. 7A being removed.

The main body cover 201 is openably/closably provided so as to cover the carriage 205 over a moving range of the carriage 205. In the state where the main body cover 201 is opened, as illustrated in FIG. 7B, a user can view the moving range of the carriage 205 mounted with the printing heads 105 and ink tanks 1K, 1PGK, 1Y, 1M, and 1C (in the following, in the case of collectively referring to them, these ink tanks may be indicated by the same symbol "1") and the periphery of the range. In practice, a sequence in which when the main body cover 201 is opened, the carriage 205 is automatically moved to almost the central position illustrated in the figure (hereinafter also referred to as a "tank replacement position") is performed, and the user can perform an replacement operation for each of the ink tanks at the tank replacement position.

As described above, in the carriage 205, the printing head unit 105 is provided with the chip-formed printing heads (not illustrated) corresponding to the respective color inks. Also, the printing heads for the respective colors can scan a printing medium such as a sheet of paper on the basis of the movement of the carriage 205 to eject the inks on the printing medium for printing during the scanning. That is, the carriage 205 slidably engages with the guide shaft 207 extending in the moving direction thereof, and can perform the above-described reciprocating movement by a carriage motor and a driving force transferring mechanism for the motor. Note that, in the present embodiment, the respective attachment parts for the ink tanks 1K, 1PGK, 1Y, 1M, and 1C are arrayed in one direction, and the array direction and the reciprocating movement direction of the carriage 205 are the same.

In the printing operation, scanning of the printing heads is performed by the above movement; during the scanning, the inks are ejected on the printing medium from the respective printing heads to perform printing in an area having a width corresponding to ejection ports of the printing heads; and between the scanning and next scanning, by performing a predetermined amount of paper feeding corresponding to the above width by the above paper feeding mechanism, a series of printing on the printing medium are sequentially performed. Also, at the end of a moving range of the printing heads by the above carriage movement, there is provided a recovery unit (not illustrated) for each of the printing heads, such as a cap that covers a face where the ejection port of the printing head is placed. Based on this, the printing heads move at predetermined time intervals to positions at which the recovery units are provided, and then recovery processing including preliminary ejection, suction recovery, and the like are performed.

In the moving range of the carriage 205, near the end on a side opposite to the positions where the above-described recovery units are provided, the light receiving part 210 having a light receiving element is provided. The light receiving part 210 includes, for example, a phototransistor, but may include another type of light receiving body. The light receiving part 210 is arranged at a position lateral to the moving direction of the carriage 205. In particular, in the present embodiment, the light receiving part 210 is fixedly arranged such that by the movement of the carriage 205, a relative positional relationship with each of the above plurality of attachment parts is varied. Based on the above configuration, as will be described later in detail, light from a light emitting part 101 is received in the light receiving part 210, and on the basis of a result of the light reception, it can be determined whether or not an ink tank is attached at a correct position (optical checking processing). The present embodiment is configured such that the light emitting part 101 directly emits the light toward the light receiving part 210; however, as will be described later with FIGS. 36 and 37, an embodiment may be configured such that, through a light guiding member or the like, the light is indirectly emitted toward the light receiving part 210.

<2. Configuration of Control System>

<2.1 Overall Configuration>

Figure 8:
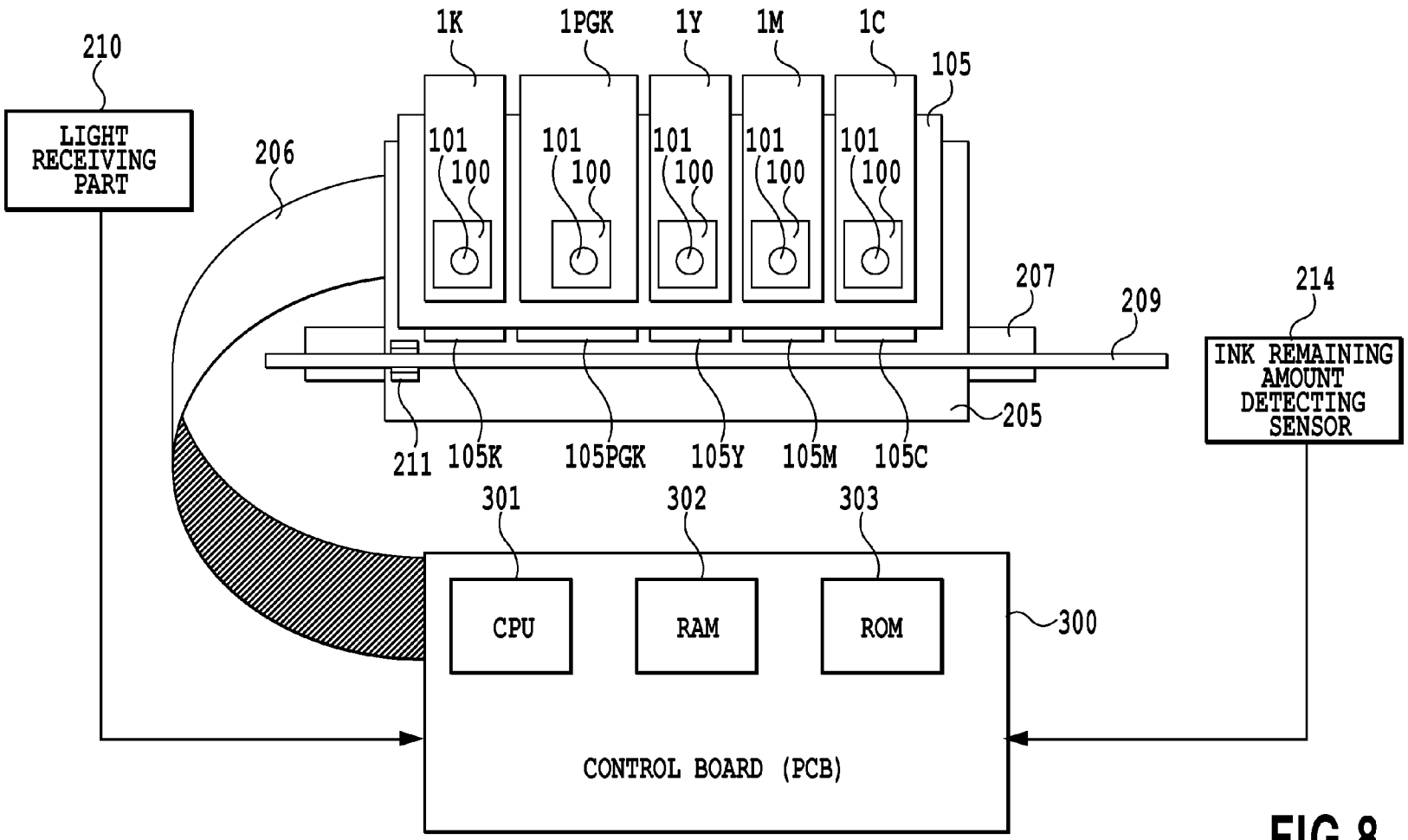
FIG. 8 is a block diagram illustrating a control configuration of the above inkjet printer.

FIG. 8 is a block diagram illustrating a configuration example of a control system of the above-described inkjet printer, and mainly illustrates a configuration associated with: a control circuit 300 (printer side control part) of a PCB (printed circuit board) form provided in the printer main body; the control circuit 103 and the light emission of the light emitting part 101 that are controlled by the control circuit 300 and provided on each of the ink tanks 1; and the like.

In FIG. 8, the control circuit 300 performs data processing and operating control of the inkjet printer of this embodiment. Specifically, according to a program stored in a ROM 303, a CPU 301 performs processing or the like that is to be described later with FIGS. 13 to 28, and the like. Also, a RAM 302 is used as a work area when the CPU 301 performs the processing.

As schematically illustrated in FIG. 8, the printing head unit 105 of the carriage 205 has the printing heads 105K, 105PGK, 105Y, 105M, and 105C for ejecting the respective inks of dye black (K), pigment black (PGK), yellow (Y), magenta (M), and cyan (C). Also, the holders of the printing head unit 105 is detachably mounted with the ink tanks 1K, 1PGK, 1Y, 1M, and 1C corresponding to the printing heads.

In the case of the present embodiment, a shape (size) of the pigment black ink tank 1PGK is larger than those of the other ink tanks 1K, 1Y, 1M, and 1C, and therefore the pigment black ink tank 1PGK cannot be attached to any of the respective attachment parts for KYCM. On the other hand, the ink tanks 1K, 1Y, 1M, and 1C have the same shape, and therefore each of the ink tanks 1K, 1Y, 1M, and 1C can be attached to any of the respective attachment parts for KYCM. For this reason, in the ink tanks 1K, 1Y, 1M, and 1C, incorrect attachment may occur.

Each of the ink tanks 1 is attached with, as described above, a board 100 provided with the light emitting part 101, control circuit 103 for the light emitting part 101 and the pad 102 serving as a contact terminal and the like. Also, when the ink tank 1 is correctly attached to the printing head unit 105, the pad 102 on the above board 100 comes into contact with the connector 152 provided in the printing head unit 105. Also, a connector (not illustrated) provided in the carriage 205 and the main body side control circuit 300 are electrically connected to each other through a flexible cable 206. Further, the printing head unit 105 is attached to the main body of the carriage 205, and thereby the above connector of the main body of the carriage 205 and the above connector 152 of the printing head unit 105 are electrically connected to each other.

Based on the above connection configuration, the main body side control circuit 300 and the control circuit 103 of each of the ink tanks 1 are electrically connected to each other, and thereby between them, a signal can be communicated. Based on this, the control circuit 300 serving as the printer main body side control part and the control circuit 103 serving as the tank side control part can perform lighting or extinction control according to a sequence illustrated in FIG. 13 or 27 or the like. Also, ink ejection in each of the printing heads 105K, 105PGK, 105Y, 105M, and 105C can be controlled by a printing signal and drive control signal from the control circuit 300 as well.

The light receiving part 210 provided near the one end of the moving range of the carriage 205 receives the light emission from the light emitting part 101 of the ink tank 1, and outputs a signal corresponding to the light emission to the control circuit 300. As will be described later, the control circuit 300 can determine on the basis of the signal whether or not a correct ink tank is attached to an attachment part of the carriage 205. Also, an encoder scale 209 is provided along the moving path of the carriage 205, and also the carriage 205 is provided with an encoder sensor 211. A detection signal of the sensor is inputted to the control circuit 300 through the flexible cable 206, and the control circuit 300 can sense a movement position of the carriage 205 according to the inputted detection signal. Information on the movement position is used for the ejection control of each of the printing heads, and also as will be described later with FIG. 13 and the like, used in the optical checking processing that determines whether or not an attachment position of an ink tank is correct.

Further, the ink remaining amount detecting sensor 214 provided near the predetermined position within the moving range of the carriage 205 is configured by the combination of a light emitting element and a light receiving element. The sensor is used to thereby detect whether or not the light of the light emitting element emitted toward the ink tank 1 is returned to the light receiving element, and a signal regarding an ink remaining amount of each of the ink tanks 1 mounted on the carriage 205 is outputted to the control circuit 300. On the basis of the signal, the control circuit 300 can detect the ink remaining amount or ink consumption.

<2.2 Configuration of Connection Part>

Figure 9:
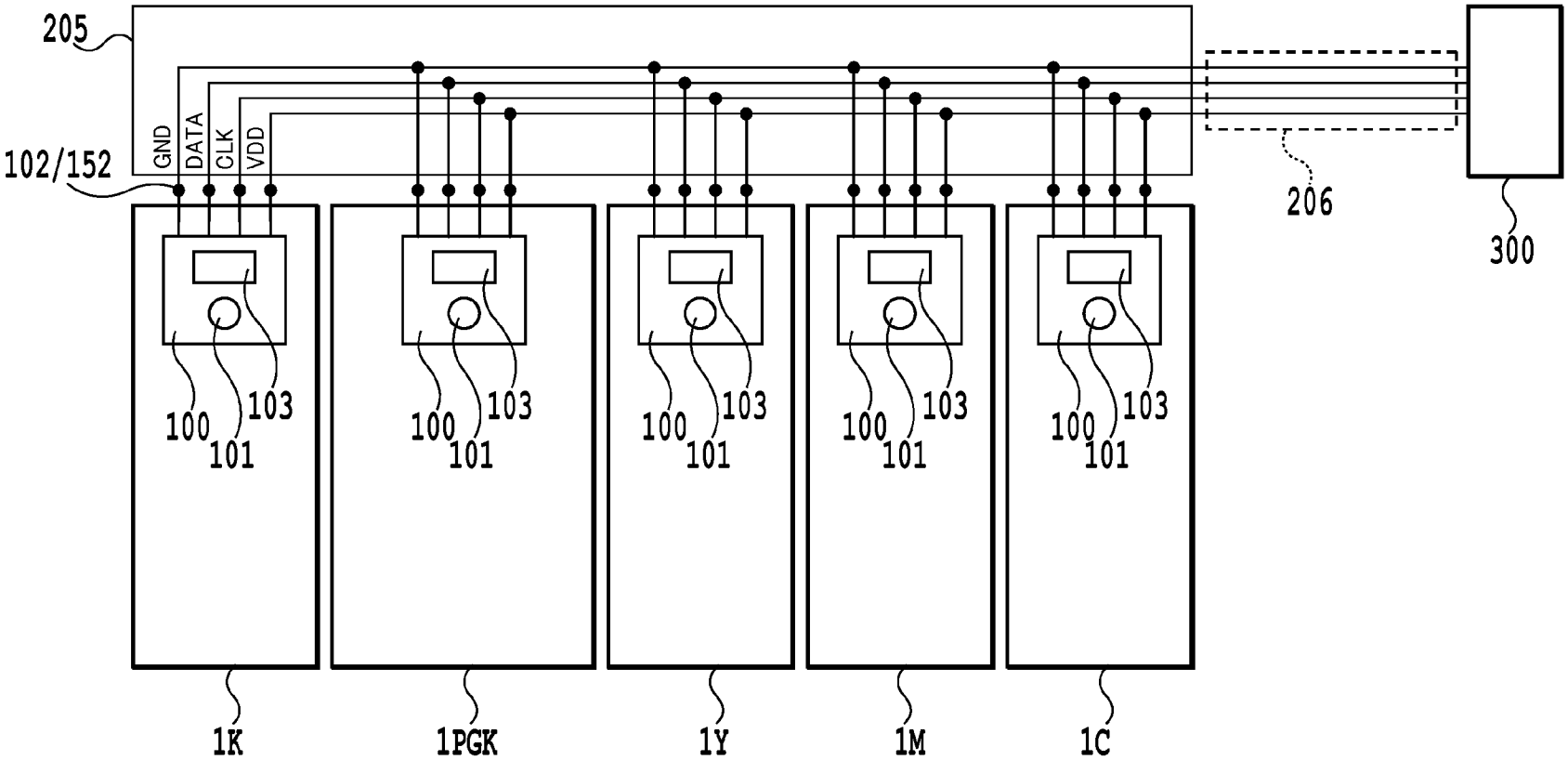
FIG. 9 is a diagram illustrating a configuration of signal wirings for making a signal connection between a control circuit 300 of the above inkjet printer and the ink tanks.

FIG. 9 is a diagram illustrating a configuration of signal wirings that make an electrical connection between the main body side control circuit 300 and the tank side control circuits 103, including the flexible cable 206, on the basis of a relationship with the boards 100 of the respective ink tanks.

As illustrated in FIG. 9, the signal wirings for the ink tank 1 include four signal lines, which are signal wirings common to the four ink tanks 1 (so-called, bus connection). That is, the signal wirings for each of the ink tanks 1 includes a power supply signal line "VDD" and earth signal line "GND" that are intended for power supply for light emission of the light emitting part 101, operation of a functional element group 103 driving the light emitting part 101 and performing other operation, and the like. Also, the signal wirings include the four signal lines including a signal line "DATA" for transmitting from the control circuit 300 a control signal (control data) regarding processing such as lighting, blinking, or the like of the light emitting part 101, and a clock signal line "CLK" for the signal line "DATA", as will be described later. The present embodiment describes the four signal lines; however, the present invention is not limited to this, but for example, the earth signal line can be realized by another signal line to thereby omit the "GND" line. Also, the signal lines for "CLK" and "DATA" can be shared to make a one line configuration.

On the other hand, the board 100 of each of the ink tanks 1 is provided with: the control part 103 that is operated by the signals of the four signal lines; and the light emitting part 101 that is operated by the control part 103.

Figure 10A:
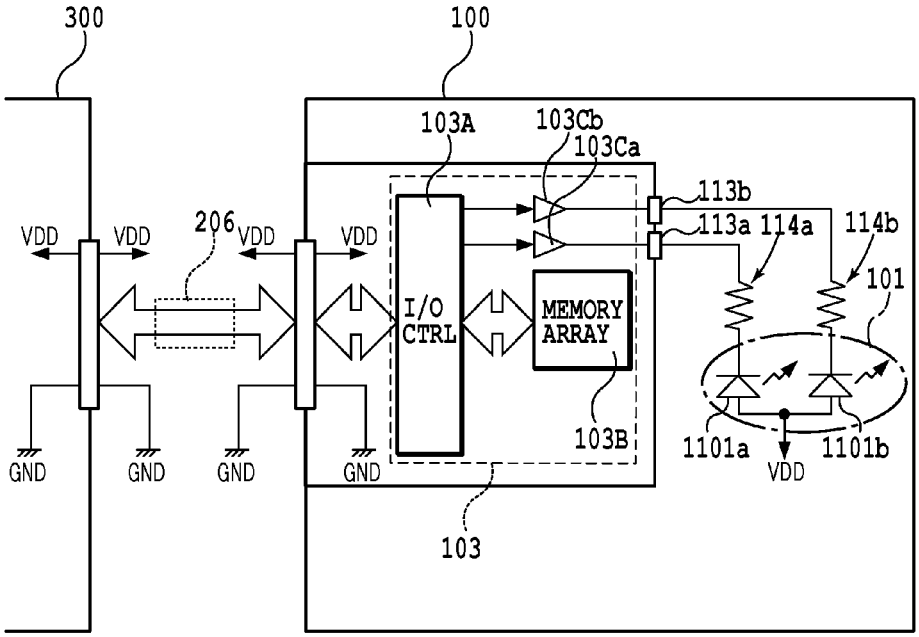
FIG. 10A is a circuit diagram illustrating details of the board 100 provided with the above control circuit 103.

FIG. 10A is a circuit diagram illustrating details of the board 100. As illustrated in the diagram, the control part 103 is configured to have an input/output control circuit (I/O CTRL) 103A, memory array 103B, and two light emitting element drivers 103Ca and 103Cb. Also, the light emitting part 101 has the first light emitting element 1101*a* and second light emitting element 1101*b* in the same package as two light emitting elements respectively having different peak emission wavelengths, and these light emitting elements are respectively driven by the above-described corresponding light emitting element drivers. Specifically, each of the light emitting elements is a three-terminal two peak wavelength LED. Note that, in the present embodiment, on the basis of the light emission from the light emitting part 101, the aftermentioned optical checking processing and ink tank state informing processing are performed; however, at the time of the optical checking processing, light emission of only the first light emitting element 1101*a* is controlled, whereas at the time of the ink tank state informing processing, light emission of only the second light emitting element 1101*b* is controlled. Details of these types of processing and characteristics of the light emitting part will be described later.

The input/output control circuit 103A functions as a drive control part that responds to the control data transmitted from the main body side control circuit 300 to control driving of the first and second light emitting elements 1101*a* and 1101*b* through the light emitting element drivers 103Ca and 103Cb, respectively. Also, along with this, the input/output control circuit 103A controls data writing/reading to/from the memory array 103B.

The memory array 103E is, in the present embodiment, of an EEPROM form; but may be another type of storage device. The memory array 103B can function as a storage part to store individual information on the ink tank 1. The individual information includes, for example, ink information indicating the type of ink contained in a tank, ID information indicating a specific number of the ink tank, manufacturing information indicating manufacture date and manufacture lot number of the tank, and others. In the case of the present embodiment, the memory array 103B stores at least the ink information.

The ink information can be written in a predetermined address of the memory array 103B corresponding to the type of ink contained in a tank at the time of delivery or manufacture of the ink tank. For example, the ink information is, as will be described with FIGS. 12A and 12B, used as information for identifying an ink tank. This enables an ink tank to be identified to perform writing of data to the memory array 103B or reading of data from the memory array 103B, and lighting/extinction of the light emitting part 101 of the ink tank to be controlled. The data written to or read from the memory array 103B can include, for example, data indicating an ink remaining amount or ink consumption of a tank. In the present embodiment, as described above, in addition to an optically detected ink remaining amount, the control circuit 300 counts the number of ejections for each of the printing heads on the basis of ejection data, and on the basis of this, obtains an ink remaining amount or ink consumption for each of the ink tanks. Then, there is performed processing of writing or reading ink amount information on the remaining amount, consumption, or the like to or from the memory array 103B of a corresponding ink tank. This enables the memory array 103B to hold the ink amount information as of then. The information can be used, for example, for remaining amount detection having higher accuracy that is performed in conjunction with the optical ink amount detection using the above prism, or to determine whether an attached ink tank is new, or has been used once and is reattached, or the like.

When a drive signal for the light emitting element driver 103Ca (103Cb) outputted from the input/output control circuit 103A is on, the light emitting element driver 103Ca (103Cb) operates so as to apply a power supply voltage to the first light emitting element 1101*a* (second light emitting element 1101*b*). This enables the first light emitting element 1101*a* (second light emitting element 1101*b*) to emit light. On the other hand, when the signal outputted from the input/output control circuit 103A is off, the light emitting element driver 103Ca (103Cb) operates so as not to apply the power supply voltage to the first light emitting element 1101*a* (second light emitting element 1101*b*). This enables the first light emitting element 1101*a* (second light emitting element 1101*b*) to be extinguished. Accordingly, when the light emitting element driver 103Ca (103Cb) signal outputted from the input/output control circuit 103A is in the on state, the first light emitting element 1101*a* (second light emitting element 1101*b*) keeps a lighting state, whereas when the above signal is in the off state, the first light emitting element 1101*a* (second light emitting element 1101*b*) keeps an extinction state. 113*a* (113*b*) represents a terminal for connecting an anode side of the first light emitting element 1101*a* (second light emitting element 1101*b*) to the light emitting element driver 103Ca (103Cb). Also, 115 denotes a terminal for connecting cathode sides of the first and second light emitting elements 1101*a* and 1101*b* to a ground line. 114*a* and 114*b* respectively denotes limiting resistors that determine currents conducted to the first and second light emitting elements 1101*a* and 1101*b*, which are inserted between outputs of the light emitting element drivers 103 and anodes of the light emitting part 101.

Figure 11:
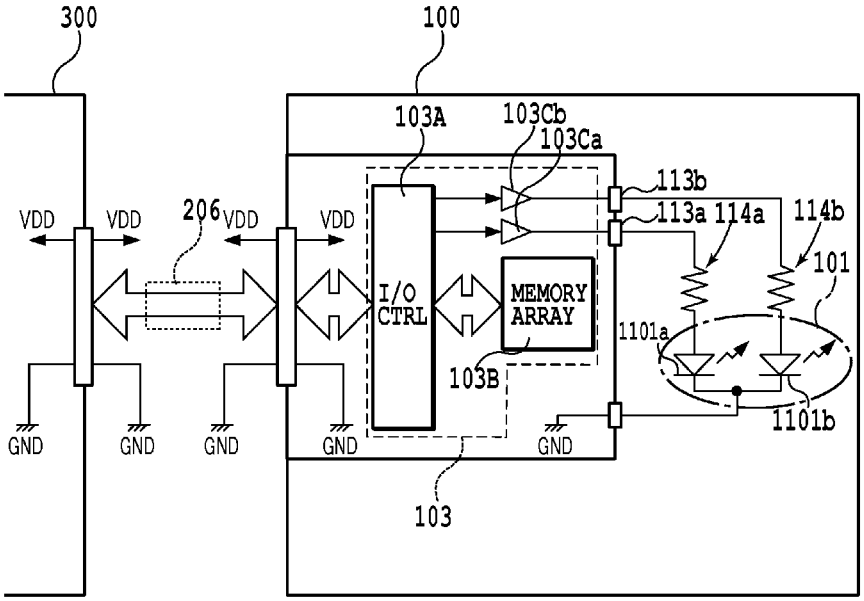
FIG. 11 is a circuit diagram illustrating a variation of the configuration of the board illustrated in FIG. 10A.

FIG. 11 is a circuit diagram illustrating a variation of the configuration of the board 100 illustrated in FIG. 10A. A point of difference of the variation from the example illustrated in FIG. 10A is that in the configuration in which the power supply voltage is applied to the light emitting element of the light emitting part 101, the power is supplied from a VDD power supply pattern provided inside the board 100 of the ink tank. The control part 103 is generally fabricated integrally on a semiconductor substrate, and has a configuration in which connection terminals on the semiconductor substrate are only LED connection terminals. Reducing the number of connection terminals largely affects an occupied area of the semiconductor substrate, and therefore cost of the semiconductor substrate can be reduced.

Figure 12A:
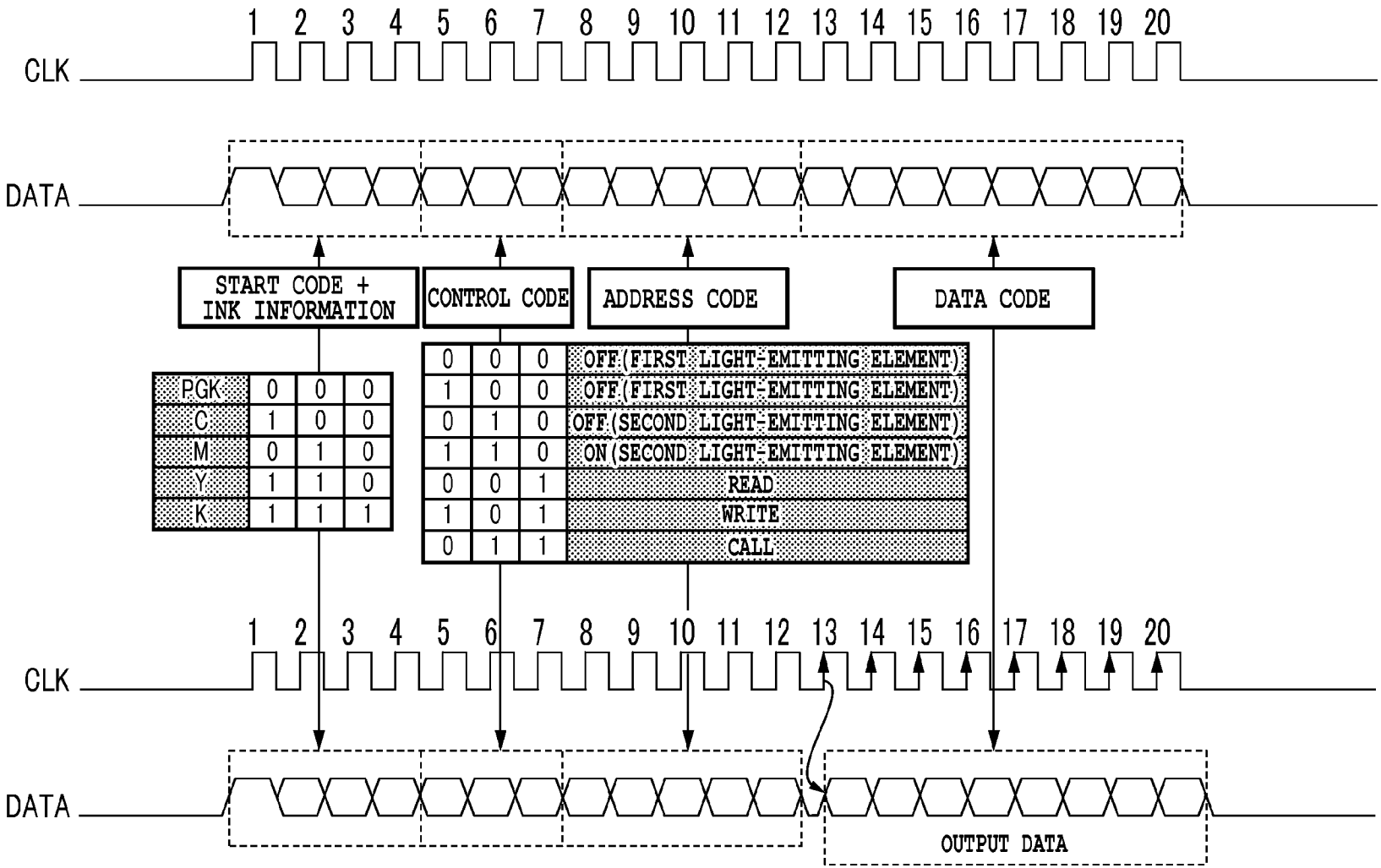
FIG. 12A is a timing chart for explaining data writing and reading operation with respect to a memory array of the above board.
Figure 12B:
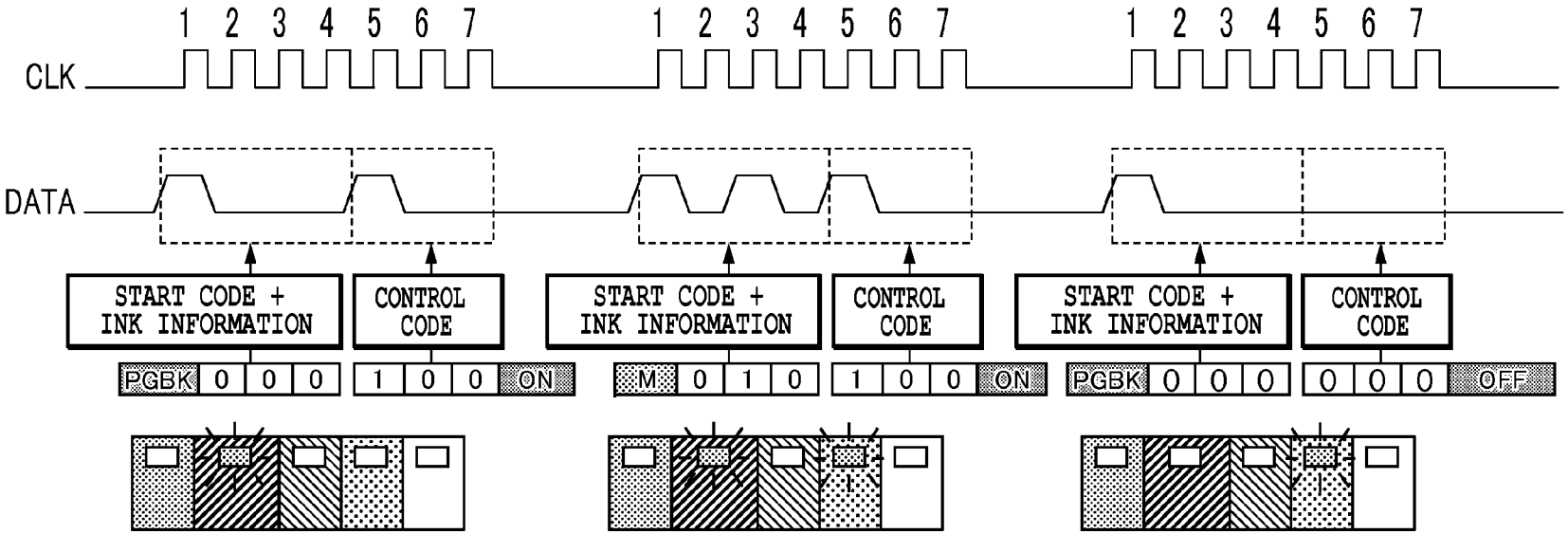
FIG. 12B is a timing chart for explaining lighting and extinction operation of a light emitting part 101.

FIG. 12A is a timing chart for explaining the above-described data writing and reading operation with respect to the memory array 103B. Also, FIG. 12B is a timing chart for explaining the lighting and extinction operation of the first and second light emitting elements 1101*a* and 1101*b*. When the main body side control circuit 300 transmits an instruction to a tank side control circuit 103, the control circuit 300 identifies the type of ink by using the ink information to thereby identify an instruction object ink tank.

As illustrated in FIG. 12A, in the writing to the memory array 103B, from the main body side control circuit 300 to the input/output control circuit 103A in the tank side control circuit 103, respective data signals for "Start code+Ink information", "Control code", "Address code", and "Data code" are transmitted through the signal line DATA (FIG. 9) in this order in synchronization with the clock signal CLK. "Start code+Ink information" means the start of the series of data signals through the "Start code" signal thereof, and identifies an ink tank 1 serving as a target for the series of data signals through the "Ink information" signal thereof.

As illustrated in the diagram, "Ink information" has a code corresponding to any of the types of ink "K", "PGK", "C", "M", and "Y", and the input/output control circuit 103A performs processing based on the subsequent data signals only if as a result of comparing the ink information indicated by the code and an ink information stored in the memory array 103B with each other, both of them coincide with each other, and if both of them do not coincide with each other, does not perform the processing based on the subsequent data signals.

Based on this, even if through the common signal line "DATA" illustrated in FIG. 9, the data signal is transmitted from the main body side control circuit 300 to the respective ink tanks 1 in common, an ink tank 1 can be identified by including the above-described ink information in the data signal, and the processing based on the subsequent data signals such as writing, reading, lighting and extinction of the first and second light emitting elements 1101*a* and 1101*b*, and the like can be performed only on the identified ink tank. In addition, it is clear from the above description that such a configuration using the common data signal line can be the same without being limited to the number of ink tanks.

"Control code" of the present embodiment indicates content of an instruction from the control circuit 300. As illustrated in FIG. 12A, "Control code" has codes corresponding to "ON" and "OFF" that are respectively used for the lighting control and extinction control of each of the first and second light emitting elements 1101*a* and 1101*b* of the light emitting part 101. "Control code" further has: codes corresponding to "READ" and "WRITE" respectively indicating reading and writing with respect to the memory array; and a "CALL" code for the main body side control circuit 300 to check the presence or absence of the ink tank 1. In the writing operation, the "WRITE" code follows the above "Ink information" that identifies an ink tank 1. The subsequent "Address code" indicates an address of the memory array, which serves as a writing destination, and the last "Data code" represents writing content (e.g., data indicating an ink consumption).

In addition, it should be appreciated that content represented by "Control code" is not limited to the above example, and for example, "Control code" can be used with being added with a control code on a verify command, continuous read command, or the like.

In reading, a configuration of data signals is the same as that in the above writing case, and also a code corresponding to "Start code+Color information" is taken in by the input/output control circuits 103A of all of the ink tanks in the same manner as in the above writing case, whereas subsequent data signals are taken in only by an input/output control circuit 103A of an ink tank on which "Color information" coincide with the "Color information" in the code. A point of difference is that, in synchronization with a rise of a first clock (thirteenth clock in FIG. 12A) after an address is specified by an address code, read data is outputted. Even in the case where the data signal terminals of the plurality of ink tanks are connected to such a common (one) data signal line, the input/output control circuits 103A intervene such that the read data does not collide with the other input signals.

In lighting or extinction of the light emitting part 101, as illustrated in FIG. 12B, similarly to the above, first, a data signal corresponding to "Start code+Color information" is transmitted from the main body side to the input/output control circuits 103A through the signal lines DATA. As described above, an ink tank is identified by the "Color information", and the lighting or extinction" of a light emitting element of a light emitting part 101 based on "Control code" to be subsequently transmitted is performed only on the identified ink tank. As described above with FIG. 12A, "Control code" related to the lighting or extinction includes a code corresponding to "ON (100, 110)" or "OFF (000, 010)" for each of the first and second light emitting elements 1101*a* and 1101*b*. Based on this, the first and second light emitting elements 1101*a* and 1101*b* of the light emitting part 101 can be individually independently controlled in lighting and extinction. When the control code corresponding to the first or second light emitting element 1101*a* or 1101*b* is "ON", the input/output control circuit 103A outputs, as described above with FIG. 11, an on signal to a corresponding light emitting element driver 103C, and then keeps the output state as well. On the other hand, when the control code is "OFF", the input/output control circuit 103A outputs an off signal to a corresponding light emitting element driver, and then keeps the output state as well. Note that actual performance timing of lighting or extinction of a light emitting element in the light emitting part 101 corresponds to a seventh or subsequent clock of the clock CLK for each of data signals illustrated in FIG. 12B.

In the example illustrated in FIG. 12B, in the first data signal present on the leftmost side of the diagram, "Ink information" is one that specifies the pigment black ink PGK (000), and "Control code" is one that indicates lighting of the first light emitting element 1101*a* (100). As a result, the pigment black ink tank 1PGK is identified to light the first light emitting element 1101*a* of the light emitting part 101 of the pigment black ink tank 1PGK. Then, in the second data signal, "Ink information" is one that specifies the magenta ink M (010), and "Control code" is one that indicates lighting of the first light emitting element 1101*a* (100). As a result, the light emitting part 101 of the pigment black ink tank 1PGK remains lit, and the first light emitting element 1101*a* in the light emitting part 101 of the magenta ink tank 1M is also lit. Subsequently, in the third data signal, "Ink information" is one that specifies the pigment black ink PGK (000), and "Control code" is one that indicates extinction of the first light emitting element 1101*a*. As a result, only the first light emitting element 1101*a* of the pigment black ink tank 1PGK is extinguished.

As can be seen from the above description, the blinking control of an LED becomes possible in such a way that the main body side control circuit 300 transmits data signals respectively including "Control codes" corresponding to lighting and extinction after having specified a corresponding ink tank. In this case, by setting a period in which the signals are transmitted, a blinking period can be controlled.

Next, the code corresponding to "CALL" in FIG. 12A is described. The "CALL" code is one of control codes that the main body side control circuit 300 transmits to the tank side control circuit 103, and typically used in ink tank attachment/detachment processing illustrated in FIG. 14. First, a data signal provided with "Start code+Ink information" and "Control code" (including a "CALL code") is transmitted from the main body side control circuit 300 to the input/output control circuit 103A of the control circuit 103 through the signal line DATA. The input/output control circuit 103A having received the "CALL" code checks whether or not the "Ink information" included in the transmitted data signal and "Ink information" stored in the memory array 103B coincide with each other. If it is checked that both of them coincide with each other, the control circuit 103B transmits a reply to the control circuit 300. On the other hand, if it is checked that both of them do not coincide with each other, the control circuit 103B does not transmit a reply to the control circuit 300. Based on this, for example, if the ink information is one that specifies the cyan ink C, the control circuit 300 can check whether or not the cyan ink tank is attached.

<2.3 Control Procedure>

Figure 13:
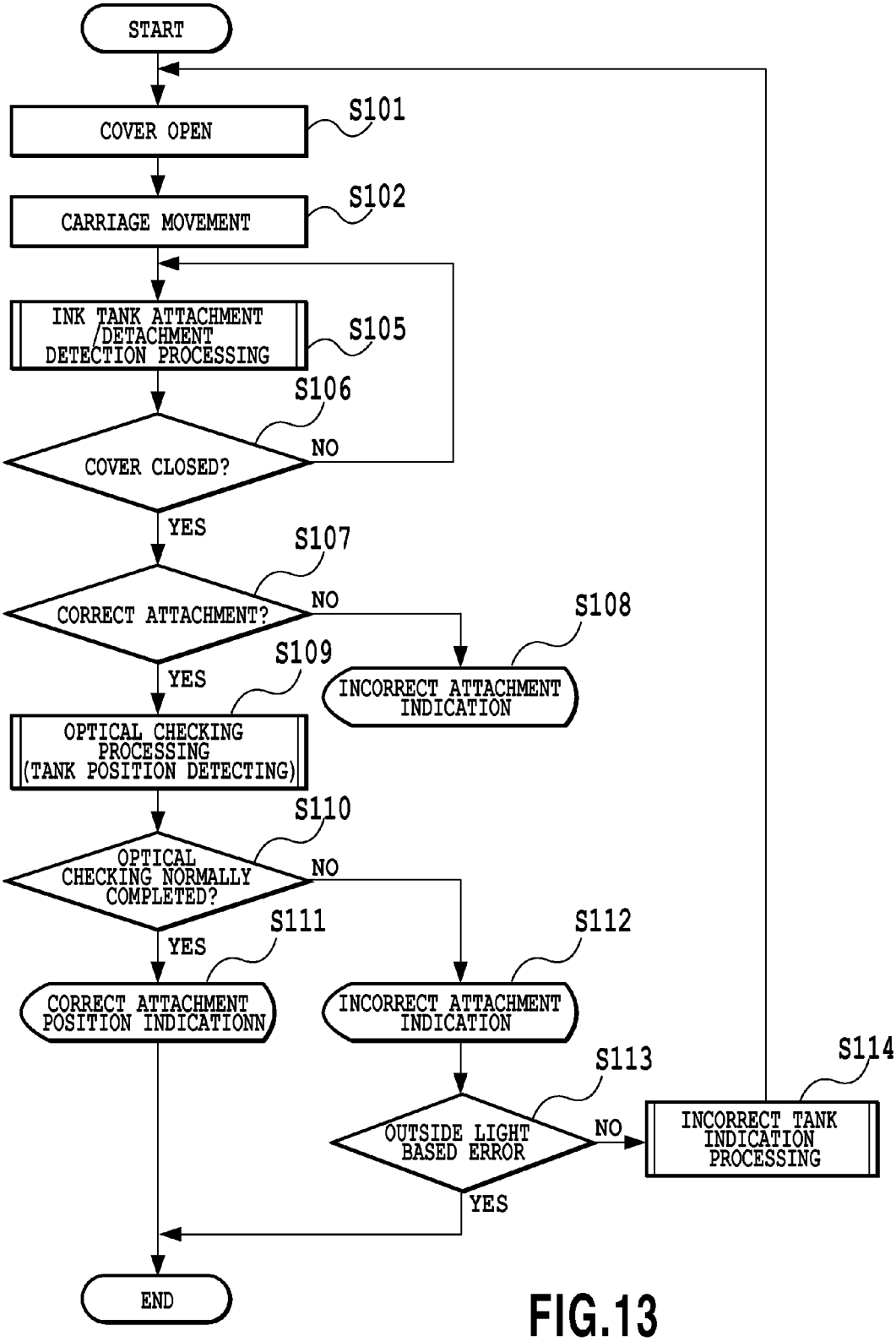
FIG. 13 is a flowchart illustrating a control procedure of ink tank attachment/detachment according to one embodiment of the present invention.

FIG. 13 is a flowchart illustrating a control procedure of the ink tank attachment/detachment based on the above-described configuration of the present embodiment. The flowchart is one that particularly illustrates control of lighting/extinction of a Light emitting element in a light emitting part 101 of each of the ink tanks 1 by the main body side control circuit 300 and a tank side control circuit 103.

When a user opens the main body cover 201 of the printer, the cover opening is sensed by an unillustrated sensor that is provided in the printer main body and detects an open/close state of the main body cover 201 (S101). Processing illustrated in FIG. 13 is one that is activated by sensing the cover opening. When the cover opening is sensed, in S103, the carriage is started to move to the "tank replacement position" set near the center of the carriage moving range, and in S105, ink tank attachment/detachment processing is performed.

Figure 14:
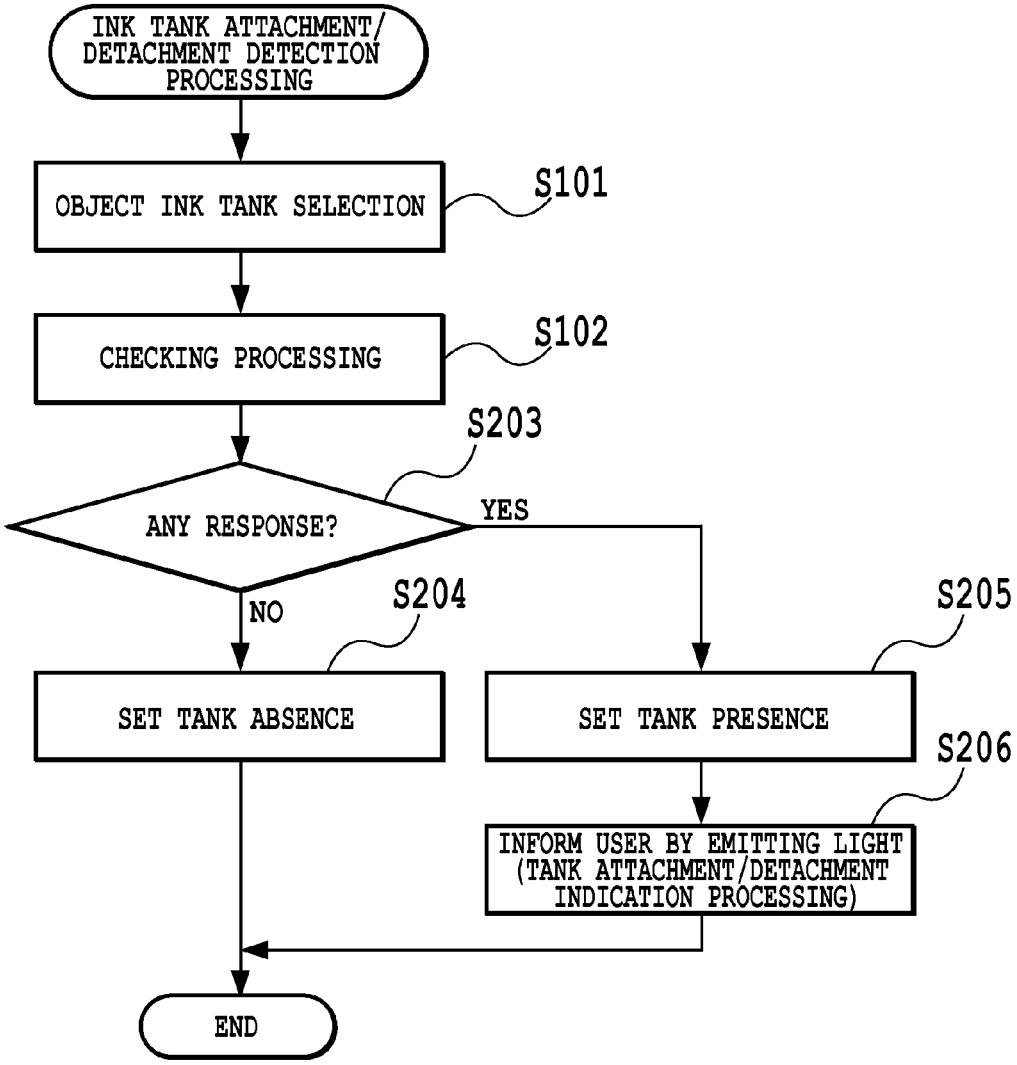
FIG. 14 is a flowchart illustrating details of the ink tank attachment/detachment processing in FIG. 13.

FIG. 14 is a flowchart illustrating details of the ink tank attachment/detachment processing. In S201, among the ink tanks 1K, 1PGK, 1Y, 1M, and 1C, an ink tank 1 to be processed is selected. Then, in S202, checking processing step is performed. In the checking processing step, first, as described above, the control circuit 300 transmits a data signal including "Ink information" and a "CALL" code corresponding to the ink tank 1 selected in S201 to the tank side control circuits 103. Each of the tank side control circuits 103 checks whether or not the "Ink information" included in the transmitted data signal and ink information stored in a corresponding memory array 103B coincide with each other. If it is checked that the both coincide with each other, the control circuit 103 transmits a reply to the control circuit 300. On the other hand, if it is checked that the both do not coincide with each other, the control circuit 103 does not transmit a reply to the control circuit 300.

In S203, the control circuit 300 checks the reply from the control circuit 103. If the control circuit 300 cannot check the reply from the control circuit 103, it is determined that the ink tank 1 selected in S201 is not attached to the carriage 205, and the flow proceeds to S204. Content of a processing step in S204 will be described later.

If the control circuit checks the reply from the control circuit 103, it is determined that the ink tank 1 selected in S201 is attached to the carriage 205, and the flow proceeds to S205, where a processing step associated with the attachment of the ink tank is performed as will be described later. Then, in S206, light emission control (e.g., lighting) of the second light emitting element 1101*b* is performed to inform the user of the correct attachment of the tank.

After the processing steps in S204 and S205, the series of processing steps are completed. The ink tank attachment/detachment processing including such processing steps is repeatedly performed until in S106 of FIG. 13, the above-described sensor senses that the main body cover 201 is closed. During the repeated processing, the respective ink tanks 1 are sequentially selected in S201.

Next, pieces of content of the processing steps in S204 and S205 are described. In S204, as information on the ink tank 1 selected in S201, information indicating that the ink tank 1 is not attached (non-attachment state) is stored in the RAM 302 of the printer. Also, a result of previous ink tank attachment/detachment processing of the ink tank 1, which is stored in the RAM 302, is referenced to determine whether or not an attachment state has changed to the non-attachment state. If the attachment state has changed to the non-attachment state, time counting of a period of non-attachment time of the ink tank 1 is started. In addition, in the case where in the first ink tank attachment/detachment processing of the ink tank 1, no reply is determined in S203 to perform the processing step in S204, that is, in the case where from the beginning it is determined to be the non-attachment state, the time counting of the period of non-attachment time is also started.

On the other hand, in S205, as information on the ink tank 1 selected in S201, information indicating that the ink tank 1 is attached (in the attachment state) is stored in the RAM 302 of the printer. Also, a result of previous ink tank attachment/detachment processing of the ink tank 1, which is stored in the RAM 302, is referenced to determine whether or not the non-attachment state has changed to the attachment state. If the non-attachment state has changed to the attachment state, the time counting of the period of non-attachment time of the ink tank 1 is completed to store a result of the time counting in the RAM 302. In addition, in the case where during the time counting of the period of non-attachment time, closing of the main body cover 201 is sensed by the above sensor in S106 of FIG. 13 to complete the ink tank attachment/detachment processing, the time counting of the period of non-attachment time is also simultaneously completed.

Then, it is determined whether or not at the time of the cover closing, there is any ink tank 1 having a period of non-attachment time exceeding a predetermined period of time, and if the predetermined period of time is exceeded, a recovery flag is made on in a predetermined area of the RAM 302. After that, only if it is determined that the optical checking processing has been normally completed in after-mentioned S110 of FIG. 13, the suction recovery processing using the recovery unit is performed on the basis of the recovery flag.

Referring to FIG. 13 again, if it is sensed in S106 that the main body cover 201 is closed, in S107, processing for checking whether or not ink tank attachment is correct (attachment checking processing) is performed. In the attachment checking processing, on the basis of processing similar to a method described in the checking processing in S202 of FIG. 14, it is checked whether or not pieces of ink information corresponding to the ink tanks to be mounted on the carriage are all prepared. That is, in the present embodiment, it is checked whether or not the five types of ink tanks (1K, 1PGK, 1Y, 1M, and 1C) are attached to the carriage.

More specifically, the control circuit 300 sequentially changes pieces of "Ink information" corresponding to the five types of ink tanks, and at the same time, transmits a data signal including "Ink information" and a "CALL" code to check a reply from the control circuits 103. If the control circuit 300 can obtain "Ink information" from each of the control circuits 103 of the five types of ink tanks (i.e., can obtain all of the five types of ink information), it determines that the attachment is correct, and the flow proceeds to the light checking processing in S109. On the other hand, if the control circuit 300 cannot obtain the five types of ink information, it is determined to be incorrect attachment, and the flow proceeds to S108. As the case where the five types of ink information cannot be obtained, there is, for example, a case where a plurality of ink tanks containing the same type (color) ink are attached to the carriage. If it is determined to be the incorrect attachment, the flow proceeds to S108, where an incorrect attachment indication is made, in which the indicator of the operation part 213 is blinked in orange.

<Optical Checking Processing>

Next, the optical checking processing in S109 is described. The optical checking processing is determination processing in which light from the light emitting part 101 is received in the light receiving part 210, and based on a result of the light reception, it is determined whether or not the ink tank is attached at a correct position.

In the optical checking processing, out of the two light emitting elements having different peak emission wavelengths of the light emitting part 101, only the first light emitting element 1101*a* (1101*a* in FIG. 10A) is driven to emit light. That is, control not making the second light emitting element 1101*b* emit light is performed.

The optical checking processing is based on the principle that, between the case where an ink tank 1 is attached to a correct attachment part and the case where the ink tank 1 is not attached to the correct attachment part, when the first light emitting element 1101*a* of the light emitting part 101 of the ink tank 1 is made to emit light, a result of reception of the light by the light receiving part 210 is different although a position of the carriage 201 is the same.

For example, the control circuit 300 can, when the carriage 205 is at a predetermined position, identify the type of ink to transmit a lighting instruction to the common wiring, and use a result of reception, by the light receiving part 210, of light emission of the first light emitting element 1101*a* based on the lighting instruction to determine whether or not an ink tank 1 containing the ink of the type identified by the lighting instruction is attached to a correct attachment part.

In this case, the type of ink subjected to the lighting instruction may be predetermined corresponding to a position of the carriage 205. As one configuration for the case, a configuration is possible, in which to each of a plurality of positions of the carriage 205, one type of ink subjected to the lighting instruction is allocated (the allocations are made, for example, to a position where the attachment part for the ink tank 1Y faces to the light receiving part, the yellow ink is allocated, to a position where the attachment part for the ink tank 1M faces to the light emitting part, the magenta ink is allocated, and so on). In this case, at each of the above plurality of positions, the first light emitting element 1101*a* of one ink tank subjected to the above lighting instruction is made to emit light, and a received light amount detected by the light receiving part 210 at this time (a light reception result associated with light emission at each of the plurality of positions) can be used to determine whether or not the ink tank is attached at a correct position.

Also, as another configuration, a configuration is possible, in which to each of a plurality of positions of the carriage 205, two or more types of inks subjected to the lighting instruction are allocated (the allocations are made, for example, to a position where the attachment part for the ink tank 1Y faces to the light receiving part, the yellow ink is allocated; to a position where the attachment part for the ink tank 1M faces to the light receiving part, the magenta ink is allocated; the cyan ink; and the yellow ink). In this case, at each of the above plurality of positions, the first light emitting elements of the light emitting parts 101 of the plurality of ink tanks subjected to the above lighting instruction are sequentially made to emit light, and received light amounts detected by the light receiving part 210 at this time (light reception results associated with sequential light emissions respectively at the plurality of positions) can be used to determine whether or not the ink tanks are attached at correct positions.

Further, with respect to one position of the carriage 205, the types of inks subjected to the lighting instruction may be sequentially changed to determine whether or not ink tanks are attached at correct positions. For example, the carriage 205 is moved and stopped such that the attachment part for the ink tank 1Y faces to the light receiving part 210, and the types of inks subjected to the lighting instruction, such as Y, M, and C are sequentially changed to make the light emitting elements in the light emitting parts emit light. If when an lighting instruction targeting Y is transmitted, a received light amount of the light receiving part 210 is most intense, it can be determined that the attachment part for the ink tank 1Y is attached with the ink tank 1Y.

As described, specific content of the optical checking processing can have various configurations, and these may be used together, or depending on the type of ink, a different configuration may be employed. Also, the optical checking processing may be performed on all types of ink tanks or some ink tanks.

<Ink Tank State Informing Processing>

Next, the ink tank state informing processing is described. Content informed to a used in the ink tank state informing processing includes an adequacy/inadequacy result of attachment positions determined by the above-described optical checking processing (incorrect tank indication processing), ink remaining amounts (ink absence indication processing), and correct attachment informing at the time of attachment/detachment of ink tanks (tank attachment/detachment indication processing). Also, a method for the processing is one that, as illustrated in FIG. 25, when a user opens the cover for ink tank replacement, controls light emission of the light emitting part 101 through lighting, blinking, extinction, or the like, and by visually checking a light emission state, informs the user of an ink tank state. Note that, when the present invention is carried out, as the ink tank state informing processing, all of the above-described incorrect tank indication processing, ink absence indication processing, and tank attachment/detachment indication processing may not be performed. For example, one of them may be performed or two of them may be performed in combination.

The above informing processing enables the user to know error content at the time of tank replacement, or which ink tank is in error or correctly attached, and therefore smooth ink tank replacement with few mistakes can be performed. Details of the processing will also be described later in the tank attachment/detachment indication processing in FIG. 14, and the incorrect tank indication processing in FIG. 13 both of which are described above, and the ink absence indication processing in FIG. 28. In the present embodiment, in the ink tank state informing processing, out of the two light emitting elements having different emission wavelengths, only the second light emitting element 1101*b* (1101*b* in FIG. 10A) is driven to emit light. That is, at this time, control not making the first light emitting element 1101*a* emit light is performed.

<Characteristics of First Light Emitting Element 1101*a* and Light Receiving Part 210 appropriate for Optical Checking Processing>

Characteristics of the first light emitting element 1101*a* of the light emitting part 101 and the light receiving part 210 used for the optical checking processing are described. Depending on use environment of the printer, usage of the printer by a user, or the like, outside light may enter the printer 200 at the time of the optical checking processing. If, in an environment where a light amount of the entering outside light is large, the optical checking processing is performed, the light receiving part detects the intense outside light, which may cause a determination error. For example, even in the case where the main body cover 201 is closed, from a gap on the ASF side or discharge tray side, intense outside light may enter. Also, in the case where during the optical checking processing (at the time of light emission or light reception), the main body cover 201 is opened, or as will be described later with respect to a fourth embodiment of the present invention, in the case where the optical checking processing is performed in the cover open state, a light amount of outside light entering the printer is likely to increase at the time of the optical checking processing.

Figure 15A:
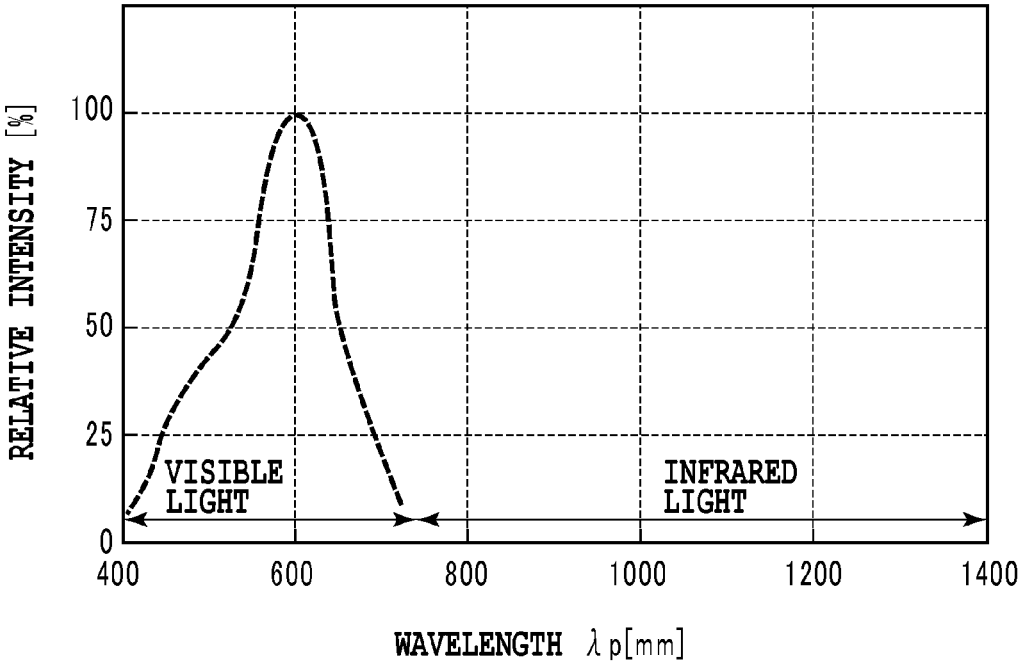
FIG. 15A is a diagram illustrating an emission wavelength range and peak emission wavelength of a fluorescent lamp serving as outside light.

FIG. 15A is a diagram illustrating an emission wavelength range and peak emission wavelength of a fluorescent lamp as a typical example of the outside light. As illustrated in the figure, the emission wavelength range of the fluorescent lamp is not less than 400 nm and not more than 750 nm, and the peak emission wavelength is around 600 nm.

Figure 15B:
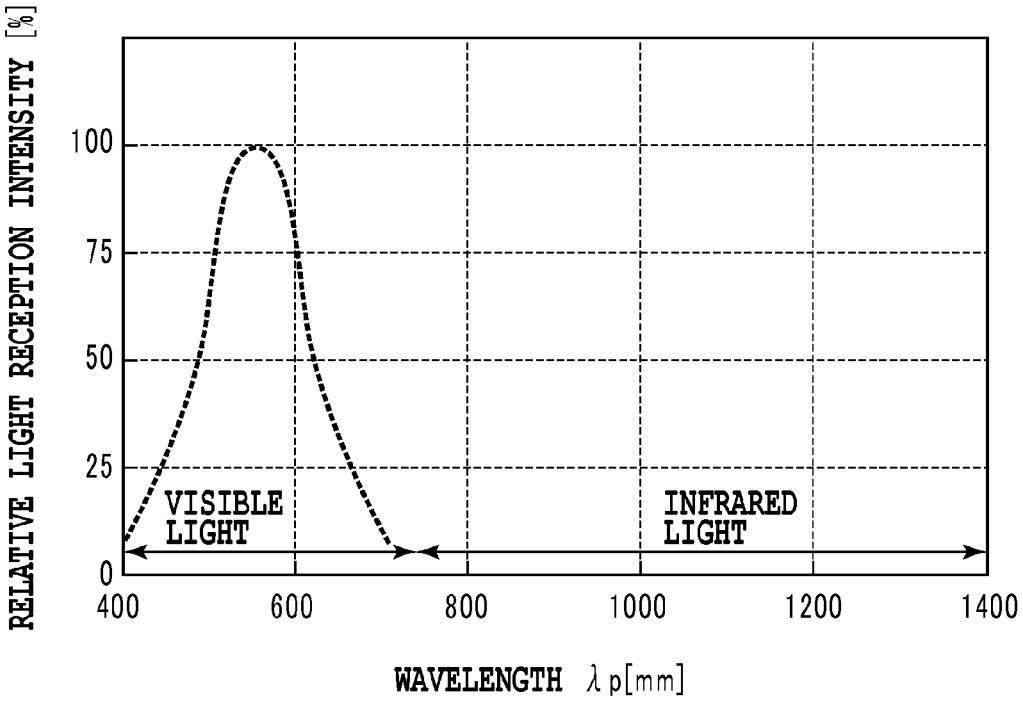
FIG. 15B is a diagram illustrating light reception sensitivity characteristics of a light receiving element of which a peak sensitivity wavelength is within a visible light range.
Figure 15C:
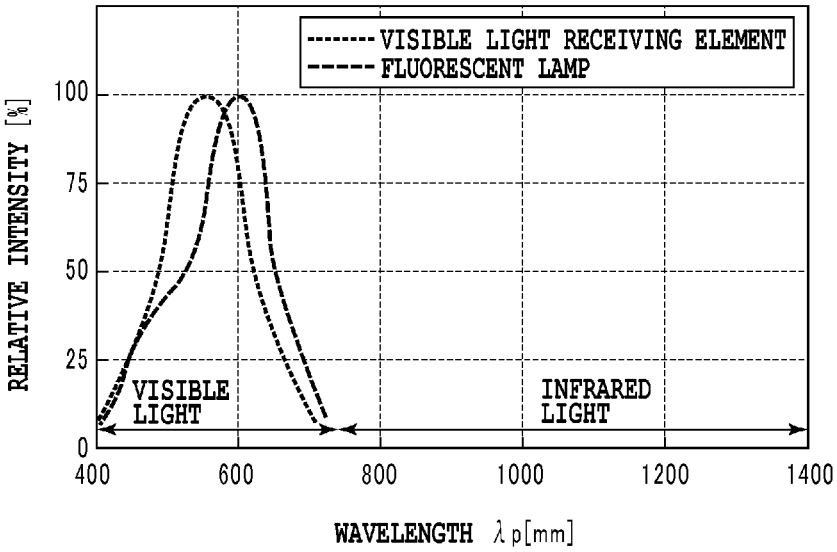
FIG. 15C is a diagram in which the wavelength range of the fluorescent lamp illustrated in FIG. 15A and the wavelength range of the light receiving element illustrated in FIG. 15B are illustrated with being superimposed.

On the other hand, FIG. 15B is a diagram illustrating characteristics of a light receiving element of which a peak sensitivity wavelength is within a visible light range, and as illustrated in the figure, a light reception wavelength range of the light receiving element is not less than 400 nm and not more than 700 nm, and the peak sensitivity wavelength is around 580 nm. FIG. 15C is a diagram in which the wavelength range of the fluorescent lamp illustrated in FIG. 15A and the wavelength range of the visible light receiving element illustrated in FIG. 15B are illustrated with being superimposed. As is clear from FIG. 15C, the light receiving element as in FIG. 15B has a large overlap area with respect to the wavelength range and intensity (sensitivity) of the fluorescent lamp as the outside light. As a result, the light receiving element having such a peak sensitivity wavelength in the visible light range is increased in relative sensitivity to the outside light (fluorescent lamp), and therefore likely to cause an outside light based determination error due to influence of the outside light.

Therefore, in the present embodiment, a light receiving element of which a peak sensitivity wavelength range is within a range not less than 760 nm and not more than 1100 nm corresponding to an infrared range is used for the light receiving part 210. Considering that the influence of the outside light is further eliminated, the peak sensitivity wavelength of the light receiving element in the light receiving part 210 is, preferably within a range not less than 780 nm and not more than 950 nm, and more preferably within a range not less than 850 nm and not more than 940 nm.

Figure 16A:
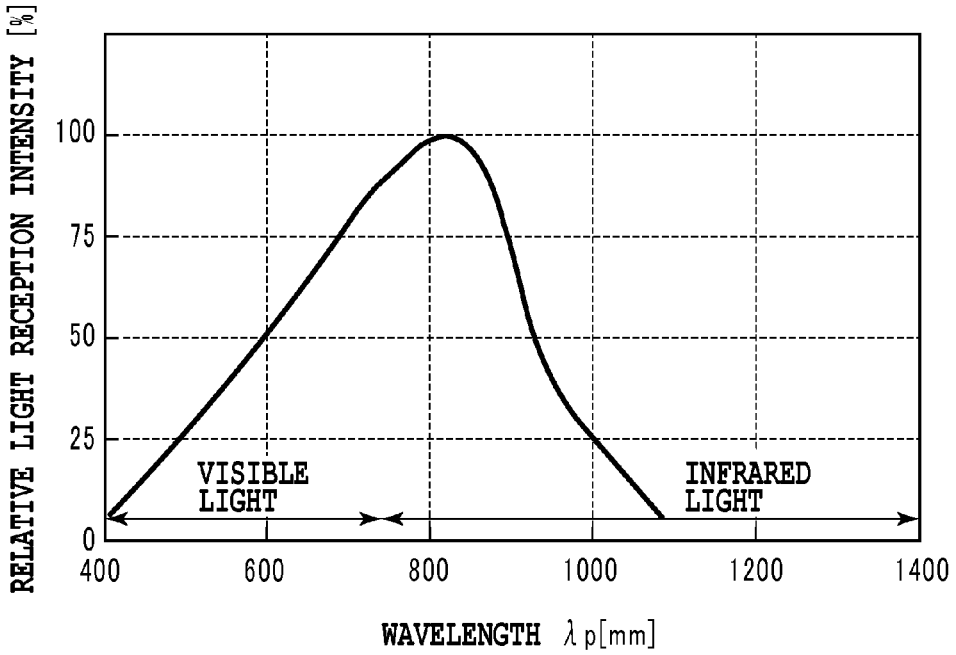
FIG. 16A is a diagram illustrating light reception sensitivity characteristics of a light receiving element applicable in the present invention, and FIG. 16 B is a diagram in which a wavelength range of the light receiving element illustrated in FIG. 16A is illustrated with being superimposed.
Figure 16B:
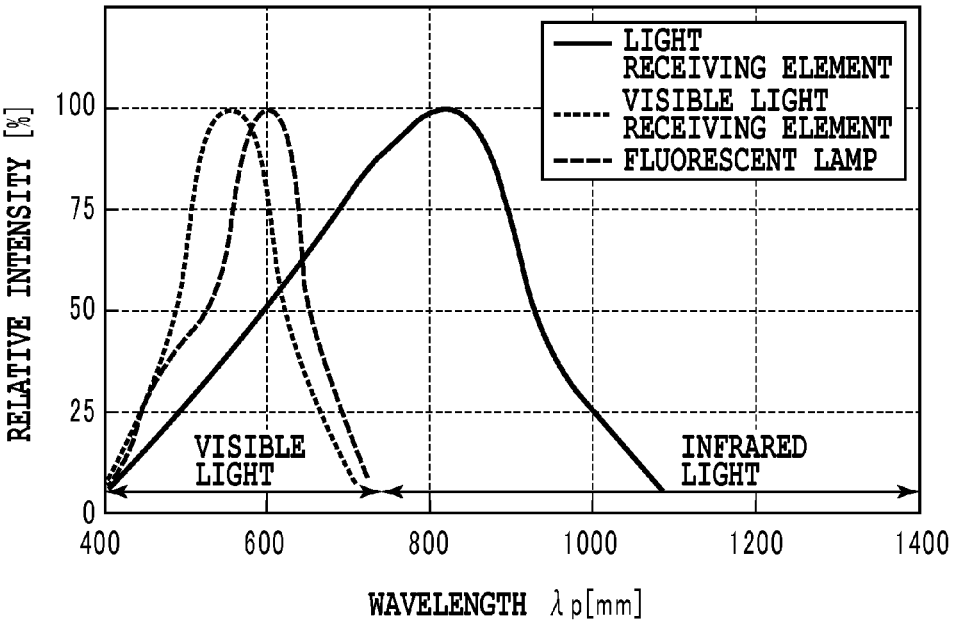

FIG. 16A is a diagram illustrating light reception sensitivity characteristics of a light receiving element applicable as the light receiving part 210. In this example, a sensitivity wavelength range of the light receiving element is not less than 400 nm and not more than 1100 nm, and a peak sensitivity wavelength is 800 nm. FIG. 16B is a diagram in which the wavelength ranges of the fluorescent lamp and the visible light receiving element illustrated in FIG. 15C and the wavelength range of the light receiving element of the present embodiment illustrated in FIG. 16A are illustrated with being superimposed.

As is clear from FIG. 16B, the peak sensitivity wavelength of the light receiving element of the present embodiment illustrated in FIG. 16A is out of the emission wavelength range of the fluorescent lamp. Also, the peak sensitivity wavelength of the light receiving element of the present embodiment illustrated in FIG. 16A is more largely displaced from the peak emission wavelength of the fluorescent lamp than the peak sensitivity wavelength of the light receiving element illustrated in FIG. 15B. Further, the light receiving element of the present embodiment illustrated in FIG. 16A has lower light reception sensitivity around the peak emission wavelength of the fluorescent lamp than the light receiving element illustrated in FIG. 15B. For this reason, rather than using the light receiving element as illustrated in FIG. 15B, using the light receiving element having the peak sensitivity wavelength in the infrared range as illustrated in FIG. 16A enables the outside light based determination error to be reduced.

For such a light receiving element of the present embodiment, as the first light emitting element 1101*a* of the light emitting part 101, there is used a light emitting element (e.g., infrared LED) having a peak emission wavelength in the infrared region (range not less that 760 nm, preferably not less than 760 nm and not more than 1100 nm), which can be received by the light receiving part 210. That is, the reason to use the first light emitting element 1101*a* having such emission characteristics is because the peak sensitivity wavelength of the light receiving element in the light receiving part 210 is within the infrared range, and sensitivity of the light receiving element in the visible light range is low.

As described, the present embodiment uses the first light emitting element 1101*a* having the peak emission wavelength relatively close to the peak sensitivity wavelength of the light receiving element in the light receiving part 210. Based on this, as compared with the case of using the first light emitting element having the peak emission wavelength relatively distant from the peak sensitivity wavelength of the light receiving element, to obtain the same level of light reception sensitivity, an emission intensity of the light emitting element can be reduced, and consequently power consumption can be reduced. From the above points, the peak emission wavelength of the first light emitting element 1101*a* of the present embodiment is preferably within the range not less than 760 nm and not more than 1100 nm. More preferably, the peak emission wavelength of the first light emitting element 1101*a* is within the range not less than 780 nm and not more than 950 nm.

Figure 17A:
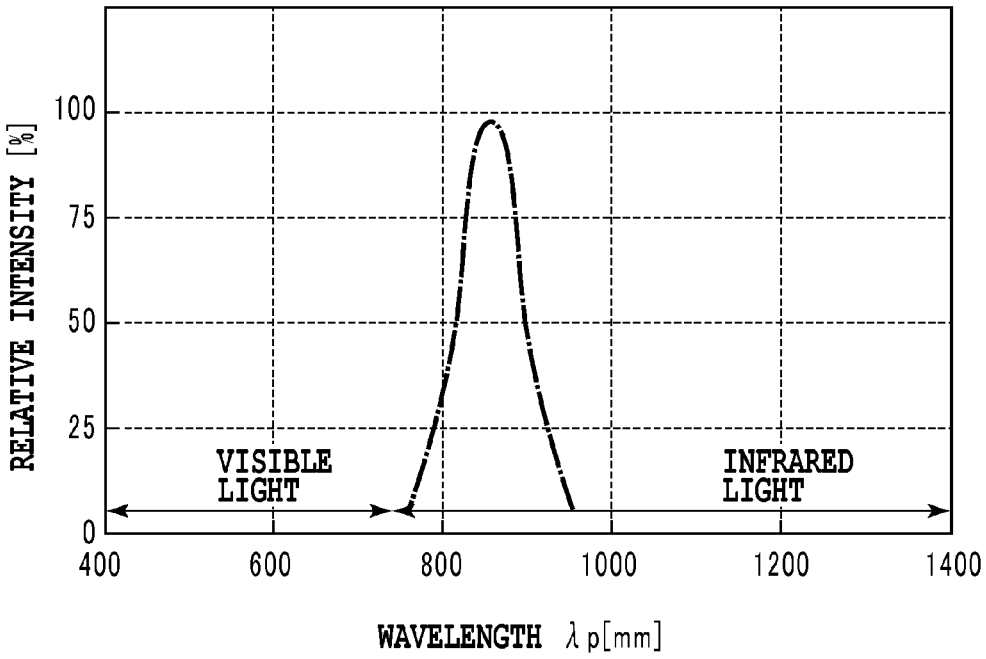
FIG. 17A is a diagram illustrating emission characteristics of a light emitting element applicable in the present embodiment.

As an example of such a light emitting element, an infrared LED having emission characteristics, for example, as illustrated in FIG. 17A is preferable. FIG. 17A is a diagram illustrating emission characteristics of a first light emitting element 1101*a* applicable in the present embodiment. As illustrated in the figure, an emission wavelength range of the first light emitting element 1101*a* is not less than 780 nm and not more than 960 nm, and a peak emission wavelength of the light emitting part is 870 nm.

Figure 17B:
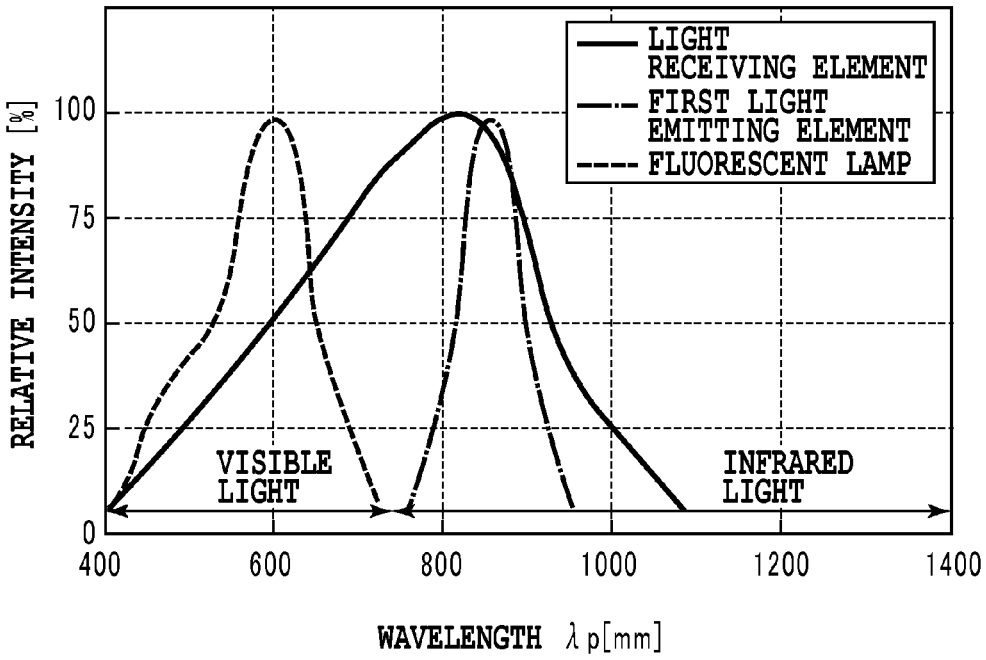
FIG. 17B is a diagram in which the wavelength range of the fluorescent lamp illustrated in FIG. 15A, the wavelength range of the light receiving element illustrated in FIG. 15B, and the wavelength range of the light emitting part illustrated in FIG. 17A are illustrated with being superimposed.

FIG. 17B is a diagram in which the wavelength range of the fluorescent lamp illustrated in FIG. 15A, the wavelength range of the light receiving element illustrated in FIG. 16A, and the wavelength range of the first light emitting element illustrated in FIG. 17A are illustrated with being superimposed. As is clear from FIG. 17B, by using the light receiving element having the peak sensitivity wavelength in the infrared range and the first light emitting element having the peak emission wavelength in the infrared range, the influence of the outside light (fluorescent lamp) can be reduced to perform the optical checking processing.

Figure 18A:
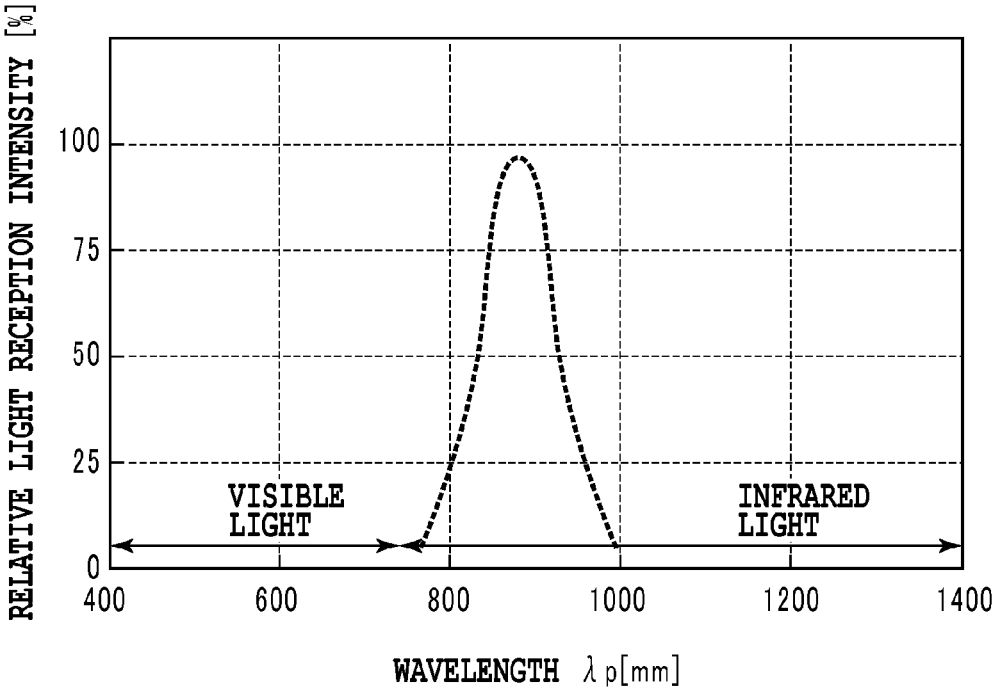
FIG. 18A is a diagram illustrating light reception sensitivity characteristics of another light receiving element applicable in the present invention.

FIG. 18A is a diagram illustrating light reception sensitivity characteristics of another example (a light receiving element different from the light receiving element in FIG. 16A) of the light receiving element applicable in the present embodiment. As illustrated in FIG. 18A, the light receiving element has a sensitivity wavelength range not less than 760 nm and not more than 1000 nm, and a peak sensitivity wavelength of 850 nm. FIG. 185 is a diagram in which the wavelength range of the fluorescent lamp illustrated in FIG. 15A and the wavelength range of the light receiving element illustrated in FIG. 18A are illustrated with being superimposed. As is clear from FIG. 18B, the sensitivity wavelength range of the light receiving element illustrated in FIG. 18A is out of the emission wavelength range of the fluorescent lamp, and therefore rather than using the light receiving element illustrated in FIG. 16A, the outside light (e.g., fluorescent lamp) based determination error can be further reduced.

Figure 19A:
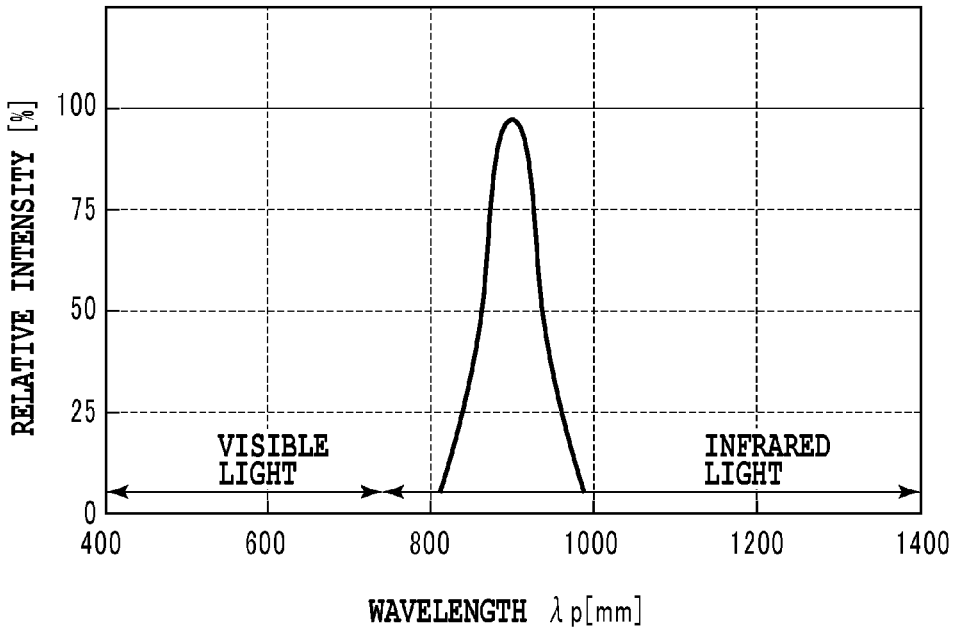
FIG. 19A is a diagram illustrating emission characteristics of another light emitting element applicable in the present invention.

As the first light emitting element used in combination with the light receiving element illustrated in FIG. 18A, one having a peak emission wavelength of 760 nm or more is applicable; however, as a preferable element, a light emitting element having emission characteristics illustrated in FIG. 19A can be cited. FIG. 19A is a diagram illustrating emission characteristics of another example (a light emitting element different from the light emitting element in FIG. 17A) of the first light emitting element applicable in the present embodiment. An emission wavelength range of the first light emitting element is not less than 810 nm and not more than 970 nm, and a peak emission wavelength is 890 nm.

Figure 18B:
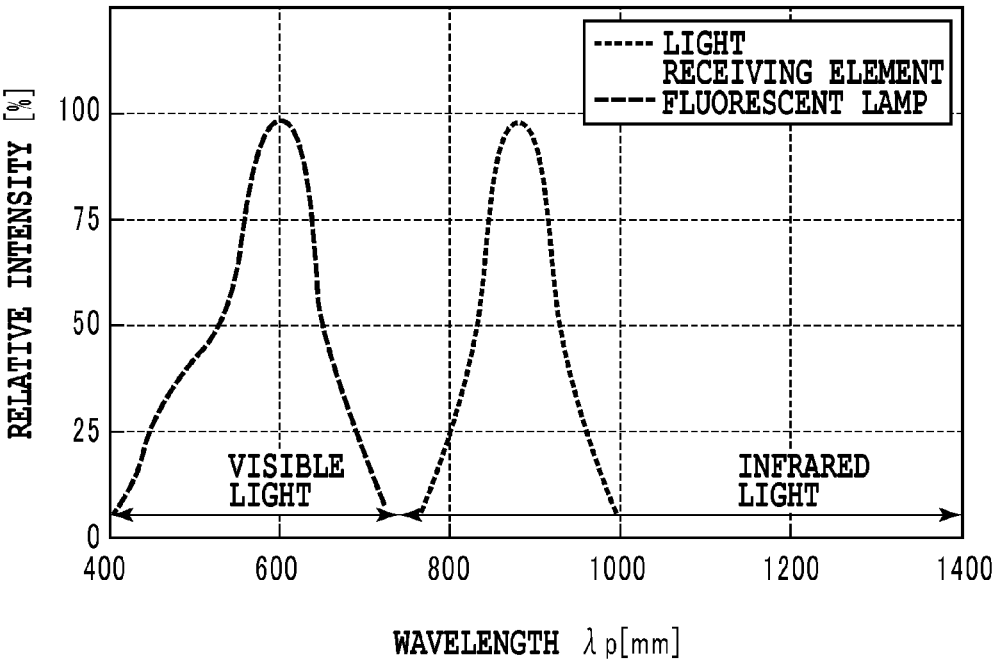
FIG. 18B is a diagram in which the wavelength range of the fluorescent lamp illustrated in FIG. 15A and the wavelength range of the light receiving element illustrated in FIG. 18A are illustrated with being superimposed.
Figure 19B:
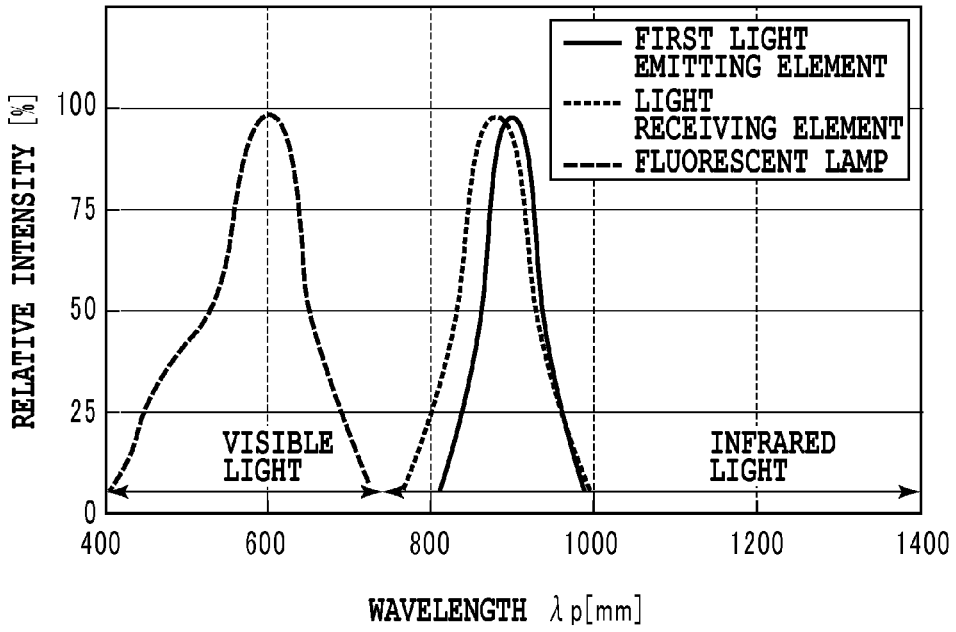
FIG. 19B is a diagram in which the wavelength range of the first light emitting element illustrated in FIG. 19A is illustrated with being superimposed on the overlapped wavelength range illustrated in FIG. 18B.

FIG. 19B is a diagram in which the wavelength range of the first light emitting element illustrated in FIG. 19A is illustrated with being superimposed on the characteristics illustrated in FIG. 18B. As is clear from FIG. 19B, based on the combination of the first light emitting element illustrated in FIG. 19A and the light receiving element illustrated in FIG. 18A, rather than the combination of the light receiving element illustrated in FIG. 16A and the first light emitting element illustrated in FIG. 17A, the optical checking processing can be performed with the influence of the outside light being further reduced.

Note that the first light emitting element in FIG. 19A and the light receiving element in FIG. 16A can also be used in combination, or the first light emitting element in FIG. 17A and the light receiving element in FIG. 18A can also be used in combination. Also, in the present embodiment, any first light emitting element is applicable if it has a peak emission wavelength of 760 nm or more that can be received in the light receiving part, and in addition to the first light emitting elements illustrated in FIGS. 17A and 19A, any infrared LED having a peak emission wavelength of, for example, 900 nm, 940 nm, 950 nm, or the like is also applicable.

<Characteristics of Second Light Emitting Element Appropriate for Ink Tank State Forming Processing>

The second light emitting element 1101*b* of the light emitting part 101 used to perform the ink tank state informing processing is described. In the present embodiment, the light emitting part 101 is provided with the two light emitting elements having different peak emission wavelengths. In the ink tank state informing processing, only the second light emitting element 1101*b* is adapted to be driven to emit light, whereas the first light emitting element 1101*a* is adapted not to emit light. As described, in the present embodiment, the light emitting part 101 is configured to individually drive the first light emitting element 1101*a* appropriate for the optical checking processing and the second light emitting element 1101*b* appropriate for the ink tank state informing processing. Based on this, the above-described outside light based error in the optical checking processing can be reduced, and also usability can be improved by expansion of degree of freedom in the ink tank state informing.

Figure 20A:
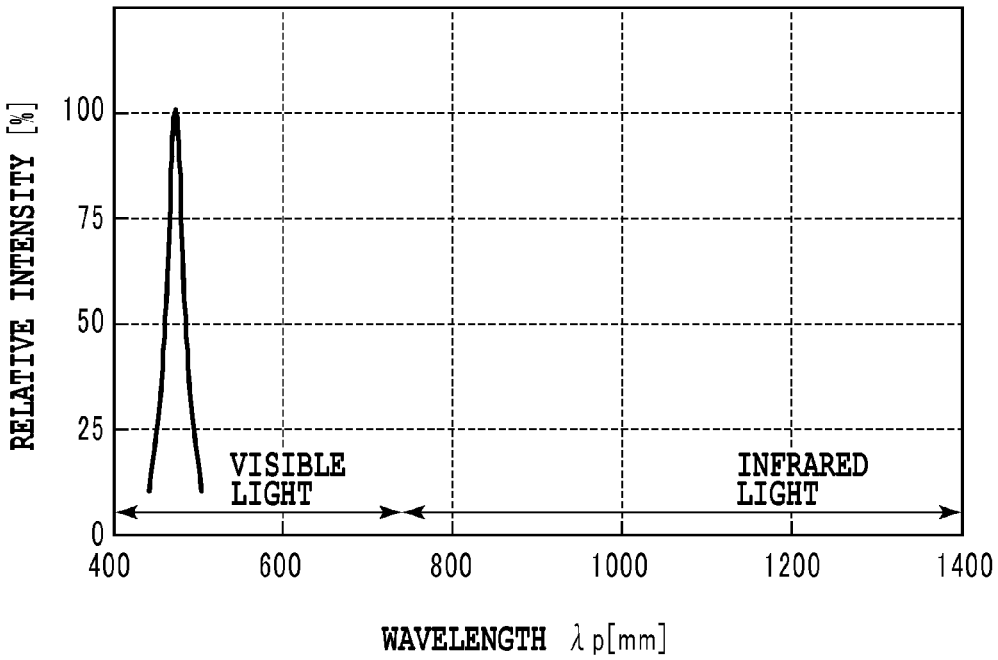
FIG. 20A is a diagram illustrating emission characteristics applicable in the present embodiment.

In the present embodiment, the second light emitting element 1101*b* of the light emitting part 101 is used only for the ink tank state informing, and therefore if an emission wavelength range is within the visible range, a light emitting element can be arbitrarily selected without any restriction. Preferably, the peak emission wavelength is within the range not less than 400 nm and not more than 760 nm corresponding to the visible light range. As an example of such a second light emitting element 1101*b*, for example, an LED having emission characteristics as illustrated in FIG. 20A is preferable. FIG. 20A is a diagram illustrating the emission characteristics of the second light emitting element 1101*b* applicable in the present embodiment. As illustrated in the figure, the second light emitting element 1101*b* is a blue LED having an emission wavelength range not less than 440 nm and not more than 500 nm and a peak emission wavelength of a light emitting part of 470 nm.

Figure 20B:
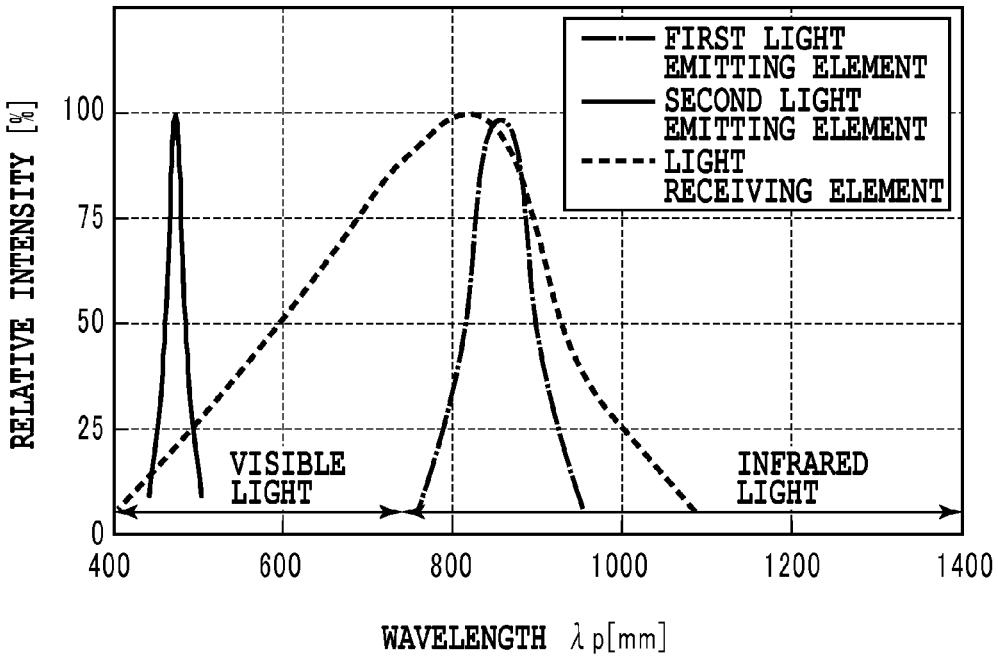
FIG. 20B is a diagram in which the wavelength ranges of the light emitting element illustrated in FIG. 20A, the light receiving element illustrated in FIG. 16A, and the light emitting element illustrated in FIG. 17A are illustrated with being superimposed.

FIG. 20B is a diagram in which the wavelength ranges of the second light emitting element illustrated in FIG. 20A according to the present embodiment, the light receiving element of the present embodiment illustrated in FIG. 16A, and the first light emitting element illustrated in FIG. 17A are illustrated with being superimposed. In the present embodiment, in the optical checking processing using the light receiving element, the second light emitting element is adapted not to emit light, and therefore essentially it is not necessary to consider the overlap in wavelength range between the second light emitting element and the light receiving element, or closeness between the peak emission wavelength and the peak sensitivity wavelength. However, for example, even in a configuration in which in the optical checking processing, the second light emitting element emits light along with the first light emitting element, the wavelength range of the second light emitting element is present only in a range where the light reception sensitivity of the light receiving element is extremely low. For this reason, the influence of the second light emitting element on the optical checking processing is small, and in combination with the use of the first light emitting element 1101*a* having the peak emission wavelength relatively close to the peak sensitivity wavelength of the light receiving element, accuracy of the optical checking processing can be improved.

A second light emitting element 1101*b* made to emit light in the ink tank state informing processing is applicable if in the present embodiment, a peak emission wavelength thereof is within the visible light range. For example, in addition to the second light emitting element 1101*b* illustrated in FIG. 20A, a red LED having a peak emission wavelength of 760 nm or 660 nm, a green LED having a peak emission wavelength of 530 nm, a violet LED having a peak emission wavelength of 400 nm, or the like can also be used.

<Specific Examples of Optical Checking Processing and Ink Tank State Informing Processing>

Figure 21:
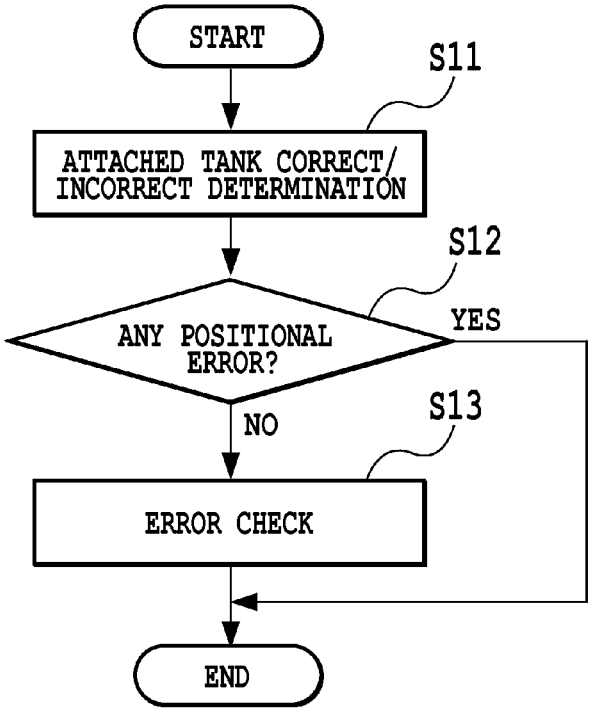
FIG. 21 is a flowchart illustrating a flow of optical checking processing.

Next, specific processing examples of the optical checking processing and the ink tank state informing processing are described. FIG. 21 is a flowchart illustrating the optical checking processing illustrated in S109 of FIG. 13. FIGS. 22A to 25K are diagrams for explaining attached tank correct/incorrect determination processing in S11 of FIG. 21. Also, FIGS. 26A to 26F are diagrams for explaining operation in error checking processing in S13 of FIG. 21.

Note that, in FIGS. 22A to 22K, 25A to 25K, and 26A to 26F, "K, PGK, Y, M, C" denoted in the carriage 205 respectively represent positions of the attachment parts to be attached with the dye black ink tank 1K, pigment black ink tank 1PGK, yellow ink tank 1Y, magenta ink tank 1M, and cyan ink tank 1C.

As illustrated in FIG. 8, in the present embodiment, the attachment part for dye black ink tank attachment (referred to as a "K attachment part"), the attachment part for pigment black ink tank attachment (referred to as a "PGK attachment part"), the attachment part for yellow ink tank attachment (referred to as a "Y attachment part"), the attachment part for magenta ink tank attachment (referred to as an "M attachment part"), and the attachment part for cyan ink tank attachment (referred to as a "C attachment part") are arrayed in this order from the left. Also, the present embodiment is configured such that because of a relationship between the moving range of the carriage 205 and the position of the light receiving part 210, the rightmost C attachment part cannot face to the light receiving part 210.

When the optical checking processing in S109 of FIG. 13 is started, first, in S11 of FIG. 21, there is performed processing (attached tank correct/incorrect processing) that determines whether or not the five ink tank attachment parts are respectively attached with the correct ink tanks.

Figures 22A, 22B, 22C, 22D, 22E, 22F, 22G, 22H, 22I, 22J, 22K:
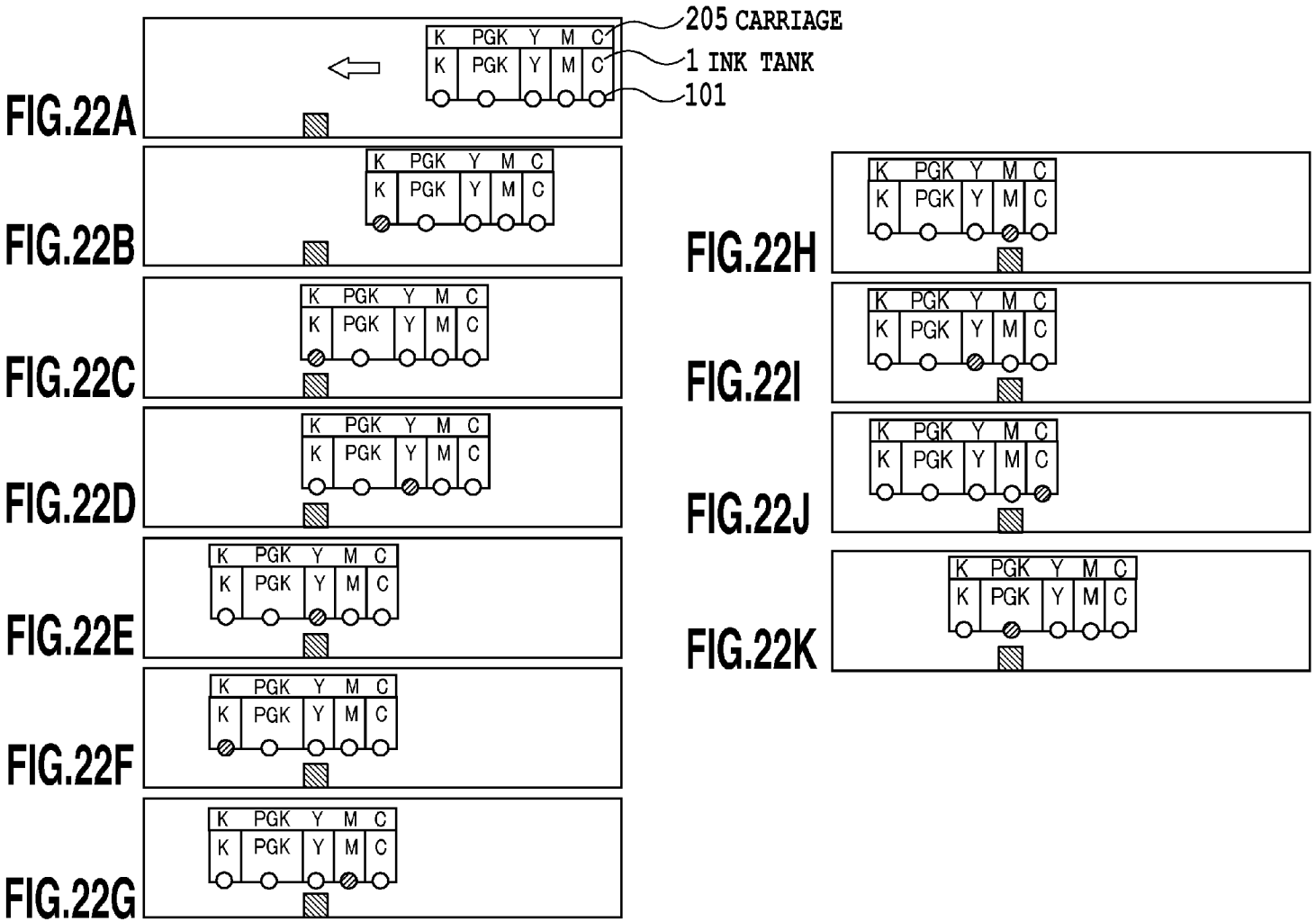
FIGS. 22A to 22K are diagrams for explaining operation of the optical checking processing for the case where all attachment parts are attached with correct ink tanks.

FIGS. 22A to 22K are explanatory diagrams of operation for the case where all of the attachment parts are attached with the correct ink tanks. When the carriage 205 is at a home position, the first light emitting elements 1101*a* of the light emitting parts 101 (hereinafter may be described as simply the first light emitting elements 1101*a*) serving as the light emitting parts of the ink tanks 1 are in the extinction state. First, as illustrated in FIG. 22A, the carriage 205 at the rightmost home position not illustrated in the diagram starts to move to a position facing to the light receiving part 210.

Then, as illustrated in FIG. 22B, before the carriage 205 reaches the position facing to the light receiving part 210, the first light emitting element 1101*a* of the dye black ink tank 1K that should be attached in the leftmost K attachment part is lit. Subsequently, with the first light emitting element 1101*a* of the dye black ink tank 1K being lit, the carriage 205 is moved from the position in FIG. 22B to a position in FIG. 22C to, as illustrated in FIG. 22C, make the K attachment part face to the light receiving part 210.

Note that the lighting (light emission) of the first light emitting element 1101*a* of the dye black ink tank 1K is performed in the following manner. First, the main body side control circuit 300 transmits a data signal including "Ink information" specifying the dye black ink and "Control code" indicating lighting to the common wiring. The data signal is inputted to the control circuits 103 of the five ink tanks (1K, 1PGK, 1Y, 1M, and 1C) through the common wiring. Then, each of the control circuits 103 of the five ink tanks compares the "Ink information" included in the data signal transmitted from the main body side control circuit 300 through the common wiring with "Ink information" stored in the memory thereof. If the pieces of ink information compared with each other coincide with each other, control to light the first light emitting element 1101*a* is performed, whereas if the pieces of ink information compared with each other do not coincide with each other, the control to light the first light emitting element 1101*a* is not performed. In the case of FIG. 22B, the "Ink information" included in the data signal is one that specifies the dye black ink, and therefore only the control circuit 103 provided on the dye black ink tank 1K performs the control to light the first light emitting element 1101*a* provided on the same tank. On the other hand, the control circuits 103 provided on the other ink tanks (1PGK, 1Y, 1M, and 1C) do not perform the control to light the first light emitting element 1101*a*. Based on this, even in the case where the data signal is transmitted from the main body side control circuit 300 to the respective ink tanks 1 in common, only the first light emitting element 1101*a* of the one specified ink tank can be made to emit light. In the above, the case where the first light emitting element 1101*a* of the dye black ink tank is made to emit light is described; however, it should be appreciated that the same holds true for a mechanism to make a light emitting part of any of the other ink tanks emit light.

Subsequently, a received light amount (1) of the light receiving part 210 at the time when the first light emitting element 1101*a* of the dye black ink tank 1K is lit is detected, and information of the received light amount (1) is stored in the RAM 302 as "K/Center". If the K attachment part is attached with the dye black ink tank 1K, between received light amounts regarding the tank 1K ("K/Center" and "K/Right"), the received light amount "K/Center" is maximum.

After the first light emitting element 1101*a* of the dye black ink tank 1K has been extinguished, a received light amount at this position is obtained as a background light amount (10), and information on the background light amount (10) is stored as "K/BG". Note that the background light amount corresponds to a light amount of light from the outside (outside light). The reason to obtain the above background light amount will be described later.

Then, without changing the position of the carriage 205, as illustrated in FIG. 22D, the first light emitting element 1101*a* of the yellow ink tank 1Y that should be attached to the Y attachment part adjacent to the K attachment part except the PGK attachment part is lit. Also, a received light amount (2) of the light receiving part 210 at the time when the first light emitting element 1101*a* of the yellow ink tank 1Y is lit is detected, and information on the received light amount (2) is stored in the RAM 302 as "Y/Left".

Subsequently, with the first light emitting element 1101*a* of the yellow ink tank 1Y being lit, the carriage 205 is moved from the position in FIG. 22D to a position in FIG. 22E to, as illustrated in FIG. 22E, make the Y attachment part face to the light receiving part 210. Also, a received light amount (3) of the light receiving part at the time when the first light emitting element 1101*a* of the yellow ink tank 1Y is lit is detected, and information on the received light amount (3) is stored in the RAM 302 as "Y/Center". If the Y attachment part is attached with the yellow ink tank 1Y, among received light amounts regarding the tank 1Y ("Y/Center", "Y/Left", and "Y/Right"), the received light amount "Y/Center" is maximum. Then, after the first light emitting element 1101*a* of the yellow ink tank 1Y has been extinguished, a received light amount at this position is obtained as a background light amount (11), and information on the background light amount (11) is stored in the RAM 302 as "Y/BG".

After that, without changing the position of the carriage 205, as illustrated in FIG. 22F, the first light emitting element 1101*a* of the dye black ink tank 1K is lit. Also, a received light amount (4) of the light receiving part at the time when the first light emitting element 1101*a* of the dye black ink tank 1K is lit is detected, and information on the received light amount (4) is stored in the RAM 302 as "K/Right".

Subsequently, without changing the position of the carriage 205, after the first light emitting element 1101*a* of the dye black ink tank 1K has been extinguished, as illustrated in FIG. 22G, the first light emitting element 1101*a* of the magenta ink tank 1M that should be attached to the M attachment part adjacent to the Y attachment part is lit. Also, a received light amount (5) of the light receiving part at the time when the first light emitting element 1101*a* of the magenta ink tank 1M is lit is detected, and information on the received light amount (5) is stored in the RAM 302 as "M/Left".

After that, with the first light emitting element 1101*a* of the magenta ink tank 1M being lit, the carriage 205 is moved from the position in FIG. 22G to a position in FIG. 22H to, as illustrated in FIG. 22H, make the N attachment part face to the light receiving part 210. Also, a received light amount (6) of the light receiving part at the time when the first light emitting element 1101*a* of the magenta ink tank 1M is lit is detected, and information on the received light amount (6) is stored in the RAM 302 as "M/Center". If the M attachment part is attached with the magenta ink tank 1M, between the received light amounts regarding the tank 1M ("M/Center" and "M/Left"), the received light amount "M/Center" is maximum.

Then, after the first light emitting element 1101*a* of the magenta ink tank 1M has been extinguished, a received light amount at this position is obtained as a background light amount (12), and information on the background light amount (12) is stored in the RAM 302 as "M/BG". Subsequently, without changing the position of the carriage 205, as illustrated in FIG. 22I, the first light emitting element 1101*a* of the yellow ink tank 1Y is lit. Also, a received light amount (7) of the light receiving part 210 at the time when the first light emitting element 1101*a* of the yellow ink tank 1Y is lit is detected, and information on the received light amount (7) is stored in the RAM 302 as "Y/Right".

Subsequently, without changing the position of the carriage 205, after the first light emitting element 1101*a* of the yellow ink tank 1Y has been extinguished, as illustrated in FIG. 22J, the first light emitting element 1101*a* of the cyan ink tank 1C that should be attached to the C attachment part adjacent to the M attachment part is lit. Also, a received light amount (8) of the light receiving part 210 at the time when the first light emitting element 1101*a* of the cyan ink tank 1C is lit is detected, and information on the received light amount (8) is stored in the RAM 302 as "C/Left". After that, the first light emitting element 1101*a* of the cyan ink tank 1C is extinguished.

Finally, the carriage 205 is moved from the position in FIG. 22J to a position in FIG. 22K to make the PGK attachment part face to the light receiving part 210. Also, at this position, the first light emitting element 1101*a* of the pigment black ink tank 1PGK is made to emit light to detect a received light amount (9) of the light receiving par 210 at this time, and information on the received light amount (9) is stored in the RAM 302 as "PGK/Center".

Then, after the first light emitting element 1101*a* of the pigment black ink tank 1PGK has been extinguished, a received light amount at this position is obtained as a background light amount (13), and information on the background light amount (13) is stored in the RAM 302 as "PGK/BG".

By repeating light emission of a first light emitting element 1101*a* of an ink tank identified depending on a position of the carriage 205 and light reception by the light receiving part 210 in the above manner, the pieces of information on the received light amounts (1) to (9) and the pieces of information on the background light amounts (10) to (13) are obtained. The pieces of information on the received light amounts (1) to (9) are stored in the RAM 302 as a table 1 illustrated in FIG. 23A, and also the pieces of information on the background light amounts (10) to (13) are stored in the RAM 302 as a table 2 illustrated in FIG. 23B. Then, the CPU 301 of the printer subtracts the background light amounts in the table 2 from the received light amounts in the table 1 to obtain corrected light amounts in which the influence of the background light amounts is removed, and pieces of information on the corrected light amounts are stored in the RAM 302 as a table 3 illustrated in FIG. 23C.

The reason to create the table 3 is described here. As described above, depending on use environment of the printer, the outside light enters from the ASF 202 side or discharge tray 203 side, and even though any of the first light emitting elements 1101*a* of the ink tanks 1 is not lit, the light receiving part 210 may detect the outside light. In the present embodiment, as described above, as a light receiving element constituting the light receiving part 210, there is used an infrared light receiving element (e.g., the light receiving element illustrated in FIG. 16A) having low light reception sensitivity in the visible light range where the peak emission wavelength of the fluorescent lamp, which is a typical example of the outside light, is present, and a peak sensitivity wavelength within the infrared range of 760 nm to 1100 nm.

According to this, the influence of the outside light can be reduced to reduce the possibility that a determination error occurs in the optical checking processing. However, it is not that even such a light receiving element is not at all influenced by the outside light that is visible light, because it has the light reception sensitivity not only in the infrared range but also in the visible light range. In the case where, in the situation where the outside light enters, a first light emitting element 1101*a* of an ink tank 1 is lit, a received light amount at this time equals to (a light amount of the first light emitting element 1101*a*+a light amount of the outside light). Accordingly, at the time of the optical checking processing, it is preferable to remove the light amount of the outside light (background light amount) from the received light amount received by the light receiving part 210 to perform the tank attachment position determination processing.

Therefore, the present embodiment is adapted such that by subtracting the background light amounts from the corresponding received light amounts of the light receiving part 210, the corrected light amounts are obtained, and according to the corrected light amount, the optical checking processing is performed. For this purpose, the table 3 illustrated in the above FIG. 23C is created. As described, by using the table in FIG. 23C to perform the tank attachment position correct/incorrect determination processing, the determination accuracy can be further increased.

Figure 24:
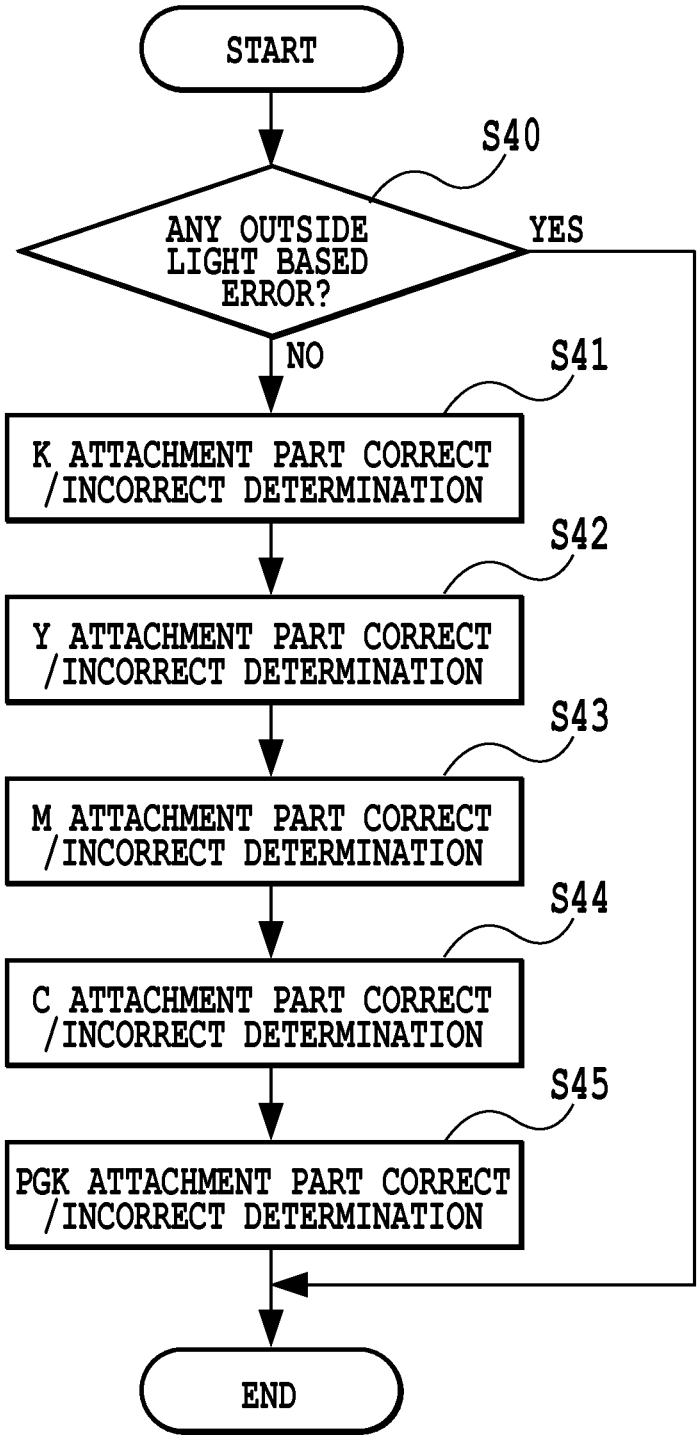
FIG. 24 is a flowchart illustrating a sequence of the attached tank correct/incorrect determination that is performed with use of the table in FIGS. 23A to 23C.

Then, the main body side control circuit 300 uses the table 3 in FIG. 23C to determine whether or not each of the attachment parts is attached with a correct ink tank in the order of K, Y, M, C, and PGK. FIG. 24 is a flowchart illustrating a sequence of the determination.

First, in S40 of FIG. 24, it is determined whether or not the outside light based error occurs. Specifically, it is determined whether or not each of the background light amounts (BG) listed in the table 2 of FIG. 23B is equal to or more than a predetermined value. If any of the background light amounts is significantly large, (a light amount of a first light emitting element 1101*a*+a light amount of the outside light) exceeds an upper limit of a light amount receivable by the light receiving part 210, and therefore an output value from the light receiving part 210 is saturated. If so, a value (corrected light amount) obtained by subtracting the background light amount from the received light amount does not indicate the light amount of the first light emitting element 1101*a*, which may cause erroneous sensing.

For this reason, the case where the background light amount exceeds the predetermined value is considered as an "outside light based error", and without performing processing steps in S41 and subsequent steps, the processing in FIG. 24 is completed to complete the processing step in S11 of FIG. 21. Subsequently, the flow proceeds to S12 of FIG. 21, where it is determined that there is no "positional error", and the processing of FIG. 21 is completed.

Based on this, the optical checking processing (S109) in FIG. 13 is completed. Subsequently, in S110, it is determined that the optical checking processing is not normally completed, and in S112, an incorrect indication is made. In the case of the "outside light based error", the indicator of the operation part 213 is blinked in, for example, orange. Also, in the case where a display panel is provided in the operation part 213, or the printer is connected to a PC, an error message "Printer trouble occurs. Cycle power. If trouble is not solved, see instruction manual" is displayed on the display panel or PC monitor to complete the flow.

On the other hand, in S40 of FIG. 24, if it is determined that the "outside light based error" does not occur, in S41 of FIG. 24, it is determined whether or not the K attachment part is attached with the correct ink tank (dye black ink tank 1K). For this purpose, it is determined whether or not the flowing condition (I) is met.

[Condition (I)]

(1) Corrected light amount (1) of "K/Center"-(10) ≥ Threshold value, and (2) Corrected light amount (1) of "K/Center"-(10)>Corrected light amount (4) of "K/Right"-(11).

If the condition (1) is met, it is determined that the K attachment part is attached with the correct ink tank (dye black ink tank 1K). On the other hand, if the condition (I) is not met, it is determined that the K attachment part is not attached with the correct ink tank to make a flag for "positional error" on with respect to the K attachment part.

Then, in S42 of FIG. 24, it is determined whether or not the Y attachment part is attached with the correct ink tank (yellow ink tank 1Y). For this purpose, it is determined whether or not the following condition (II) is met.

[Condition (II)]

(1) Corrected light amount (3) of "Y/Center"-(11) ≥ Threshold value, and (2) Corrected light amount (3) of "Y/Center"-(11)>Corrected light amount (7) of "Y/Right"-(12), and (3) Corrected light amount (3) of "Y/Center"-(11)>Corrected light amount (2) of "Y/Left"-(10).

If the condition (II) is met, it is determined that the Y attachment part is attached with the correct ink tank (yellow ink tank 1Y). On the other hand, if the condition (II) is not met, it is determined that the Y attachment part is not attached with the correct ink tank to make the flag for "positional error" on with respect to the Y attachment part.

Then, in S43 of FIG. 24, it is determined whether or not the M attachment part is attached with the correct ink tank (magenta ink tank 1M). For this purpose, it is determined whether or not the following condition (III) is met.

[Condition (III)]

(1) Corrected light amount (6) of "M/Center"-(12) ≥ Threshold value, and (2) Corrected light amount (6) of "M/Center"-(12)>Corrected light amount (3) of "M/Left"-(11), and (3) Corrected light amount (6) of "M/Center"-(12)>Corrected light amount (8) of "C/Left"-(12).

If the condition (III) is met, it is determined that the M attachment part is attached with the correct ink tank (magenta ink tank 1M). On the other hand, if the condition (III) is not met, it is determined that the M attachment part is not attached with the correct ink tank to make the flag for "positional error" on with respect to the M attachment part.

Then, in S44 of FIG. 24, it is determined whether or not the C attachment part is attached with the correct ink tank (cyan ink tank 1C). For this purpose, it is determined whether or not the following condition (IV) is met.

[Condition (IV)]

(1) In the processing steps in S41 to S43 of FIG. 24, no "positional error" flag is hoisted.

If no "positional error" flag is hoisted, it is determined that the C attachment part is attached with the correct ink tank (cyan ink tank 1C). That is, if under the condition that it is checked in S107 of FIG. 13 that the ink tanks for KYMC are arranged, it is checked in the above S41 to S13 that the ink tanks 1C, 1Y, and 1K are normally attached, a tank attached to the C attachment part is inevitably the cyan ink tank 1C. As described above, the pigment black ink tank 1PGK is larger than the other ink tanks 1 and cannot be attached to the C attachment part, and therefore if the condition (IV) is met, it is identified that the tank attached to the C attachment part is the cyan ink tank 1C. On the other hand, if there is at least one "positional error" flag, it cannot be identified that the tank attached to the C attachment part is the cyan ink tank 1C, and therefore in this case, the "positional error" flag is made on with respect to the C attachment part.

Finally, in S45 of FIG. 24, it is determined whether or not the PGK attachment part is attached with the correct ink tank (pigment black ink tank 1PGK). For this purpose, it is determined whether or not the following condition (V) is met.

[Condition (V)]

Corrected light amount (9) of "PGK/Center"-(13) ≥ Threshold value

If the condition (V) is met, it is determined that the PGK attachment part is attached with the correct ink tank (pigment black ink tank 1PGK). On the other hand, if the condition (V) is not met, it is determined that the first light emitting element 1101*a* of the pigment black ink tank attached to the PGK attachment part (or another part of the control circuit 300) is in trouble, and in this case, a flag for "LED error" is made on with respect to the PGK attachment part.

In the above manner, the attached tank correct/incorrect determination processing in FIG. 24 is completed, i.e., S11 in FIG. 21 is completed.

In the present embodiment, as described above, not only a received light amount (Center light amount) obtained when a first light emitting element 1101*a* of an ink tank that should be attached to an attachment part facing to the light receiving part 210 is made to emit light, but also received light amounts (Left light amount and Right light amount) obtained when the first light emitting element 1101*a* is made to emit light at positions not facing to the light receiving part 210 are used to determine whether or not the ink tank is attached at a correct position. The reason for this is as follows.

In order to determine whether or not an attachment position of an ink tank is correct, a configuration using only the Center light amount is possible. For example, if the Center light amount is equal to or more than the threshold value, it is determined that the tank attachment position is correct, whereas if the Center light amount is less than the threshold value, it is determined that the tank attachment position is incorrect. Even in such processing, it can be determined whether or not the tank attachment position is correct. However, as in the present embodiment, in the case of using LEDs as the first light emitting elements 1*a*, a variation in emission amount occurs due to manufacturing variation. If an allowable range of the variation in emission amount is decreased, and only LEDs among which a difference in emission amount is small are used, even with use of only the Center light amount, the attachment position correct/incorrect determination can be made with high accuracy.

However, considering manufacturing cost, a certain level of emission amount variation is inevitably allowed. For example, in the case of allowing the use of LEDs among which the difference in emission amount is of the order of a few times, only with use of the Center light amount, the highly accurate attachment position correct/incorrect determination may not be made. This is described by exemplifying the case where the ink tank 1Y is incorrectly attached. Consider the case where the ink tank 1Y is incorrectly attached to the M attachment part adjacent to the Y attachment part. In this case, at the position where the Y attachment part faces to the light receiving part, the LED of the ink tank 1Y attached to the M attachment position is made to emit light, and a received light amount at this time corresponds to the "Y/Center" light amount. If an emission amount of the LED of the ink tank 1Y is large, the "Y/Center" light amount may exceeds the threshold value. That is, even though the positional error occurs, the case where (1) of the condition (II) is met occurs.

Therefore, the present embodiment is adapted such that in order to increase accuracy of the ink tank attachment position correct/incorrect determination, not only the Center light amount, but also the Left and Right light amounts are used. Specifically, regarding the Y attachment part, the Left and Right light amounts can be detected, and therefore the Center, Left, and Right light amounts are used. Also, regarding the K attachment part, a Left light amount is not detected but the Right light amount can be detected, and therefore the Center and Right light amounts are used. Further, regarding the M attachment part, a Right light amount is not detected but the Left light amount can be detected, and therefore the Center and Left light amounts are used.

In addition, regarding the M attachment part, only with the use of the Center and Left light amounts, it may not be determined to be incorrect attachment, and therefore the C/Left light amount is also used. That is, consider the case where an emission amount of the LED (first light emitting element 1101*a*) of the magenta ink tank 1M incorrectly attached to the C attachment part is large. In this case, a received light amount at the time when, at the position where the M attachment part faces to the light receiving part 210, the LED (first light emitting element 1101*a*) of the magenta ink tank 1M attached to the C attachment part is made to emit light corresponds to the "M/Center" light amount; however, if the emission amount of the LED (first light emitting element 1101*a*) of the magenta ink tank 1M is large, the M/Center light amount becomes equal to or more than the threshold value. That is, (1) of the condition (III) is met.

Also, a received light amount at the time when, at the position where the Y attachment part faces to the light receiving element 210, the first light emitting element 1101*a* of the magenta ink tank 1M attached to the C attachment part is made to emit light corresponds to the "M/Left" light amount. A distance between the light receiving part 210 at the time of receiving the "M/Center" light amount and the ink tank is larger than a distance between the light receiving part 210 at the time of receiving the "M/Center" light amount and the ink tank. For this reason, the M/Left light amount is smaller than the M/Center light amount, and therefore (2) of the condition (III) is met.

Accordingly, the determination using the C/Left light amount as presented in (3) of the condition (III) is made. A received light amount at the time when, at the position where the M attachment part faces to the light receiving part, the LED (first light emitting element 1101*a*) of the cyan ink tank 1C attached to the M attachment part is made to emit light corresponds to the "C/Left" light amount, so that by including (3) of the condition (III), it is determined that C/Left light amount>M/Center light amount, and as a result, the incorrect attachment as described above can also be determined.

Referring to FIG. 21 again, after S11, in S12, it is determined whether or not any positional error occurs in the processing step of S11. If it is determined that no positional error occurs, the optical checking processing illustrated in FIG. 21 is completed, and the flow proceeds to S110 in FIG. 13. For example, in the case of above-described FIGS. 22A to 22K, all of the attachment parts are attached with the correct ink tanks, i.e., it is determined that there is no error, and therefore at this point, the optical checking processing is completed. On the other hand, in S12 of FIG. 21, it is determined that the positional error occurs, the flow proceeds to S13, where the error checking processing is performed.

The transfer to the error checking processing (S13) is made if the positional error occurs in the attached tank correct/incorrect determination processing (S11). Accordingly, first, FIGS. 25A to 25K are used to describe the case where the "positional error" occurs, and then FIGS. 26A to 26F are used to describe the error checking processing.

FIGS. 25A to 25K are explanatory diagrams of operation for the case where the dye black ink tank 1K and the yellow ink tank 1Y are reversely attached, i.e., for the case where the Y attachment part is attached with the dye black ink tank 1K and the K attachment part is attached with the yellow ink tank 1Y. At this time point, the printer cannot recognize that the incorrect attachment occurs, and therefore as in FIGS. 22A to 22K, the operation of making an LED (first light emitting element 1101*a*) of an ink tank identified depending on a position of the carriage 205 emit light and receiving the light by the light receiving part is repeated. Based on this, the table 1 on the received light amounts (1) to (9) and the table 2 on the background light amounts (10) to (13) are created, and further the table 3 is created from the tables 1 and 2. After that, in the same manner as that described above, the table 3 is used to perform the processing steps in S41 to S45 of FIG. 24.

As is clear from the comparison between FIGS. 22A to 22K and 25A to 25K, at all timings shown in FIGS. 22B to 22K and 25B to 25K, lighted ink tanks are the same. This is because lighting timings of the respective ink tanks are controlled according to a position of the carriage 205 and a lighting order of the plurality of ink tanks at the position. However, between FIGS. 22A to 22K and 25A to 25K, lighting positions of the dye black ink tank 1K and yellow ink tank 1Y are different, and due to this, received light amounts are different at some positions.

Figures 25A, 25B, 25C, 25D, 25E, 25F, 25G, 25H, 25I, 25J, 25K:
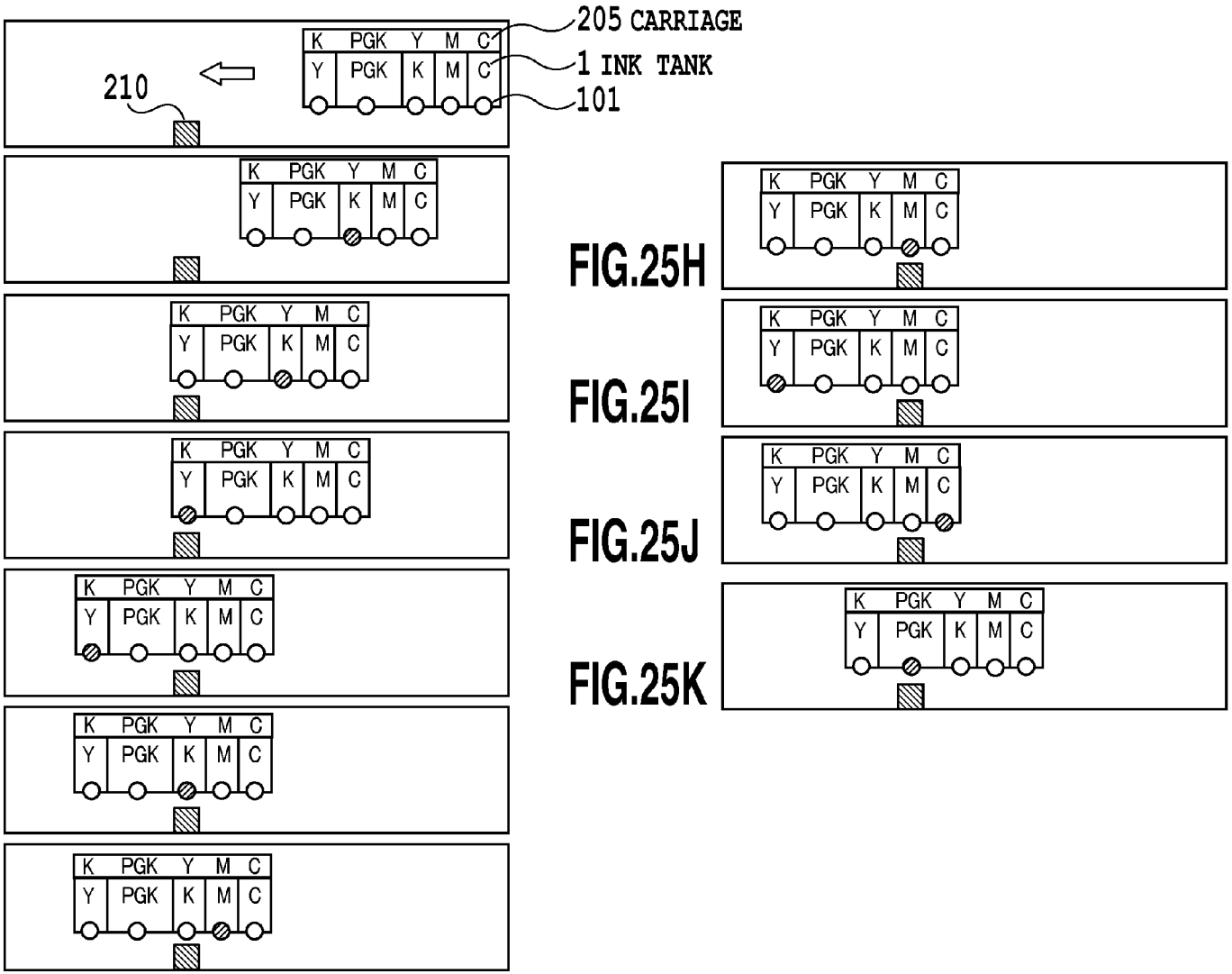
FIGS. 25A to 25K are diagrams for explaining operation of the optical checking processing for the case where attachment parts are attached with incorrect ink tanks.

For example, in the case of comparing the states of FIGS. 22C and 25C with each other, in FIGS. 22A to 22K, at a position facing to the light receiving part 210, the LED (first light emitting element 1101*a*) of the dye black ink tank is lit, whereas in FIGS. 25A to 25K, at a position not facing to the light receiving part 120, the LED (first light emitting element 1101*a*) of the dye black ink tank is lit. For this reason, the "K/Center" received light amount obtained in FIG. 25C is smaller than the "K/Center" received light amount obtained in FIG. 220. Similarly, in the case of comparing the states illustrated in FIG. 25E of the diagrams with each other, the "Y/Center" received light amount obtained in FIG. 25E is smaller than the "Y/Center" received light amount obtained in FIG. 22E.

On the other hand, in the case of comparing the states of FIGS. 22D and 25D, in FIGS. 22A to 22K, at a position not facing to the light receiving part 210, the yellow ink tank 1Y is lit, whereas in FIGS. 25A to 25K, at a position facing to the light receiving part 210, the LED (first light emitting element 1101*a*) of the yellow ink tank 1Y is lit. For this reason, the "Y/Left" received light amount obtained in FIG. 25D is larger than the "Y/Left" received light amount obtained in FIG. 22D. Similarly, in the case of comparing the states illustrated in FIG. 25F of the diagrams with each other, the "K/Right" received light amount obtained in FIG. 25F is larger than the "K/Right" received light amount obtained in FIG. 22F.

As described, between the case of the correct attachment (FIGS. 22A to 22K) and the case of the incorrect attachment (FIGS. 25A to 25E), differences in received light amount occur. As a result, the "positional error" not occurring in the case of the correct attachment as in FIGS. 22A to 22K occurs in the case of the incorrect attachment as in FIGS. 25A to 25K. In the case of FIGS. 25A to 25K, results of the processing steps in S41 to S45 of FIG. 24 are as follows.

First, in S41 of FIG. 24, it is determined that the condition (I) is not met.

For example, it is determined that (1) Corrected light amount (1) of "K/Center"–(10) <Threshold value, and (2) Corrected light amount (1) of "K/Center"–(10)<Corrected light amount (4) of "K/Right"–(11).

Based on this, the "positional error" flag is hoisted with respect to the K attachment part.

Subsequently, in S42 of FIG. 24, it is determined that the condition (II) is not met. For example, it is determined that (1) Corrected light amount (3) of "Y/Center"–(11) <Threshold value, and (2) Corrected light amount (3) of "Y/Center"–(11)<Corrected light amount (7) of "Y/Right"–(12), and (3) Corrected light amount (3) of "Y/Center"–(11)>Corrected light amount (2) of "Y/Left"–(10).

Based on this, the "positional error" flag is hoisted with respect to the Y attachment part.

After that, in S43 of FIG. 24, it is determined that the condition (III) is met. Accordingly, the "positional error" flag is not hoisted. In the case of FIGS. 25A to 25K, in the same manner as in the case of FIGS. 22A to 22K, the M attachment part is attached with the magenta ink tank 1M, resulting in the same determination result as in the case of the FIGS. 22A to 22K.

Subsequently, in S44 of FIG. 24, it is determined that the condition (IV) is not met. This is because the "positional errors" occur with respect to the K and Y attachment parts, and therefore an ink tank attached in the C attachment part cannot be identified. Accordingly, the "positional error" flag is hoisted with respect to the C attachment part.

Finally, in S45 of FIG. 24, it is determined that the condition (V) is met. This is because no trouble occurs in the LED (first light emitting element 1101*a*) of the pigment black ink tank 1PGK attached to the PGK attachment part. As described, in the case of FIGS. 25A to 25K, in the processing of FIG. 24 (processing step in S11 of FIG. 21), the "positional errors" occur with respect to the K, Y, and M attachment parts. Accordingly, in S12 of FIG. 21, it is determined that there are the positional errors, and the flow proceeds to the error checking processing (S13).

In the error checking processing, in the case where in the processing step of S11, the "positional error" occurs, in addition to determining what color ink tank is mounted on an attachment part where the positional error occurs, it is determined in combination whether or not a first light emitting element 1101*a* of the ink tank attached to the attachment part (except the C attachment part) where the positional error occurs is in trouble. Then, in S112 of FIG. 13, which is the subsequent step, flags for making such error indications are made on.

Figure 26A:
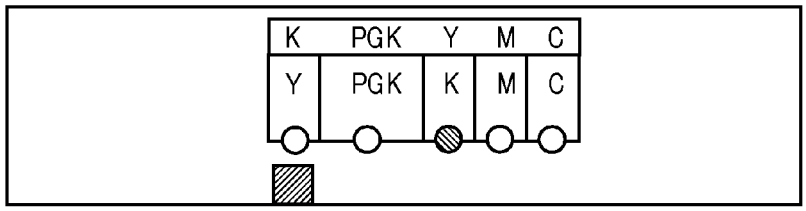
FIGS. 26A to 26F are diagrams for explaining operation of error checking processing in S13 of FIG. 21.
Figure 26B:
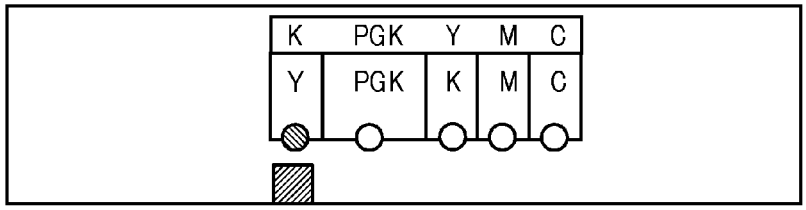
Figure 26C:
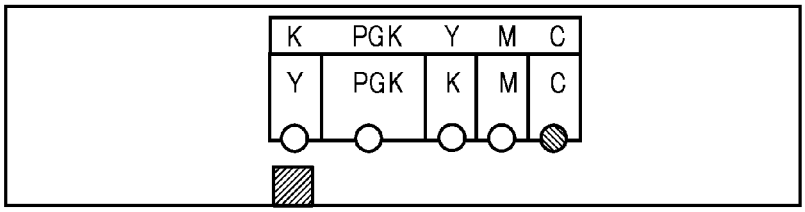
Figure 26D:
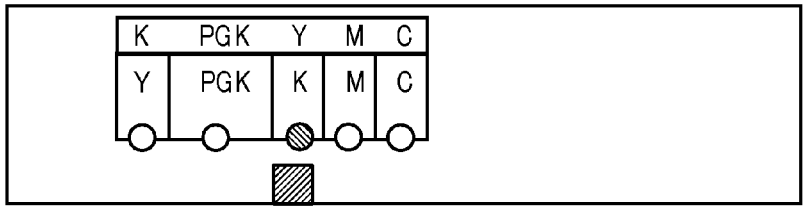
Figure 26E:
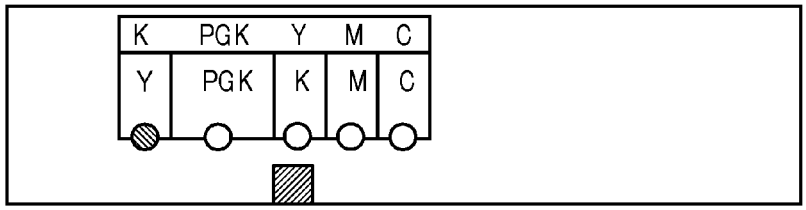
Figure 26F:
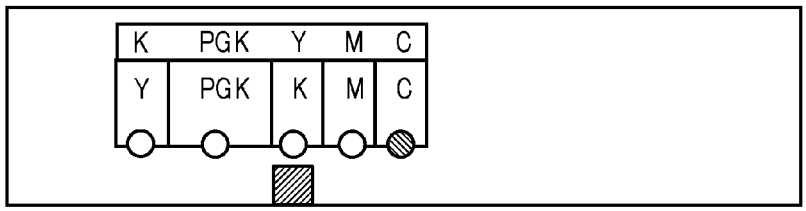
Figure 27:
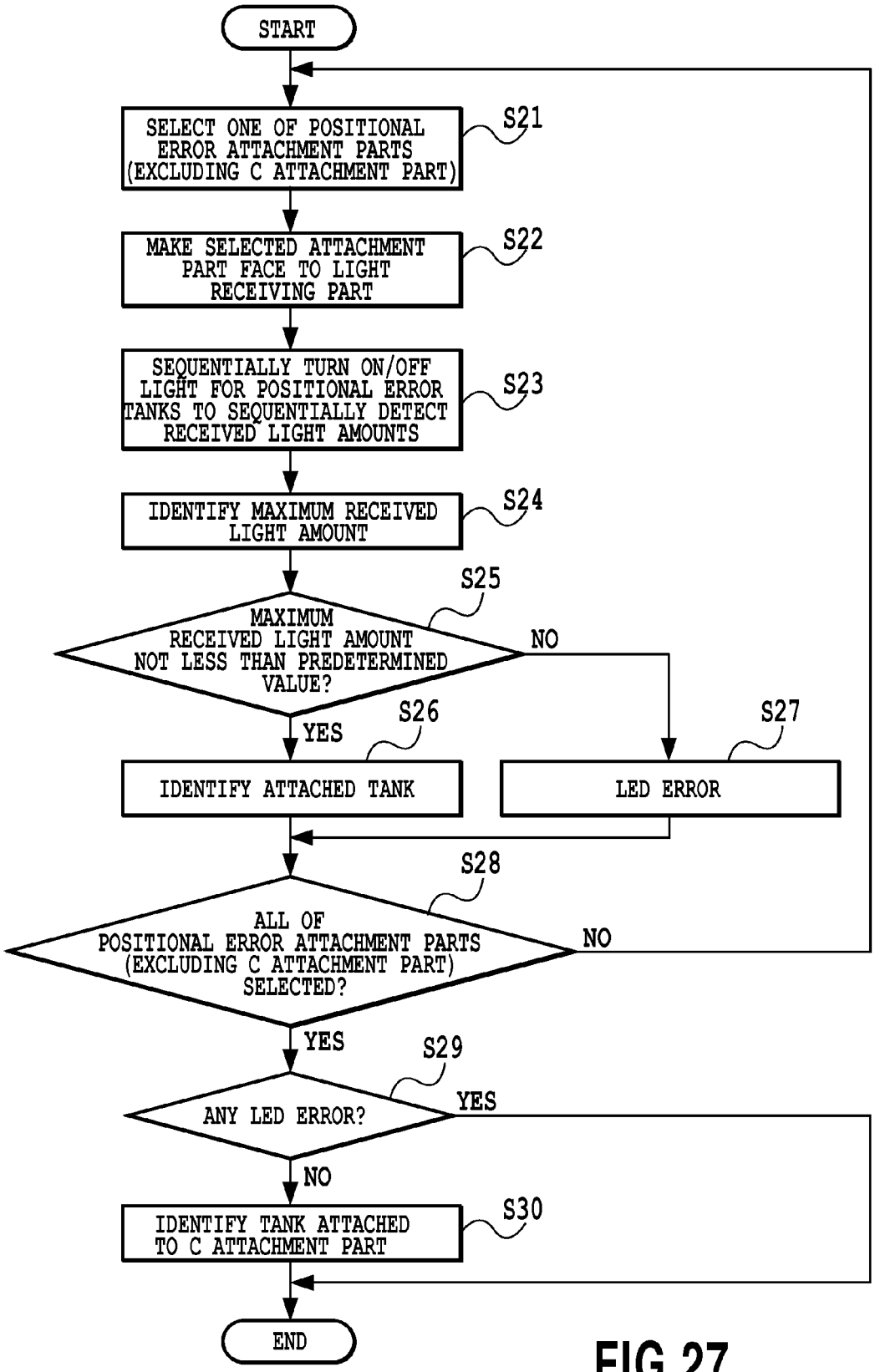
FIG. 27 is a flowchart illustrating the error checking processing in FIGS. 26A to 26F.

FIGS. 26A to 26F are explanatory diagrams of operation in the error checking processing, and FIG. 27 is a flowchart of the error checking processing. First, in S21 of FIG. 27, one attachment part is selected from attachment parts where the "positional errors" occur (note that the C attachment part that cannot face to the light receiving part is excluded). Then, in S22, the selected one attachment part is made to face to the light receiving part 210. Subsequently, in S23, ink tanks that should have been attached to the respective attachment parts where the "positional errors" occur are sequentially lit/extinguished to sequentially obtain received light amounts at the time of the sequential lighting/extinction. This situation is illustrated in FIGS. 26A to 26C.

First, as illustrated in FIG. 26A, with the K attachment part selected from the attachment parts where the "positional errors" occur being made to face to the light receiving part 210, the first light emitting element 1101*a* of the dye black ink tank 1K is lit to obtain a received light amount at the time. Then, the first light emitting element 1101*a* of the dye black ink tank 1K is extinguished. Subsequently, as illustrated in FIG. 26B, with the K attachment part being made to face to the light receiving element 210, the first light emitting element 1101*a* of the yellow ink tank 1Y is lit to obtain a received light amount at the time. Then, the first light emitting element 1101*a* of the yellow ink tank 1Y is extinguished. Finally, as illustrated in FIG. 26C, with the K attachment part being made to face to the light receiving element 210, the first light emitting element 1101*a* of the cyan ink tank 1C is lit to obtain a received light amount at the time. Then, the first light emitting element 1101*a* of the cyan ink tank 1C is extinguished.

Subsequently, in S24 of FIG. 27, a maximum received light amount is identified from the received light amounts obtained in S23. After that, in S25, it is determined whether or not the maximum received light amount is equal to or more than a threshold value. If it is determined that the maximum received light amount is equal to or more than the threshold value, in S26, an ink tank lit at the time of obtaining the maximum received light amount is identified as the ink tank attached to the K attachment part.

In the case of FIGS. 26A to 26F, the received light amount obtained when the yellow ink tank 1Y attached to the K attachment part is lit is the maximum received light amount, and therefore it is determined that the K attachment part is attached with the yellow ink tank 1Y. On the other hand, in S25, it is determined that the maximum received light amount is not equal to or more than the threshold value, it is determined that the first light emitting element 1101*a* of the ink tank attached to the attachment part facing to the light receiving part is in trouble, and the LED error is given. In this case, the LED error of the ink tank attached to the K attachment part is given.

Subsequently, the flow proceeds to S28, where it is determined whether or not all of the attachment parts (excluding the C attachment part) where the positional errors occur have been selected, and if all of the attachment parts have been selected, the flow proceeds to S29. On the other hand, if all of the attachment parts have not been selected, the flow proceeds to S21, where the processing steps in S21 and subsequent steps is repeated on a not-selected attachment part.

In the case of FIGS. 26A to 26F, in addition to the K attachment part, in the Y attachment part, the positional error occurs, and therefore the processing steps in S21 and subsequent steps is also performed on the Y attachment part in the same manner as for the K attachment part. This situation is illustrated in FIGS. 26D to 26F. First, as illustrated in FIG. 26D, with the Y attachment part being made to face to the light receiving part, the first light emitting element 1101*a* of the dye black ink tank 1K is lit to obtain a received light amount at the time. Then, the first light emitting element 1101*a* of the dye black ink tank 1K is extinguished.

Subsequently, as illustrated in FIG. 26E, with the Y attachment part being made to face to the light receiving element 210, the first light emitting element 1101*a* of the yellow ink tank 1Y is lit to obtain a received light amount at the time. Then, the first light emitting element 1101*a* of the yellow ink tank 1Y is extinguished. Finally, as illustrated in FIG. 26F, with the Y attachment part being made to face to the light receiving element 210, the first light emitting element 1101*a* of the cyan ink tank 1C is lit to obtain a received light amount at the time. Then, the first light emitting element 1101*a* of the cyan ink tank 1C is extinguished.

Subsequently, the processing steps in S24 and subsequent steps in FIG. 27 are performed. In the case of FIGS. 26A to 26F, the received light amount obtained when the dye black ink tank 1K attached to the Y attachment part is lit is the maximum received light amount, and therefore it is determined that the Y attachment part is attached with the dye black ink tank 1K.

Then, in S29 of FIG. 27, the presence or absence of the LED error is determined. In S29, it is determined that there is no LED error, the flow proceeds to 330, where an ink tank attached to the C attachment part is identified. At the time point of S30, the ink tanks other than the ink tank attached to the C attachment part have been identified in S26. For example, in the case of FIGS. 26A to 265, in S26, it has been identified that the K attachment part is attached with the yellow ink tank 1Y and the Y attachment part is attached with the dye black ink tank 1K, and therefore it is identified that the C attachment part is attached with the cyan ink tank.

On the other hand, in S29, if it is determined that there is the LED error, the ink tank attached to the C attachment part cannot be identified, and therefore the processing flow is directly completed. Based on this, the error checking processing (S13) in FIG. 21 is completed, and the optical checking processing in FIG. 21 is also completed.

Note that during the optical checking processing, the main body cover 201 may be opened. Even in such a case, the optical checking processing (S109) directly continues. If cover closing is sensed before the completion of the optical checking processing, a subsequent correct attachment indication (S111) or incorrect attachment indication (S112) is made, and then the carriage is moved to the "tank replacement position" (S103). On the other hand, if the cover closing is not sensed before the completion of the optical checking processing, i.e., if the cover open state is continued, a user is informed on the cover open state through the indicator of the operation part 213, display panel, PC monitor, or the like. Along with this, it the optical checking processing is not normally completed, the incorrect attachment indication as described later is made in S112.

Referring to FIG. 13 again, when the above-described optical checking processing in S109 is completed, in S110, it is determined whether or not the optical checking processing has been normally completed. In S110, it is determined whether or not any flag for "outside light based error", "positional error", or "LED error" is present, and if there is no error, it is determined to be the normal completion, whereas if there is any error, it is determined not to be the normal completion. Also, in the case where any error occurs, the control circuit 300 performs control in which as long as the error is cancelled, printing based on a print start instruction that has been inputted at this time point or will be subsequently inputted is not performed. By doing so, for example, printing can be prevented from being performed in the state where an attachment position error of an ink tank occurs, and serious color mixture can be avoided from occurring in an ink chamber of a printing head.

In S110, if it is determined to be the normal completion, the flow proceeds to S111, where the indicator of the operation part 213 is lit, for example, in green to complete the present processing. On the other hand, in S110, if it is determined not to be the normal completion, the flow proceeds to S112. In S112, the indicator of the operation part 213 is blinked in, for example, orange. At this time, by changing the number of blinks depending on an error identified in S109, a user can be informed on content of the error.

Also, in the case where the operation part 213 is provided with a display panel, or the printer is connected to a PC, on the display panel or PC monitor, the following display is provided. In the case of the "LED error", the error message indicating "Error occurs in ink tank. Open cover of printer to replace ink tank attached to ○ attachment part" is displayed. In the case of the "positional error", the error message indicating "Some ink tank is not attached at correct position. Check correct ink tank is attached at attachment position of ink tank attached to Δ attachment part" is displayed. In the case of the "outside light based error", a display is provided as described above. Based on this, a user can be informed of the occurrence of an error in an ink tank.

Further, in S113, if it is determined to be an error other than the "outside light based error", i.e., in the case of the "LED error" or "positional error", in addition to the display as described above, the ink tank state informing processing is performed. In the informing processing in this step, in S114, incorrect tank indication processing based on extinction, blinking, or lighting of a second light emitting element 1101*b* of an ink tank in which an error occurs is performed. For example, in the case of the "LED error", a second light emitting element 1101*b* of an ink tank identified in Step S109 in which an error occurs is extinguished, and a second light emitting element 1101*b* of a correct ink tank is lit. Also, in the case of the "positional error", the second light emitting element 1101*b* of the emission part 101 of the ink tank that is identified in Step S109 and not attached at an original correct position is, for example, slowly blinked. Based on this, in Step S114, when the user opens the main body cover 201, he/she can know the ink tank not attached at the original correct position to prompt reattachment of it at the correct position.

Figure 28:
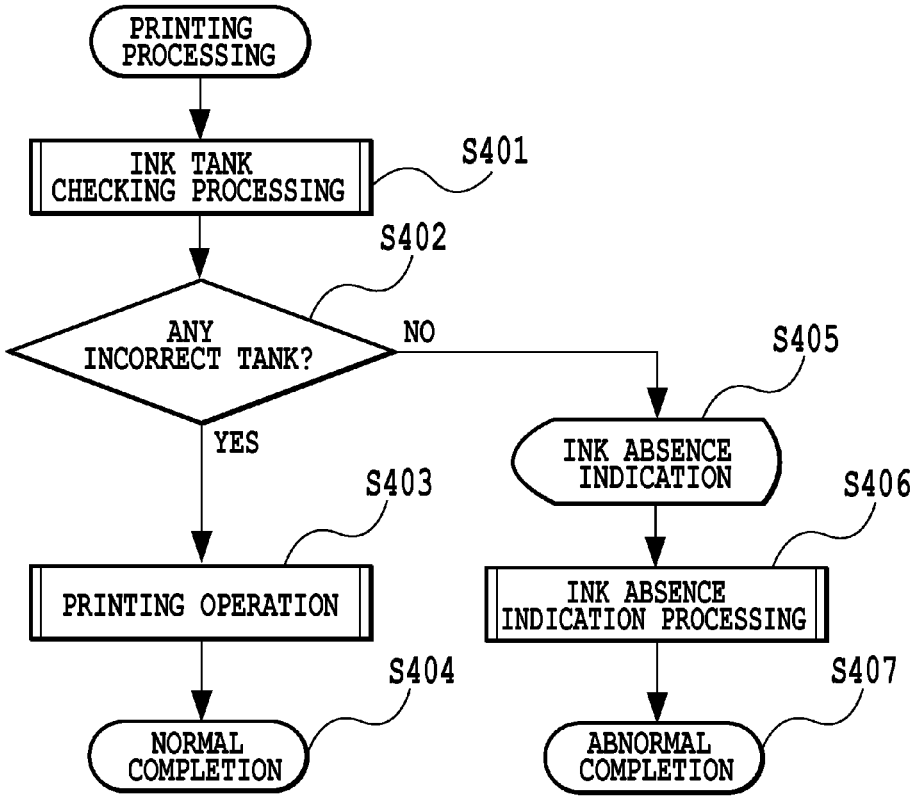
FIG. 28 is a flowchart illustrating printing processing according to the above embodiment.

FIG. 28 is a flowchart illustrating printing processing that is started in accordance with the normal completion of the processing in FIG. 13 and the input of the print start signal to the printer. In this processing, first, in S401, an ink remaining amount checking processing step is performed. This processing step is one that obtains, from printing data, a printing amount of a job to be printed from now, and compares the amount with remaining amounts of the respective ink tanks to check whether or not sufficient amounts for printing the above job are present. Note that, in this processing step, regarding the above ink remaining amounts, ones obtained as remaining amounts at the time in the control circuit 300 can be used.

in S402, it is determined on the basis of the above checking processing step whether ink amounts necessary for the printing are present. If there are the sufficient ink amounts, printing operation is performed in S403, and also in S404, the indicator of the operation part 213 is lit in green to normally complete the processing. On the other hand, in Step S402, if it is determined that the sufficient ink amounts are not present, the indicator of the operation part 213 is blinked in orange in Step S405, and also in Step S406, the ink tank state informing processing is performed to abnormally complete the processing. The ink tank informing processing in this step is performed such that, when the user opens the main body cover 201 for ink tank replacement, a light emitting part 101 of an ink tank of which an ink remaining amount is short is, for example, quickly blinked. Note that if a host PC that controls the printer is connected to the printer, in S405, an ink remaining amount display can also be provided through a PC monitor.

<Variation of First Embodiment>

Figure 10B:
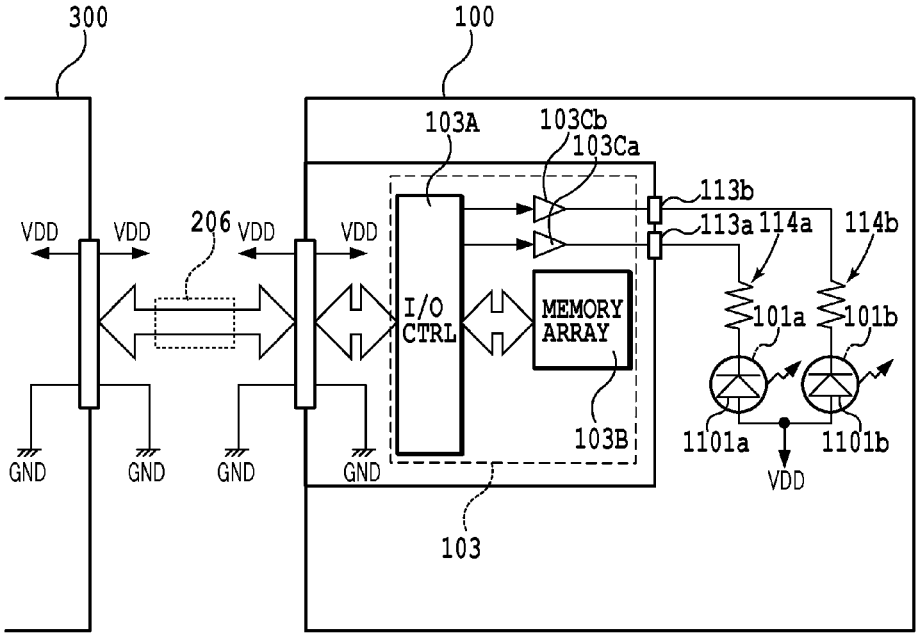
FIG. 10B is a circuit diagram illustrating details of a board 100 according to another embodiment.

The light emitting part 101 described with FIGS. 4A to 4C and FIG. 10A with respect to the first embodiment is constituted by the first and second light emitting elements 1101*a* and 1101*b* as the two light emitting element having different peak emission wavelengths in one package. The light emitting part applicable with the present invention is not limited to this configuration. For example, there can also be employed a configuration in which, as illustrated in FIG. 4D or FIG. 10B, each of first and second light emitting parts 101*a* and 101*b* that are individually packaged is provided with one light emitting element. That is, there can also be employed a configuration in which the first and second light emitting parts 101*a* and 101*b* are respectively provided with the first and second light emitting elements 1101*a* and 1101*b* having different peak emission wavelengths. Also, these two light emitting parts are placed adjacent to each other on the board 100.

In the present invention, such a configuration is also applicable in the same manner as in the first embodiment, and can be arbitrarily selected depending on required specifications or the like.

<Second Embodiment> in the first embodiment, the optical checking processing for the case where the C ink tank attachment part corresponding to the rightmost attachment part cannot face to the light receiving part 210 is described; however, in the second embodiment, the optical checking processing for the case where the C ink tank attachment part corresponding to the rightmost attachment part can face to the light receiving part 210 is described. Except for this point, the second embodiment is the same as the first embodiment, and therefore in the following, only the point of difference is described.

In the second embodiment, in the same manner as in the first embodiment, the optical checking processing is performed according to the flowchart in FIG. 21. However, in the second embodiment, the determination processing with respect to the M and C attachment parts is different from that in the first embodiment. For this reason, between the second and first embodiments, processing content in S11 or S13 of FIG. 21 is different, and due to the difference, operating content and processing content illustrated in FIGS. 22A to 27 are also different.

A large difference of the second embodiment from the first embodiment is that, in the second embodiment, at a position where the C attachment part corresponding to the rightmost attachment part is made to face to the light receiving part 210, the cyan ink tank 1C is made to emit light to detect a received light amount (21) at the time; also at this position, the magenta ink 1M is made to emit light to detect a received light amount (22) at the time is detected; and the received light amounts (21) and (22) are used for the attached tank correct/incorrect determination. In the following, the optical checking processing in the second embodiment is described with reference to FIGS. 29A to 32D.

FIGS. 29A to 29K are explanatory diagrams of operation in the second embodiment for the case where all of the attachment parts are attached with the correct ink tanks. FIGS. 29A to 29K correspond to FIGS. 22A to 22K in the first embodiment, and FIGS. 29A to 29J and 29K are the same as FIG. 22A to 22J and 22K. On the other hand, states in FIGS. 29L to 29N are not present in FIGS. 22A to 22K, which is a point of difference between FIGS. 29A to 29N and 22A to 22K. In the attached tank correct/incorrect determination processing (S11 in FIG. 21) of the second embodiment, in FIGS. 29C to 29J, received light amounts (1) to (8) and background light amount (10) to (12) are obtained in the manner as described in FIGS. 22C to 22J. Then, with the light emitting part 101 of the cyan ink tank 1C being lit, the carriage 205 is moved from the position in FIG. 29J to make the C attachment part corresponding to the rightmost attachment part face to the light receiving part 210 as illustrated in FIG. 29L. Also, at the position in FIG. 29L, a received light amount (21) at the time when the first light emitting element 1101*a* of the cyan ink tank 1C is lit is detected, and information on the received light amount (21) is stored in the RAM 302 as [C/Center].

Figures 29A, 29B, 29C, 29D, 29E, 29F, 29G, 29H, 29I, 29J, 29K, 29L, 29M, 29N:
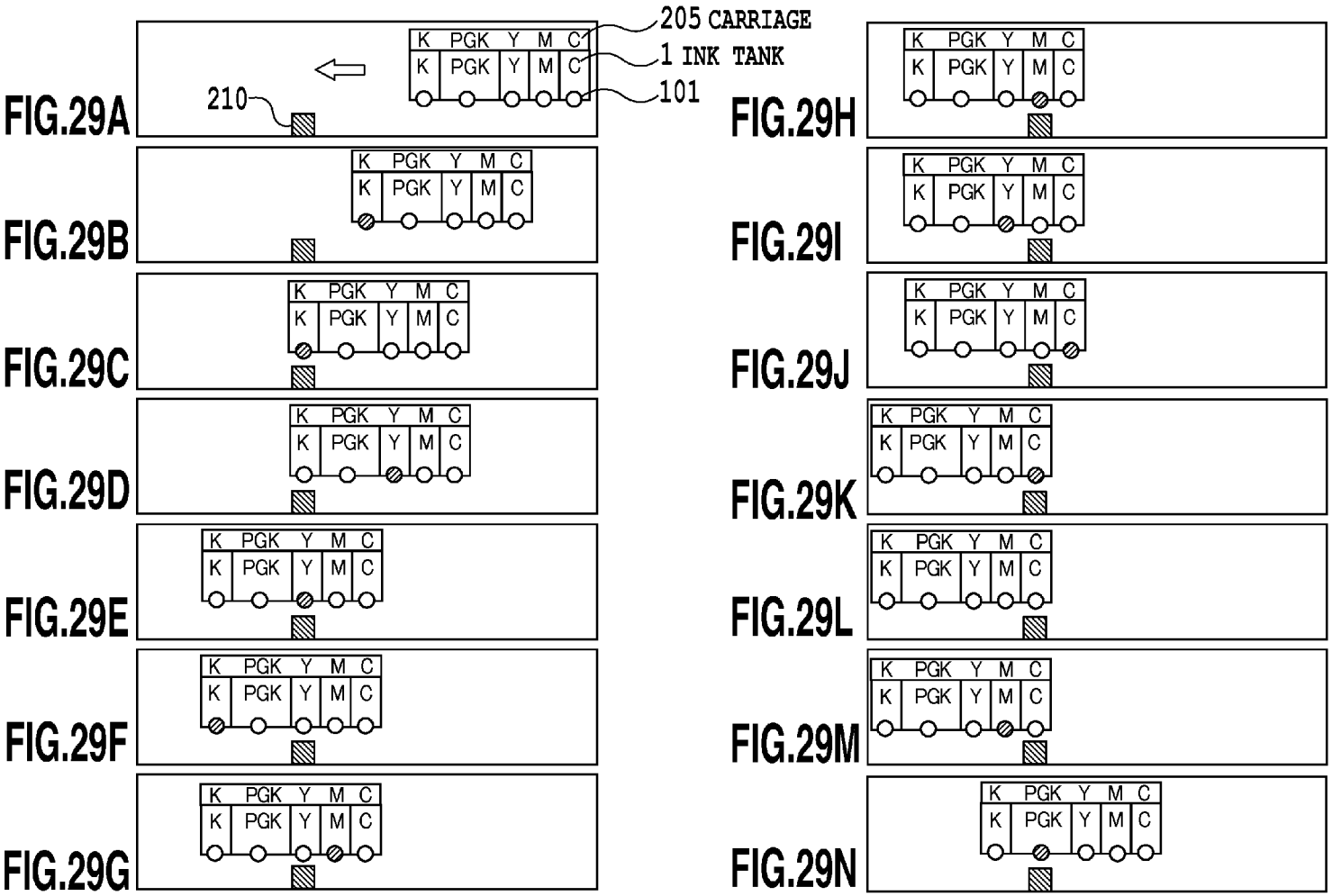
FIGS. 29A to 29N are diagrams for explaining operation of the light checking processing for the case where all attachment parts are attached with correct ink tanks in a second embodiment.
Figures 31A, 31B, 31C, 31D, 31E, 31F, 31G, 31H, 31I, 31J, 31K, 31L, 31M, 31N:
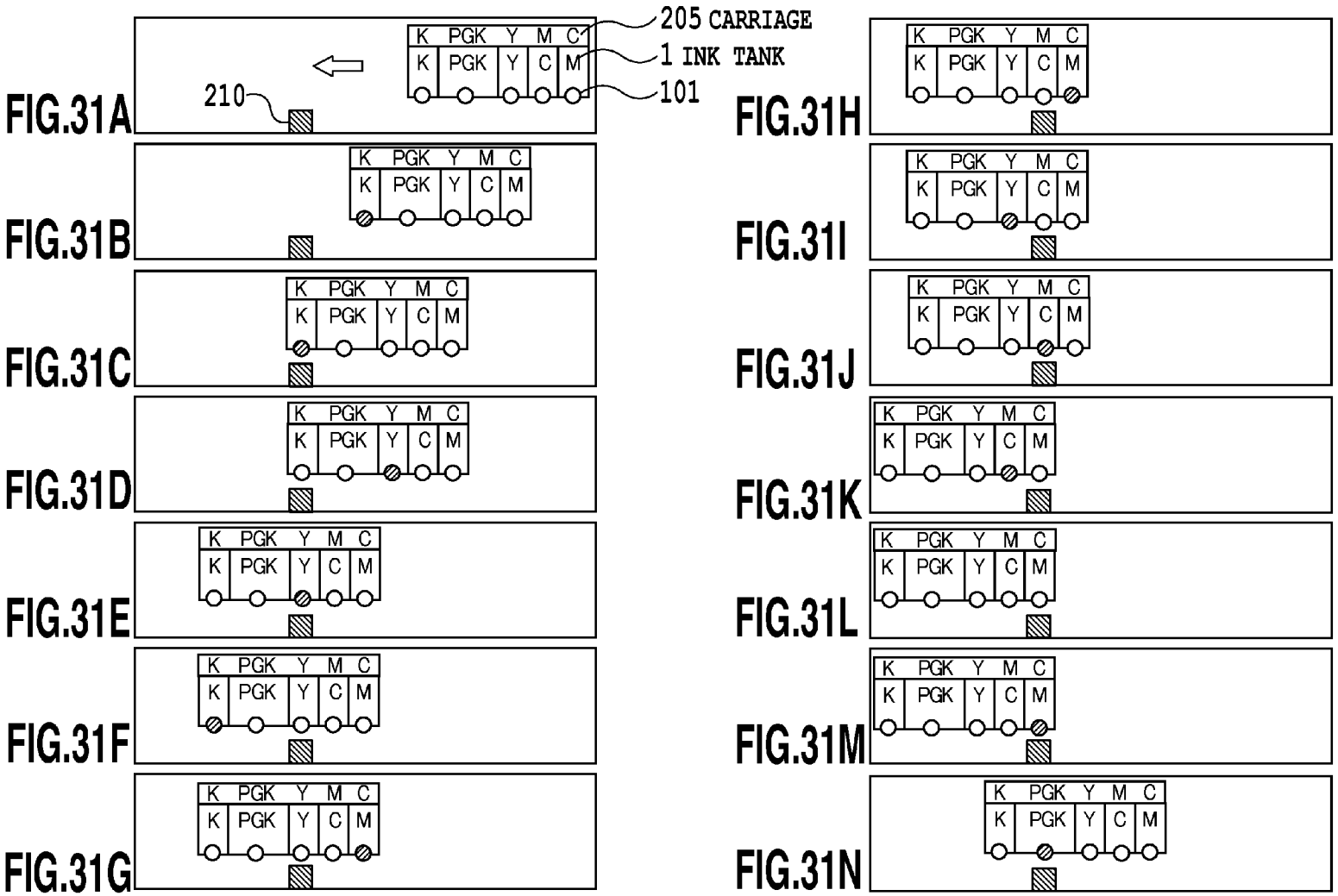
FIGS. 31A to 31N are diagrams for explaining operation of the optical checking processing for the case where attachment parts are attached with incorrect ink tanks in the second embodiment.

Then, after the first light emitting element 1101*a* of the cyan ink tank 1C has been extinguished as illustrated in FIG. 29M, a received light amount at this position is obtained as a background light amount (14), and information on the background light amount (14) is stored in the RAM 302 as "C/BG". After that, without changing the position of the carriage 205, as illustrated in FIG. 29N, the first light emitting element 1101*a* of the magenta ink tank 1M is lit. Also, a received light amount (22) at the time when the first light emitting element 1101*a* of the magenta ink tank 1M is lit is detected, and information on the received light amount (22) is stored in the RAM 302 as "M/Right". Subsequently, the carriage 205 is moved to a position in FIG. 29K, where a received light amount (9) and background light amount (13) are obtained in the manner as described in the first embodiment.

In the above manner, in addition to the received light amounts (1) to (9) and background light amounts (10) to (13), the received light amounts (21) and (22) and background light amount (14) are obtained. Then, a table l' is created, in which in the columns for [C/Center] and [M/Right] in the table 1 of FIG. 23A, the pieces of information on the received light amounts (21) and (22) are written. FIG. 30A is a diagram illustrating the table 1'. Also, a table 2' is created, in which in the column for [C/BG] in the table 2 of FIG. 23B, the information on the background light amount (14) is written. FIG. 30B illustrates the table 2'. Further, a table 3' is created in which in the column for [C/Center] in the table 3, information on (21)-(14) is written as a corrected light amount, and in the column for [M/Right], information on (22)-(14) is written as a corrected light amount. FIG. 30C illustrates the table 3'.

In the second embodiment, the table 3' illustrated in FIG. 30C is used to perform the attached tank correct/incorrect processing (FIG. 24). The processing steps in S41 to S42 and S45 of FIG. 24 are the same as those in the first embodiment, and therefore in the following, the processing steps in S43 and 344 are described.

As is clear from the above, regarding to the M attachment part, the pieces of information on Center, Left, and Right are obtained as in the case of the Y attachment part. Accordingly, in the determination processing in S43 of FIG. 24, in addition to the pieces of information on [M/Center] and [M/Left] used in the first embodiment, the information on [M/Right] is also used. Specifically, it is determined whether or not the following condition (III') is met.

(Condition III')

(1) Corrected light amount (6) of "M/Center"-(12) ≥Threshold value, and (2) Corrected light amount (6) of "M/Center"-(12)>Corrected light amount (5) of "M/Left"-(11), and (3) Corrected light amount (6) of "M/Center"-(12)>Corrected light amount (22) of "M/Right"-(14).

If the condition (III') is met, it is determined that the M attachment part is attached with the correct ink tank (magenta ink tank 1M). On the other hand, if the condition (III') is not met, it is determined that the M attachment part is not attached with the correct ink tank to make the flag for "positional error" on with respect to the M attachment part.

Next, the determination processing (S44) for the C attachment part is described. Regarding the C attachment part, as in the case of the K attachment part, in addition to the information on Center, the information at another position is obtained (in the case of the K attachment part, the information on Right; however, in the case of the C attachment part, the information on Left). Specifically, it is determined whether or not the following condition (IV') is met.

[Condition (IV')]

(1) Corrected light amount (21) of "C/Center"-(14) ≥Threshold value, and (2) Corrected light amount (21) of "C/Center"-(14)>Corrected light amount (8) of "C/Left"-(12).

If the condition (IV') is met, it is determined that the C attachment part is attached with the correct ink tank (cyan ink tank 1C). On the other hand, if the condition (IV') is not met, it is determined that the C attachment part is not attached with the correct ink tank to make the flag for "positional error" on with respect to the C attachment part.

In the above manner, the attached tank correct/incorrect determination processing in FIG. 24 is completed, which completes S11 in FIG. 21. Subsequently, a criterion in S12 of FIG. 21 is the same as that in the first embodiment. Regarding the error checking processing in S13, the operating content and processing content are different between the first and second embodiments. The differences are as follows.

The error checking processing (S13) in the first embodiment is as illustrated in the flowchart of FIG. 27; however, in S21 and S28 of the flowchart, the C attachment part cannot face to the light receiving part (S22 cannot be performed), and therefore the processing is performed, excluding the C attachment part. Also, in S21 and S28, the processing steps are performed, excluding the C attachment part, and therefore the processing steps in S29 and S30 are included.

On the other hand, in the second embodiment, the C attachment part can face to the light receiving part, and therefore in S21 and S28 of the flowchart in FIG. 27, the processing steps are performed without excluding the C attachment part. Accordingly, if the "positional error" occurs in the C attachment part, the C attachment part may be selected in S21. If the C attachment part is selected, the C attachment part is made to face to the light receiving part (S22), and in this state, first light emitting elements 1101*a* of ink tanks that should be attached to attachment parts where the "positional errors" occur are sequentially lit/extinguished to sequentially obtain received light amounts at the time (S23).

After that, in the same manner as in the first embodiment, S24 to S27 is performed, and then the flow proceeds to S28. In S28, the determination is made without excluding the C attachment part, and in the case where all of the attachment parts having the positional error have been selected, the processing is completed without performing the processing steps in S29 and S30. As described, in the second embodiment, the point that in S21 and S28, the determinations are made without excluding the C attachment part, and the point that the processing steps in S29 and S30 are not performed are the differences from the first embodiment.

Consider here the case where as illustrated in FIGS. 31A to 31K, the cyan ink tank 1C is attached to the M attachment part, and the magenta ink tank 1M is attached to the C attachment part. Also, it is assumed that any of the first light emitting elements 1101*a* of the cyan and magenta ink tanks 1C and 1M is not in trouble. In this case, in S11 of FIG. 21 (attached tank correct/incorrect determination processing), as illustrated in FIGS. 31A to 31K, a first light emitting element 1101*a* of each of the respective tanks is made to emit light, and the light is received in the light receiving part. As a result, in the M and C attachment parts, the "positional error" occurs. Accordingly, in FIG. 27 corresponding to S13 (error checking processing) of FIG. 21, from the attachment parts where the "positional errors" occur (in this case, the M and C attachment parts), one attachment part (in this case, the M attachment part) is selected (S21).

Figure 32A:
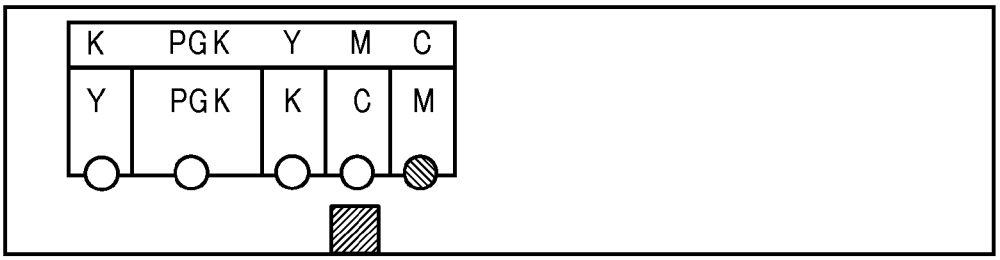
FIGS. 32A to 32D are diagrams for explaining operation of the error checking processing in the second embodiment.
Figure 32B:
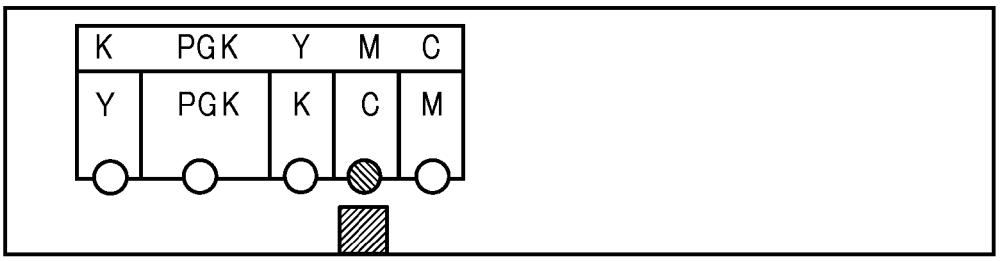

Then, as illustrated in FIG. 32A, the M attachment part is made to face to the light receiving part 210 (S22). Subsequently, with the M attachment part being made to face to the light receiving part 210, the first light emitting element 1101*a* of the magenta ink tank 1M is lit to obtain a received light amount at the time, and then the first light emitting element 1101*a* of the magenta ink tank 1M is extinguished (S23). After that, as illustrated in FIG. 320, with the M attachment part being made to face to the light receiving part 210, the first light emitting element 1101*a* of the cyan ink tank 1C is lit to obtain a received light amount at the time, and then the first light emitting element 1101*a* of the cyan ink tank 1C is extinguished (S23).

Subsequently, a maximum received light amount is identified from the received light amounts obtained in S23 (S24). In this case, the received light amount obtained when the cyan ink tank 1C is lit is larger than that obtained when the magenta ink tank 1M is lit, and therefore the former serves as the maximum received light amount. After that, it is determined whether or not the maximum received light amount is equal to or more than a threshold value (S25). If it is determined that the maximum received light amount is equal to or more than the threshold value, an ink tank that was lit when the maximum received light amount was obtained is identified as an ink tank attached to the M attachment part. In this case, it is determined that the M attachment part is attached with the cyan ink tank 1C. On the other hand, in S25, if it is determined that the maximum received light amount is not equal to or more than the threshold value, as in the first embodiment, it is determined that a first light emitting element 1101*a* of an ink tank attached to an attachment part facing to the light receiving part 210 is in trouble, and the LED error is given.

Then, the flow proceeds to S28, where it is determined whether or not all of attachment parts where the positional errors occur have been selected. In this case, the "positional error" occurs also in the C attachment part, and therefore the processing steps in S21 and subsequent steps are also performed on the C attachment part in the same manner as that for the M attachment part. That is, as the attachment part where the "positional error" occurs, the C attachment part is selected (S21), and then the C attachment part is made to face to the light receiving part 210 (S22).

Figure 32C:
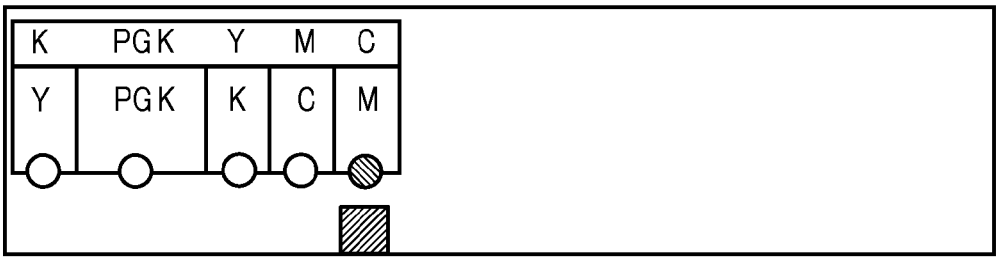
Figure 32D:
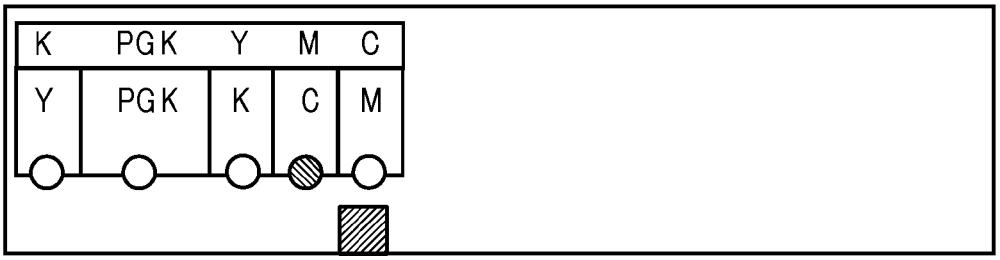

Subsequently, as illustrated in FIG. 32C, with the C attachment part being made to face to the light receiving part 210, the first light emitting element 1101*a* of the magenta ink tank 1M is lit to obtain a received light amount at the time, and then the first light emitting element 1101*a* of the magenta ink tank 1M is extinguished (S23). After that, with the C attachment part being made to face to the light receiving part 210, the first light emitting element 1101*a* of the cyan ink tank 1C is lit to obtain a received light amount at the time, and then the first light emitting element 1101*a* of the cyan ink tank 1C is extinguished (S23).

Subsequently, the maximum received light amount is identified from the received light amounts obtained in S23 (S24). In this case, the received light amount obtained when the magenta ink tank 1M is lit is larger than that obtained when the cyan ink tank 1C is lit, and therefore the former serves as the maximum received light amount. After that, it is determined whether or not the maximum received light amount is equal to or more than the threshold value (S25). If it is determined that the maximum received light amount is equal to or more than the threshold value, an ink tank that was lit when the maximum received light amount was obtained is identified as an ink tank attached to the C attachment part. In this case, it is determined that the C attachment part is attached with the magenta ink tank 1M. Then, the flow proceeds to S28, where the determination is again made, and in this case, the attachment part where the "positional error" occurs is no longer present, and therefore the processing is directly completed.

As described, according to the present embodiment, the positional error and LED error can be sensed with high accuracy.

<Third Embodiment>

In the first and second embodiment, the configuration including the pigment black ink tank 1PGK that is different in shape (size) from the other ink tanks is described; however, it should be appreciated that the present invention may have a configuration not including such a differently shaped ink tank.

The third embodiment has a configuration that uses the four ink tanks 1K, 1Y, 1M, and 1C resulting from removing the pigment black ink tank 1PGK from the five ink tanks used in the first and second embodiment. In this configuration, each of the four ink tanks can be attached to any attachment part, and therefore as in the above-described embodiments, the incorrect attachment may occur.

In the third embodiment, the optical checking processing is performed with the processing of the PGK attachment part being removed from the optical checking processing in the first and second embodiment. The other points are the same as those in the first and second embodiments, and therefore description thereof is omitted. Based on this, the optical checking process for the case where all of the ink tanks have the same shape becomes possible.

<Fourth Embodiment>

In the first to third embodiment, with the exception that during the optical checking processing, a user opens the main body cover 201, the optical checking processing is essentially performed in the cover close state. However, if a predetermined condition is met, the optical checking processing may be performed in the cover open state. In the fourth embodiment, although based on the optical checking processing in the first to third embodiments, the case of transferring to the optical checking processing in the cover open state is described.

In the above-described embodiments, when in S112 of the flowchart in FIG. 13, the incorrect attachment indication is made to complete the processing in FIG. 13, a user opens the cover for ink tank replacement. Then, in S101 of the flowchart in FIG. 13, the cover opening is sensed by the sensor, and in S102, the carriage is moved to the "tank replacement position". At the tank replacement position, the user references the previous incorrect attachment indication in S112 or the incorrect tank indication processing in S114 to replace a tank.

On the other hand, the fourth embodiment is adapted such that during the processing in FIG. 13, a period of time when an ejection port face of a printing head is not capped (non-cap time) is measured, and if the non-cap time exceeds a predetermined period of time, the ejection port face is capped. Then, if the ejection port face is capped during a period of time from a time point when the incorrect attachment indication is made in S112 of FIG. 13 to a time point when the cover is opened again in S101, before the carriage 205 is stopped at the "tank replacement position" in the carriage movement (S102) after the cover opening (S101), the same optical checking processing as that performed in S109 is performed. In the following, a sequence of this is described.

Along with the start of the carriage movement in S102 of FIG. 13, the ejection port face of the printing head, which has been capped, is uncapped. Then, the measurement of an elapsed time since the cap has been removed (non-cap time) is started. Through some processing steps illustrated in FIG. 13, in S112, the incorrect attachment indication is made, and then, in the manner as described above, it is determined whether or not the elapsed time being measured exceeds the predetermined period of time. If it does not exceed the predetermined period of time, the carriage 205 is made to wait near the home position at the end of the moving range of the carriage 205. Note that the home position is present on the side where the recovery unit is provided, and positioned on the side opposite to the side where the light receiving part 210 is provided. If the elapsed time exceeds the predetermined period of time, the carriage is moved to a position facing to the recovery unit, and by using a cap of the recovery unit, the ejection port face of the printing head is capped.

If a user opens the cover before a long time has not elapsed since the incorrect attachment indication was made in S112 (S101), the above elapsed time does not exceed the predetermined period of time, and therefore without performing the capping operation, the carriage near the home position is directly moved to the tank replacement position (S102). On the other hand, if the user opens the cover after a long time has elapsed since the incorrect attachment indication was made in S112 (S101), the above elapsed time exceeds the predetermined period of time, so that first, the ejection port face of the printing head, which is capped, is uncapped to perform the optical checking processing, and then the carriage 205 is moved to the tank replacement position (S102).

In the case where the capping operation is made to intervene as described, the optical checking processing is performed in case for the following reason. The capping operation is performed, as described above, in the case where the non-cap time exceeds the predetermined period of time, or the case where the period of time from the incorrect attachment indication processing (S112) to the cover opening (S101) is long. In the case where the long time has elapsed as described, it cannot be said that there is no possibility that some trouble occurs because an impact is made on the printer when the carry or the like of the printer is performed, or other reason, and in some cases, results of the optical checking processing are erased from the RAM 302. For this reason, such a long time unhandled state is a rare case; however, for such a rare case, the optical checking processing is performed after the cover opening in case. By doing so, it takes time, but the user can be given correct information.

As described, in the fourth embodiment, not only in the cover close state, but even in the cover open state, the optical checking processing is performed. Accordingly, the case where the optical checking processing is performed under the situation where a light amount of the outside light is large is more likely to arise than the first to third embodiments. However, in the present embodiment, by using the light receiving part 210 and first light emitting element 1101*a* having the above-described characteristics, even in the situation where the light amount of the outside light is large, the outside light based determination error in the optical checking processing can be reduced.

<Fifth Embodiment>

Figures 33A, 33B:
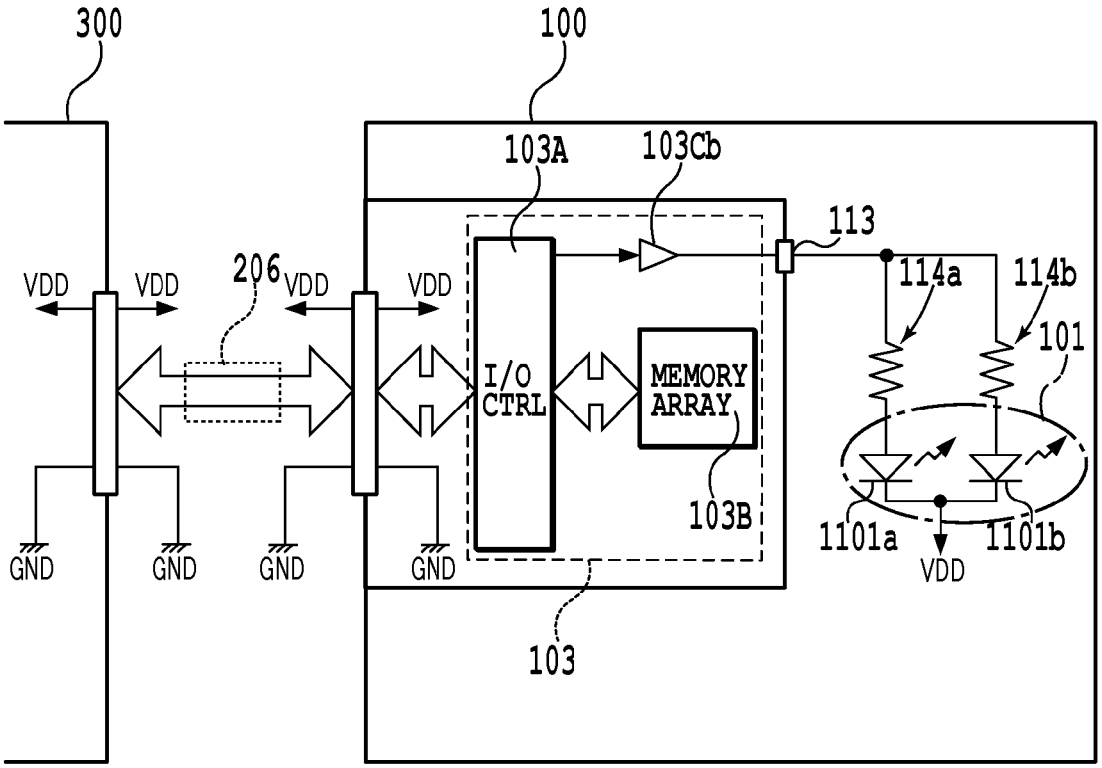
FIG. 33A is a circuit diagram illustrating details of a board 100 provided with a control circuit 103 in a fifth embodiment.
FIG. 33B illustrates data in the fifth embodiment, which corresponds to a control code in FIG. 12A.

In the above-described first to fourth embodiments, the light emitting part 101 have the configuration in which as illustrated in FIGS. 10A and 10B and FIG. 11, the two light emitting elements, i.e., the first and second light emitting elements 1101*a* and 1101*b* are respectively connected to the light emitting element drivers 103Ca and 103Cb, and by transmitting the control code as illustrated in FIG. 12A, the first and second light emitting elements 1101*a* and 1101*b* are individually driven by the input/output control circuit 103A. As another configuration, a configuration is also applicable, in which as illustrated in FIG. 33A, the light emitting part 101 is provided with one light emitting element driver and one connection terminal 113*a*, and the two light emitting elements (first and second light emitting elements) are constantly simultaneously driven. In this case, data corresponding to the control code in FIG. 12A is one illustrated in FIG. 33B, and ON/OFF of the first and second light emitting elements are controlled by a common signal. The similar configuration as illustrated in FIG. 11 is also applicable. Based on this, the number of transmission bits used in the control code, and the numbers of light emitting element drivers 103C and connection terminals 113 can be reduced and simplified, and therefore an effect of cost reduction or the like can be obtained. A light emitting element applicable to the light emitting part 101 has the same condition as described in the first embodiment, in which the first light emitting element 1101*a* is a light emitting element having a peak emission wavelength in the infrared range, and the second light emitting element 1101*b* is a light emitting element having an emission wavelength in the visible light range. Also, the light receiving element of the light receiving part 210 is applicable with the same light receiving element having a peak sensitivity wavelength in the infrared range as that in the first embodiment.

Figure 34A:
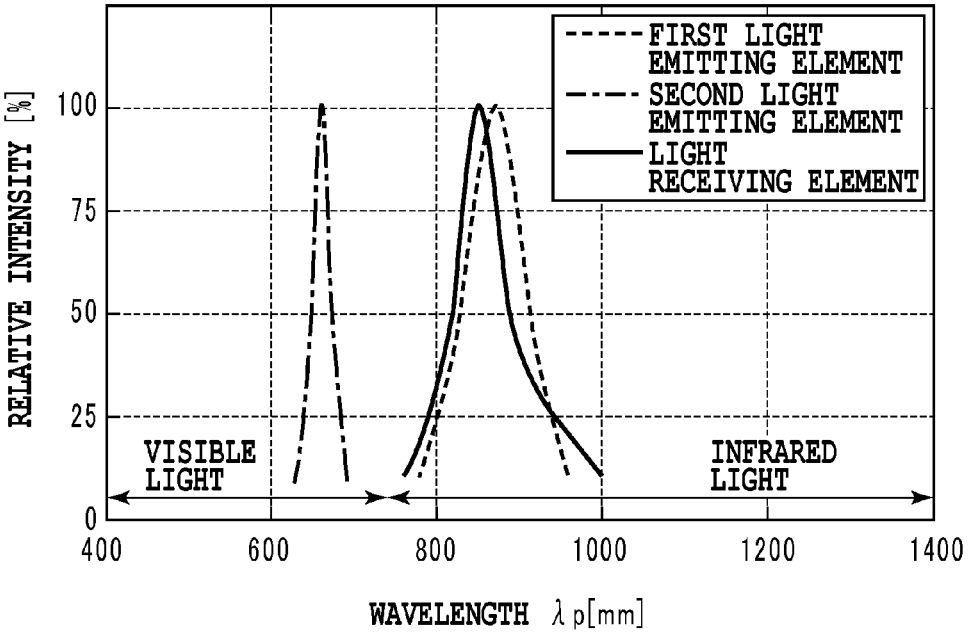
FIG. 34A is a diagram in which in the fifth embodiment, emission characteristics of first and second light emitting elements of a light emitting part and light reception characteristics of a light receiving part are illustrated with being superimposed with respect to a wavelength range.

FIG. 34A is a diagram in which as an example in the fifth embodiment, emission characteristics of the first and second light emitting elements 1101*a* and 1101*b* and light reception characteristics of the light receiving part 210 are illustrated with being superimposed with respect to a wavelength range. Note that the first light emitting element 1101*a* is the infrared LED that is also illustrated in FIG. 17A in the first embodiment, and has the emission wavelength range not less than 780 nm and not more than 960 nm and the peak emission wavelength of 870 nm. The second light emitting element 1101*b* is an infrared LED having an emission wavelength range not less than 630 nm and not more than 690 nm and a peak emission wavelength of 660 nm. The light receiving part uses the light receiving element that is illustrated in FIG. 18A, and has the sensitivity wavelength range not less than 760 nm and not more than 1000 nm and the peak sensitivity wavelength of 850 nm.

In the first to fourth embodiments, in the optical checking processing, only the first light emitting element 1101*a* (1101*a* in FIG. 10A) is driven to emit light. In the present fifth embodiment, the light emitting part constantly simultaneously drives the first and second light emitting elements 1101*a* and 1101*b*, and therefore even in the optical checking processing, from the light emitting part 101, light having the two peak emission wavelengths as illustrated in FIG. 34A is irradiated. At this time, as is clear from FIG. 34A, the sensitivity wavelength range of the light receiving element is out of the emission wavelength range of the second light emitting element, and therefore the light receiving element is hardly influenced by the visible range light irradiated from the second light emitting element 1101*b*. On the other hand, the peak emission wavelength of the first light emitting element 1101*a* is relatively close to the peak sensitivity wavelength of the light receiving part 210, and therefore the light receiving part 210 can receive the light from the first light emitting element 1101*a* with high sensitivity. Accordingly, in the same manner as in the first embodiment, the light receiving element having the peak sensitivity wavelength in the infrared range and the light from the light emitting element having the peak emission wavelength in the infrared range are used, and therefore the influence of the outside light (fluorescent light) can be reduced to perform the optical checking processing.

Also, in the ink tank state informing processing in the first embodiment, only the second light emitting element 1101*b* is driven to emit light. On the other hand, in the present embodiment, the light emitting part 101 constantly simultaneously drives the first and second light emitting elements 1101*a* and 1101*b*, and therefore even in the ink tank state informing processing, from the light emitting part 101, the light having the two peak emission wavelengths as illustrated in FIG. 34A is irradiated, and a user recognizes the light. At this time, the light irradiated from the first light emitting element 1101*a* is light having the infrared range wavelengths and therefore cannot be recognized by user's eyes, and consequently the user recognizes only the light from the second light emitting element 1101*b*.

Figure 34B:
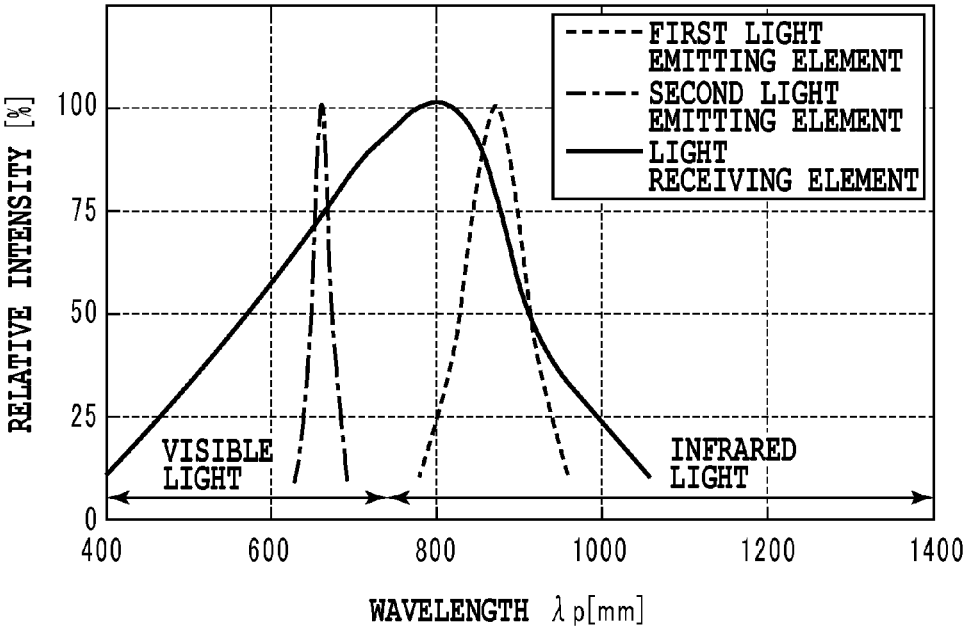
FIG. 34B is a diagram in which the emission characteristics of the first and second light emitting elements of the light emitting part and the light reception characteristics of the light receiving element in the fifth embodiment are illustrated with being superimposed with respect to the wavelength range for the case where the light receiving part uses the light receiving element illustrated in FIG. 16A.

Also, FIG. 34B illustrates another example in the present fifth embodiment, in which the wavelength ranges of the light emitting elements and light receiving element are illustrated with being superimposed for the case where the light receiving part 210 uses the light receiving element that is illustrated in FIG. 16A in the first embodiment and has the sensitivity wavelength range not less than 400 nm and not more than 1100 nm and the peak sensitivity wavelength of 800 nm. In this case, the sensitivity wavelength range of the light receiving element extends to the visible range, and therefore at the time of the optical checking processing, in addition to the irradiation light of the first light emitting element 1101*a*, the irradiation light of the second light emitting element 1101*b* is also sensed. However, the light emitting element in the present embodiment, an LED) constituting the light emitting part 101 has stable emission characteristics, and differently from unstable noisy light such as the outside light, irradiates the constant stable light, so that light intensity sensed in the light receiving part is also extremely stable, and therefore the light emitting element has little influence on the determination error. Accordingly, the same effects as in the first embodiment can be obtained.

Figure 34C:
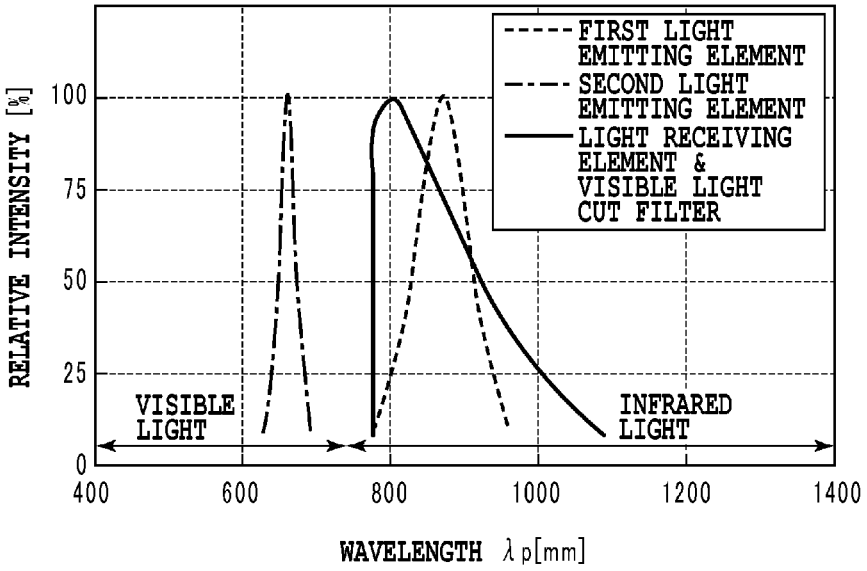
FIG. 34C is a diagram in which a sensitivity wavelength range of the light receiving element and the characteristics of the light emitting part are illustrated with being superimposed for the case where an optical filter in the fifth embodiment is inserted.

Also, even in the present embodiment, regarding the second light emitting element 1101*b*, if a peak emission wavelength is within the visible light range, light having any wavelength is also applicable, so that the reduction in outside light based error in the optical checking processing and the improvement of usability by expansion of degree of freedom in the ink tank state informing can be achieved together. Further, in the case of using the light receiving element having the wide sensitivity wavelength range in the visible and infrared ranges as illustrated in FIG. 34B (FIG. 16A), an optical filter that blocks light in the visible range and transmits light in the infrared region may be placed between the light receiving element of the light receiving part and the light emitting part 101. FIG. 34C is a diagram in which the sensitivity wavelength range and the characteristics of the light emitting elements are illustrated with being superimposed for the case where as an example of this, an optical filter (visible light cut filter) that blocks light having a wavelength of 780 nm or less and transmits light having a wavelength of 780 nm or more is inserted. Based on this, the influences of a variation in second light emitting element 1101*b* occurring in no small measure and the outside light (fluorescent lamp) can be further reduced to perform the optical checking processing.

<Other Embodiments>

(Variation of Tank)

The above-described first to fifth embodiments are configured such that the first engaging part 5 on the back side of the ink tank is inserted into the first locking part 155 on the depth side of the holder, and the attachment operation is performed with the front side of the ink tank being pressed downward and the ink tank 1 being rotationally moved with use of the insertion part as the rotational movement supporting point. The placement position of the board 100 preferable for this is, as described above, on the front side distant from the rotational movement supporting point, and along with this, the light emitting part 101 used for emitting light to both the light receiving part 210 and user's eyes is also configured integral with the board 100.

However, the placement position preferable for the board and the placement position required for the light emitting part may be different depending on a configuration of an ink tank and an attachment part for the ink tank, and in such a case, the board and the light emitting part can also be placed in appropriate positions, respectively.

An ink tank applicable in the present invention is not limited to any of the ones illustrated in FIGS. 1A to 5, but any of tanks as illustrated in, for example, FIGS. 35, 36, 37, and 38A can also be used. The light emitting part 101 provided on any of the tanks has a configuration in which as illustrated in above-described FIG. 4C or FIG. 10A, the two light emitting elements having different peak emission wavelengths are provided in the one light emitting part 101, or as illustrated in FIG. 4D or FIG. 10B, the two light emitting parts 101*a* and 101*b* are respectively mounted with the light emitting elements having different single peak emission wavelengths. That is, regarding the two light emitting elements, the single light emitting part 101 is placed, or the two light emitting parts, i.e., the first and second light emitting parts 101*a* and 101*b*, are placed adjacent to each other, and light emitting positions at the time of the light checking processing and at the time of the ink tank state processing are substantially the same position from which light is emitted. In the following, variations of the tank are described.

(First Variation of Tank)

Figure 35:
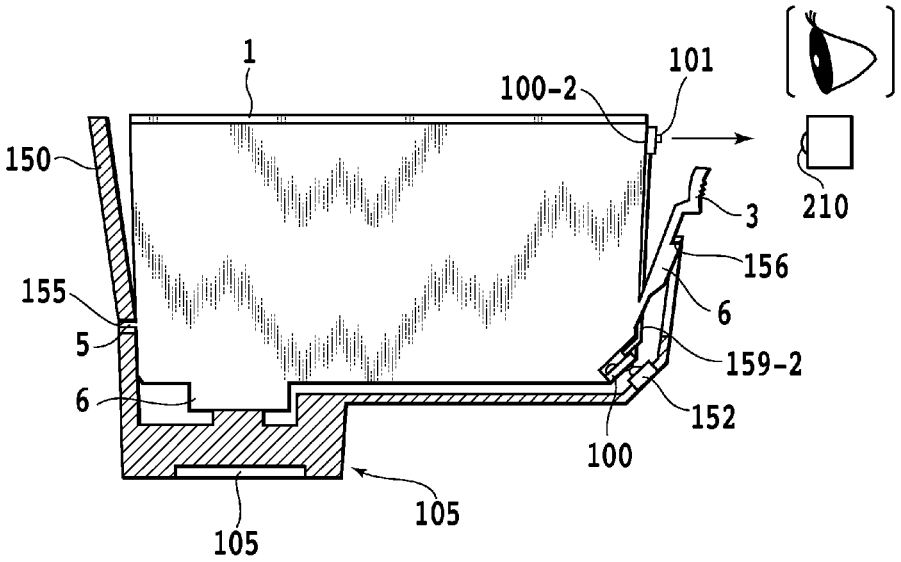
FIG. 35 is a schematic side view of an ink tank applicable in the present invention.

FIG. 35 is a schematic side view and front view of an ink tank (tank in the first variation) applicable in the present invention, and illustrates an example where in the ink tank illustrated in FIGS. 1A to 5, the board 100 and the light emitting part 101 are respectively placed in other locations.

In this example, on an upper front side of the ink tank 1, the light emitting part 101 and the board 100-2 mounted with the light emitting part 101 are provided. Also, by making a connection between the board 100 that is placed in the slope part preferable for the good electrical connection with the carriage side connector 152 and the protection form ink similarly to the above, and the board 100-2 or light emitting part 101 through a wiring part 159-2, an electrical signal is communicated. In addition, 3H represents a hole that is provided in a base part of the support member 3 to place the wiring part 159-2 along an ink tank casing.

In this example, when the light emitting part 101 emits light, the light is emitted in a direction indicated by an arrow in the diagram (to the front side). Also, at the time of the optical checking processing, the light receiving part 210 is present at the end of the scanning range of the carriage, and arranged at a position where it can receive the light emitted from the light emitting part 101. Further, as described in each of the above-described embodiments, when the carriage 205 is moved to the position facing to or near the position facing to the light receiving part 210, from emission information on the light emitting part 101, it can be recognized whether or not the ink tank 1 has been attached at a correct position. Also, at the time of the ink tank state informing processing, an emission state of the light emitting part 101 is viewed by eye and thereby informed to a user. Note that in the configuration of FIG. 35, by using a flexible printed cable (FPC), the board, wiring part 159-2, and board 100-2 can also be formed into an integrated member.

(Second Variation of Tank)

Figure 36:
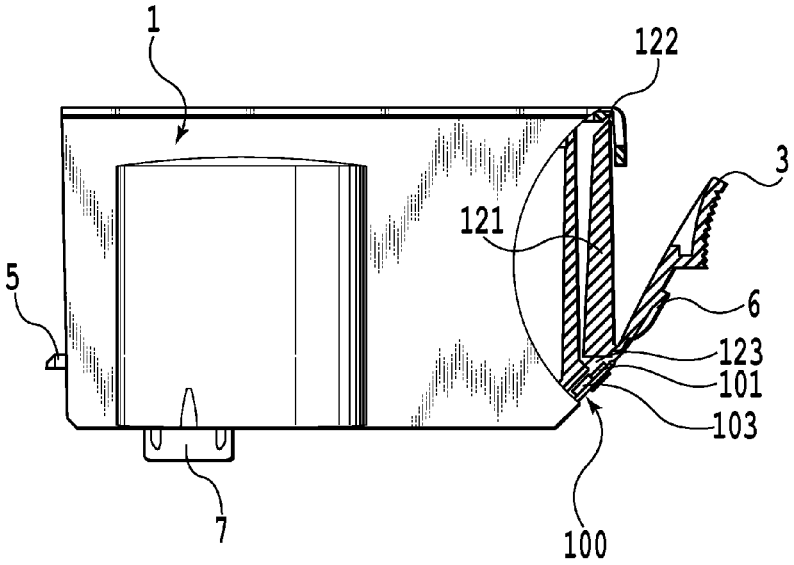
FIG. 36 is a side view of another ink tank applicable in the present invention.

FIG. 36 is a side view illustrating another ink tank (tank in the second variation) applicable in the present invention. The board 100 is arranged in a part (on a slope face) near a location where the front face and the bottom face of the ink tank 1 intersect with each other, so as to be sloped with respect to both of the front and bottom faces. On the board 100, in the same manner as in the above-described embodiments, the light emitting part 101, control circuit 103 that controls the light emitting part 101, unillustrated memory, and electrode pad serving as a tank side contact point are provided. Also, according to an electrical signal supplied from a connector serving as a printer main body side contact point through the electrode pad, the control circuit 103 controls light emission of the light emitting part 101.

Also, in the ink tank 1, a light guide part 121 for guiding light from the light emitting part 101 is provided. As is clear from the diagram, the light guide part 121 is installed upright between a front side wall face of the ink tank outer case and the support member 3 at some intervals respectively from the front side wall face and the support member. At the lower end of the light guide part 121, a light incident face 123 is provided, and the light incident face 12 is arranged near the light emitting part 101. The reason of such an arrangement relationship is because a light amount at the time when the light emitted by the light emitting part 101 is emitted to the light guide part 121 is suppressed from being attenuated. The light incident from the light incident face 123 is emitted outside from the upper end 122 of the light guide part 121 and some sites between the upper end 122 and the lower end. The light emitted outside from the light guide part 121 is received by the light receiving part 210 at the time of the above-described optical checking processing, or at the time of the ink tank state informing processing, emitted to a view field of a user.

As described, by providing the light guide part 121 in the ink tank 1, the light emitted by the light emitting part 101 can reach the light receiving part 210 without being blocked by the holder or the like. Based on this, at the time of the optical checking processing or ink tank state informing processing, a required light amount can be likely to be emitted to the light receiving part, and a degree of freedom of arrangement of the light emitting part 101 can also be increased.

(Third Variation of Tank)

Figure 37:
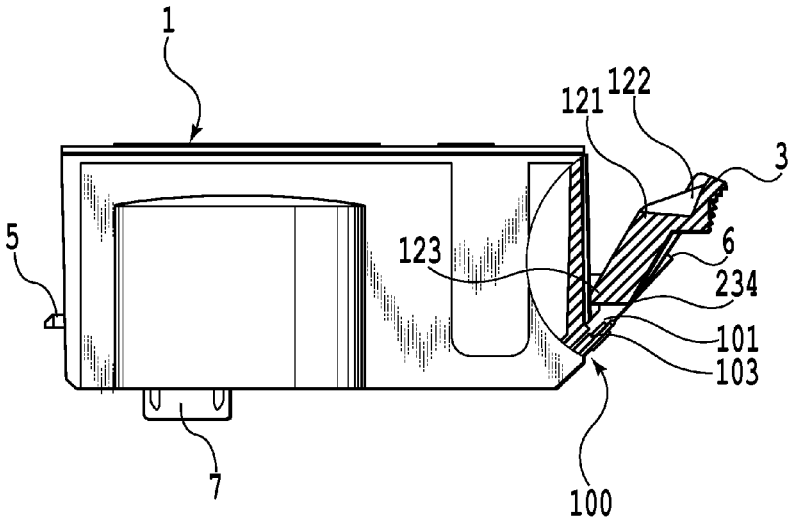
FIG. 37 is a side view of still another ink tank applicable in the present invention.

FIG. 37 is a side view illustrating still another ink tank (tank in the third variation) applicable in the present invention. The tank illustrated in FIG. 37 has a light guide part 121 in the same manner as in the tank illustrated in FIGS. 26A to 26F; however, arrangement of the light guide part 121 is different from that in FIG. 36. In the following, the tank in FIG. 37 is described. Note that a configuration of the board 100, control circuit 103, light emitting element 101, and the like in the tank of FIG. 37 is the same as that in FIG. 36, and therefore description thereof is omitted.

The support member 3 of the ink tank 1 is formed from resin, integral with an outer case member of the ink tank 1, and a part 234 connecting to the outer case member serves as a supporting point part (base part) at the time of elastic displacement. Also, on a face inside the support member 3 (on a face on a side facing to a tank front side wall face), the light guide part 121 is provided. The light guide part 121 is configured to protrude from the inside face of the support member 3 toward the tank front side wall face, and an light incident face 123 at the lower end of the light guide part 121 is provided near the base part 234 of the support member 3. Light emitted by the light emitting part 101 is incident from the light incident face 123, and the incident light is emitted outside from a fore end 122 and the like of the light guide part 121. The light emitted from the light guide part 121 is received by the unillustrated light receiving part 210 at the time of the optical checking processing, or at the time of the ink tank state informing processing, emitted to a view field of a user. Note that the light guide part 121 may be molded integral with the support member 3, or the light guide part 121 individually molded may be fixed to the support member 3.

(First Variation of Board)

The light emitting part 101 in each of the above embodiments has the configuration in which, as illustrated in FIG. 4C or FIG. 10A, the two light emitting elements having different peak emission wavelengths are provided in the one light emitting part 101, or as illustrated in FIG. 4D or FIG. 10B, the two light emitting parts 101*a* and 101*b* are respectively mounted with the first and second light emitting elements 1101*a* and 1101*b*. That is, regarding the two light emitting elements, the single light emitting part 101 is placed, or the two light emitting parts, i.e., the first and second light emitting parts 101*a* and 101*b*, are placed adjacent to each other, and light emitting positions at the time of the light checking processing and at the time of the ink tank state processing are substantially the same position from which light is emitted. However, the light emitting positions required at the time of the optical checking processing and at the time of the ink tank state informing processing may be different, and the two light emitting parts including light emitting elements may be respectively placed in appropriate positions. That is, the both may not be necessarily integrated or adjacent to each other.

Figure 38A:
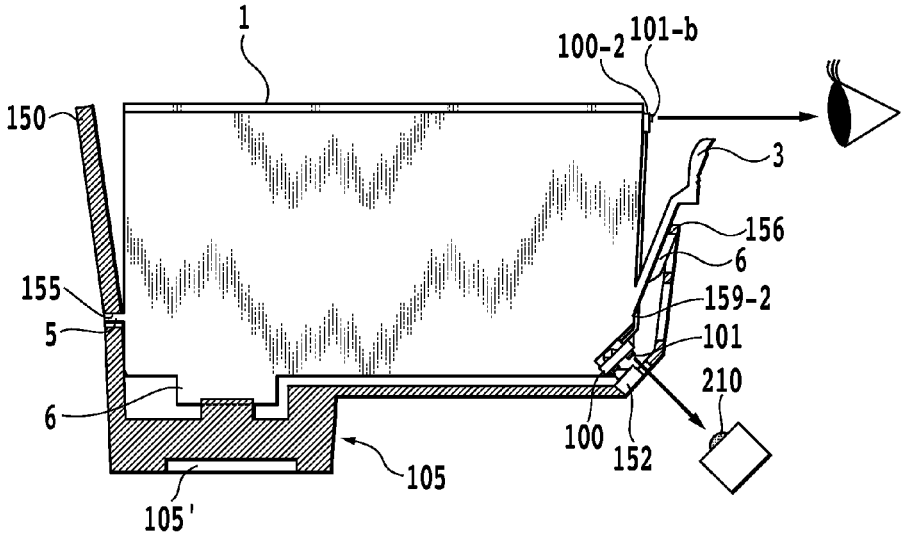
FIG. 38A is a side view for explaining a use aspect of an ink tank placed with a light emitting part in another embodiment.
Figure 38B:
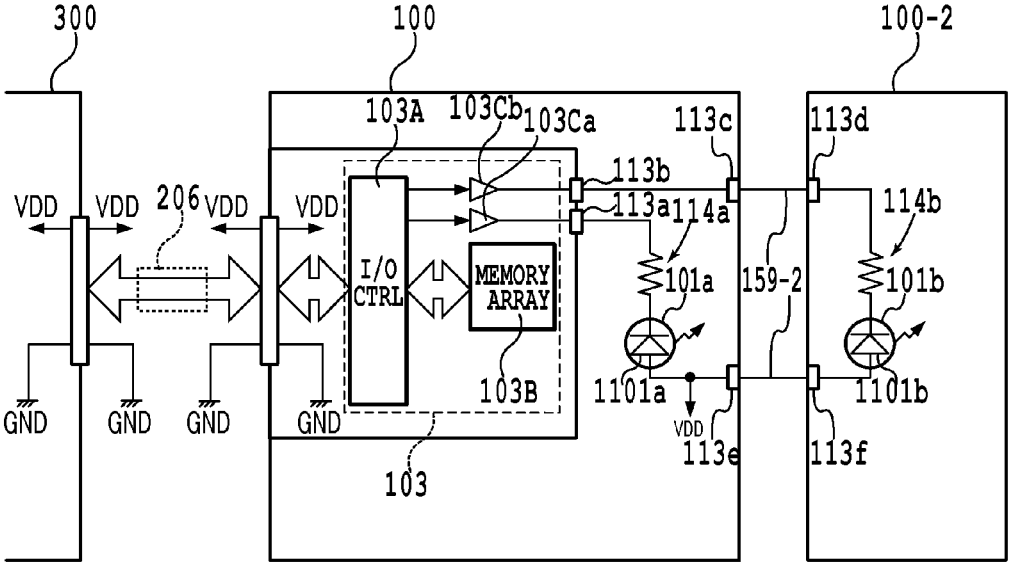
FIG. 38B is a circuit diagram illustrating details of a board 100 provided with a control circuit 103 in the another embodiment.

FIGS. 38A and 38B are diagrams illustrating a variation corresponding to the above. FIG. 38A is a side view for explaining a use aspect of an ink tank placed with a light emitting part having such a configuration, and FIG. 38B is a circuit diagram illustrating details of the board 100 in this example, which corresponds to FIG. 10A in the first embodiment. As is clear from the diagram, the first light emitting element 101*a* is placed in the lower right part of the ink tank in FIG. 38A and the second light emitting part 101*b* is placed in the upper right part of the ink tank in FIG. 38A with being separated. The first light emitting part 101*a* is provided with the first light emitting element 1101*a*, and mounted on the board 100 as illustrated in FIG. 386. The board 100 is arranged in the slope part in the lower right part of the ink tank, and thereby light emitted by the first light emitting part 101*a* is emitted in the lower right direction from the face of the board 100. Accordingly, by arranging the light receiving part 210 on a light axis in the lower right direction, the printer side can receive predetermined information on the ink tank 1 to perform the optical checking processing. On the other hand, the second light emitting part 101*b* is provided with the second light emitting element 1101*b*, and mounted and provided on the board 100-2 that is in the upper right part of the ink tank in FIG. 38A (as viewed from a user, in the upper front part of the ink tank) and illustrated FIG. 386. Also, by connecting the above-described board 100, and the board 100-2 or second light emitting part 101*b* through a wiring part 159-2 and terminals 113-*c* to *f*, an electrical signal is communicated. Further, by positioning the carriage in the center of the scanning range to control light emission of the second light emitting part 101*b*, the user can easily view a corresponding emission state by eye to perform the ink tank state informing processing. Note that, regarding emission characteristics, emission control, and the like of the first and second light emitting elements 1101*a* and 1101*b*, the same ones as those described in any of the first to fifth embodiments are applicable.

In each of the above embodiments, there is described the case where the present invention is applied to a configuration in which, in a system (hereinafter referred to as a continuous ink supply system) in which a supply system is configured to constantly, virtually continuously, supply ink having an amount corresponding to an ejected ink amount to a printing head, an ink tank configured to be detachably attached to the printing head that is mounted on the carriage or the like to reciprocate (perform main scanning) is used. However, the present invention is also applicable to a configuration in which an ink tank that is integrally indivisibly attached to the printing head. This is because it is thought that even in such a configuration, in the case of a different attachment position, data on a different color is received, or a color overlap order is difference from a designed one, and thereby desired printing quality cannot be obtained.

(Second Variation of Board)

Each of the above embodiments has the configuration in which the light emitting part is provided with the infrared range and visible range light emitting elements, one for each, i.e., the two light emitting elements in total. However, without limitation to this, three or more light emitting elements, for example, the light emitting part may be configured to have one infrared light emitting element and two or more visible range light emitting elements. It should be appreciated that the light emitting part may be configured such that as described above, a plurality of light emitting elements are placed in one package, or in a plurality of packages. Based on this, the number of colors that can be emitted at the time of the ink tank information informing processing can be increased, and thereby a user can know error content or the like in more detail.

Figure 39A:
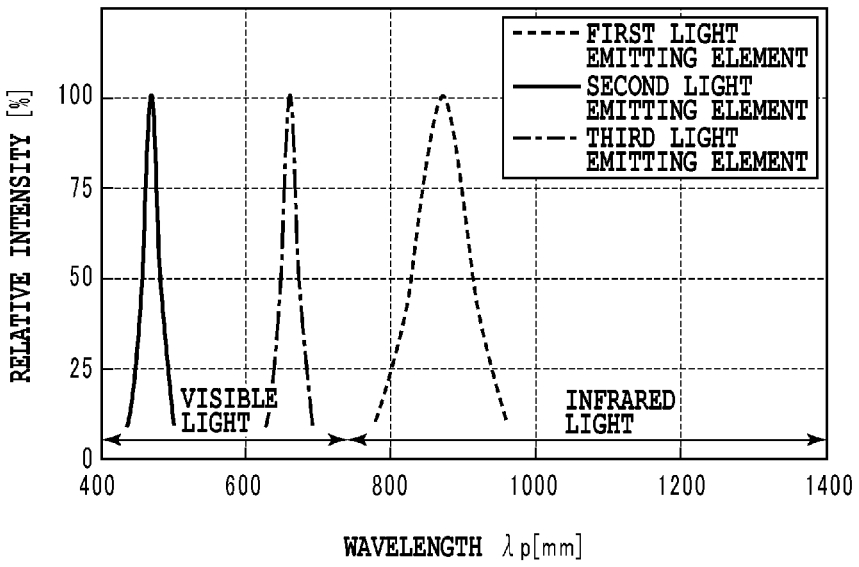
FIG. 39A is a diagram in which emission wavelength ranges of three light emitting parts are illustrated with being superimposed in still another embodiment.

FIG. 39A is a diagram in which as an example of the present variation, emission wavelength ranges of three light emitting elements are illustrated with being superimposed. In FIG. 39A, a first light emitting element 1101*a* is the infrared LED also illustrated in FIG. 17A in the first embodiment; a second light emitting element 1101*b* is the blue LED also illustrated in FIG. 20A in the first embodiment; and a third light emitting element 1101*c* is the red LED also illustrated in FIG. 34A in the fifth embodiment.

Figures 39B, 39C:
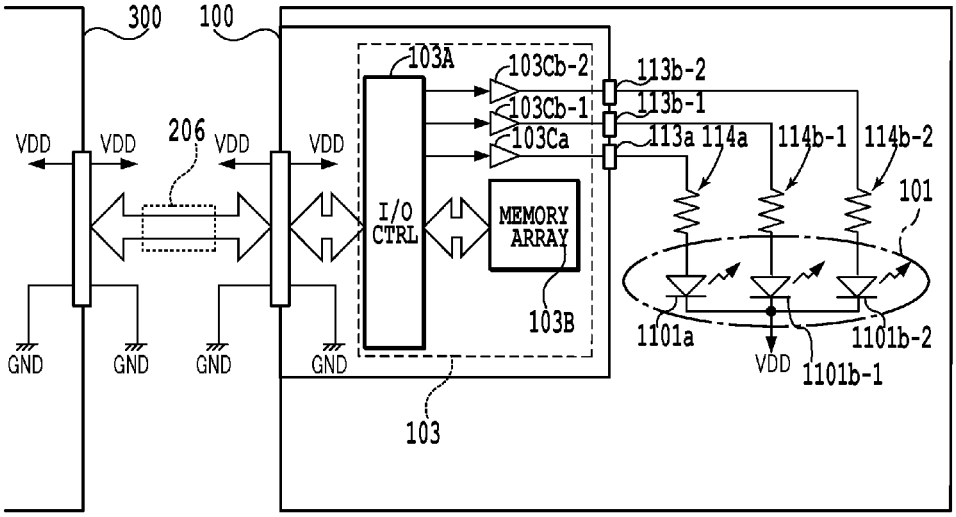
FIG. 39B is a circuit diagram illustrating details of a board 100 provided with a control circuit 103 and the like in the still another embodiment.
FIG. 39C is a diagram illustrating data in the still another embodiment, which corresponds to the control code of FIG. 12A.

FIG. 39B is a circuit diagram illustrating details of a board 100 provided with a control circuit 103 and the like, in which differences from FIG. 10A in the first embodiment are that the number of visible light emitting elements used for the ink tank informing processing is two, i.e., the second and third light emitting elements 1101*b* and 1101*c*, and along with this, a light emitting element driver 103C, terminal 113, and limiting resistor 114 are respectively added and placed.

FIG. 39C illustrates data in the present embodiment corresponding to the control code of FIG. 12A in the first embodiment, in which a control code is a 4-bit code, and ON/OFF of each of the light emitting elements is controlled by an individual signal. Also, a similar configuration as illustrated in FIG. 11 in the first embodiment is also applicable. The optical checking processing in the present variation is the same as the processing described in the first to fifth embodiment. However, in the present embodiment, in the ink tank information informing processing, three color lights, i.e., blue light at the time when only the second light emitting element 1101*b* emits light, red light at the time when only the third light emitting element 1101*c* emits light, and reddish violet light at the time when the second and third light emitting elements 1101*b* and 1101*c* simultaneously emit light, can be selectively emitted depending on an ink tank state. For example, in the ink tank attachment/detachment processing in S105 of FIG. 13, a light emitting part of a correct ink tank is lit in blue; a light emitting part of an ink tank having an attachment position error is blinked in red; a light emitting part of an ink tank having an ink absence error is blinked in reddish violet, and so on, i.e., depending on a situation, an emission color can be changed. Based on this, the discrimination of a correct/incorrect ink tank, and the discrimination of error content can be made not only from an emission pattern but also a variation in light color, and therefore more intuitively a lot of information can be informed to a user. Also, in the case of placing four light emitting elements (e.g., infrared light and three visible lights), many more color lights can be emitted, and therefore it should be appreciated that more information can be informed.

(Third Variation of Board)

Figure 40:
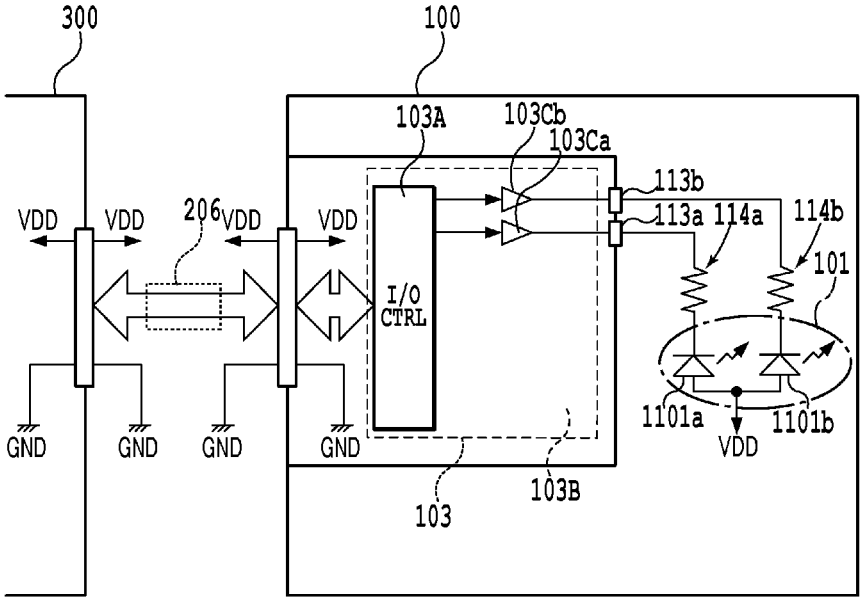
FIG. 40 is a circuit diagram illustrating details of a board 100 provided with a control circuit 103 and the like according to yet another embodiment of the present invention.

FIG. 40 is a circuit diagram illustrating details of a board 100 as a variation of the board of the present invention. As illustrated in the diagram, a control circuit 103 is configured to have an input/output control circuit (I/O CTRL) 103A and a light emitting element driver 103C.

The input/output control circuit 103A controls driving of a light emitting part 101 through the light emitting driver 103C according to control data transmitted from the main body side control circuit 300 through the flexible cable 206. The light emitting element driver 103C operates to apply a power supply voltage to the light emitting part when a signal outputted from the input/output control circuit 103A is on, and on the basis of this, makes the light emitting part 101 emit light. Accordingly, when the signal outputted from the input/output control circuit 103A is on, the light emitting part 101 is in a lighting state, whereas when the above signal is off, the light emitting part 101 is in an extinction state.

A difference of the present embodiment from the first embodiment illustrated in FIG. 10A is the absence of the memory array 103B. A method for, even in the case of the absence of pieces of individual information (such as ink information) stored in the memory array, identifying an ink tank, and controlling lighting/extinction of a light emitting part 101 of the ink tank is described below with a timing chart illustrated in FIG. 41.

From the control circuit 300 serving as the main body side control part to the input/output control circuit 103A in the control circuit serving as the tank side control part, through the signal line DATA (FIG. 9), "Start code+Ink information" and "Control code" are transmitted in synchronization with a clock signal CLK. The input/output control circuit 103A is configured to have inside a command identification part 103D that collectively identifies "Ink information"+"Control code" as "Command" and determines on/off of an output signal to the light emitting element driver 103C.

Figure 41:
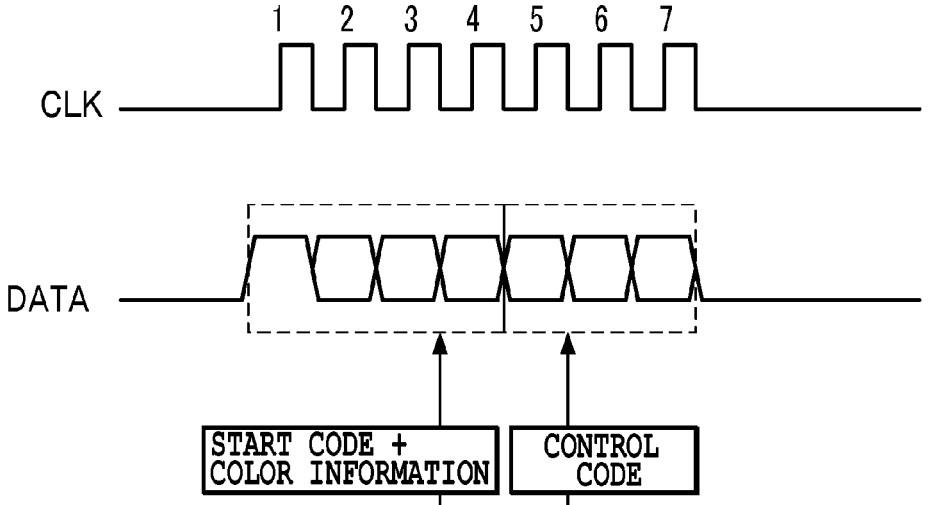
FIG. 41 is a timing chart according to the embodiment in FIG. 40.

The ink tanks for the respective types K, PGK, Y, M, and C are mounted with control circuits 103 having different command identification parts 103D, respectively, and commands that control lighting/extinction in the respective ink types are configured as illustrated in FIG. 41. That is, each of the command identification parts 103D is configured to include inside individual information (ink information) for each of the ink types, and compares this with the "Ink information" part of the inputted "Command" for identification to control various types of operations. Based on this, there can be performed control in which, when the main body transmits, for example, "K-ON" ink information+control code "111100" that lights the ink tank 1K together with the start code, only the command identification part 103D of the ink tank 1K identifies them, and only the ink tank 1K is lit. The present embodiment is required to individually configure the control circuit 103 for each of the ink types, but advantageous in that it is not necessary to mount the memory array 103B.

Also, the command identification part 103D may have a function that identifies a plurality of commands such as, as illustrated in FIG. 41, not only the command for lighting/extinction of a light emitting part 101 for each of the ink types, but a command "ALL-ON"/"ALL-OFF" that lights/extinguishes the light emitting parts 101 of the all types of inks, and a "CALL" command that specifies the type of an ink to output a response signal from the control circuit 103.

Further, as another example, the case where the command including ink information+control code transmitted from the main body side control circuit 300 to an ink tank 1 is not directly compared with ink information (individual information) inside the ink tank is also applicable. That is, it may be configured to convert (calculate) the above inputted command in the control circuit 103; compare a value resulting from the conversion with a predetermined value that is retained in the memory array 1038 or the command identification part 103D; and if a result of the comparison corresponds to a predetermined relationship, control lighting/extinction, or the like.

Further, in addition to the above example, it may be configured to convert (calculate) a signal transmitted from the main body side in the control circuit 103; also convert (calculate) a value retained in the memory array 1038 or command control circuit 103D in the control circuit 103; compare the converted values with each other; and if a result of the comparison corresponds to a predetermined relationship, control lighting/extinction, or the like.

(Type of Ink Used)

In each of the above-described embodiment, the case of using the five types of inks (K, PGK, Y, C, and M) or the four types of inks (K, Y, C, and M) is described; however, ink types applicable in the present invention is not limited to the case. The present invention is applicable to, in addition to the above four or five ink types, a configuration using light inks having higher lightness than these inks (e.g., light cyan (Lc), light magenta (Lm), and gray (GY)), or a configuration using special inks (e.g., red (K), blue (B), and green (G)) that can express lightness or saturation that cannot be expressed by the combination of the above four or five ink types. Such configurations may include various configurations such as a configuration using six ink types (K, Y, C, M, Lc, and Lm), a configuration using seven ink types (K, PGK, Y, C, Lc, and Lm), and a configuration using eight ink types (K, Y, C, NJ, Lc, Lm, B, and G). Also, the present invention is applicable to a configuration using the three ink types of Y, C, and M.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-061148, filed Mar. 17, 2010, which is hereby incorporated by reference herein in its entirety.

What is claimed is:

1. An ink jet printing apparatus comprising:

an ink tank having at least a first light emitting element and a second light emitting element;

a carriage to which said ink tank is detachably attached;

a light receiving part configured to receive light emitted from the first light emitting element;

a determining unit configured to determine whether or not an attachment position of said ink tank is correct, on the basis of a light reception state of said light receiving part, at a time when only light emission from the first light emitting element is controlled; and an informing unit configured to provide information relating to a state of said ink tank based on light emitted from the second light emitting element, at a time when only light emission from the second light emitting element is controlled, wherein a peak sensitivity wavelength range of said light receiving part is within a range of not less than 760 nm and not more than 1100 nm, and wherein a peak emission wavelength of the first light emitting element is not less than 760 nm, and a peak emission wavelength of the second light emitting element is within a range of not less than 400 nm and not more than 760 nm.

2. An ink jet printing apparatus comprising:

a plurality of ink tanks each of which is provided with a light emitting part having a plurality of light emitting elements and a drive control part for controlling driving of the light emitting part, wherein each ink tank is provided with a memory part that stores information regarding a type of ink contained therein, and wherein each drive control part is configured to control the plurality of light emitting elements individually; and a printing apparatus main body that is provided with an apparatus side control part electrically connected to each of the drive control parts through a common wiring, wherein said printing apparatus main body comprises:

a carriage that is provided with a plurality of attachment parts respectively corresponding to said plurality of ink tanks which are detachably attached to the carriage, the carriage is configured to move in a reciprocated manner in a direction in which the plurality of attachment parts are arranged;

a light receiving part arranged so that a positional relationship of the light receiving part with respect to each of the plurality of attachment parts changes according to the movement of the carriage, the light receiving part is adapted to receive light from at least one of the light emitting parts, and an ink remaining amount detecting unit configured to detect an ink remaining amount in at least one of said ink tanks, wherein the drive control part of each of said plurality of ink tanks is configured to cause one or more light emitting elements of the light emitting part to emit light in a case that the drive control part receives a lighting command which specifies a type of ink shown by ink information stored in the memory part, from the apparatus side control part, and wherein the apparatus side control part is configured to:

(i) send through the common wiring the lighting command for the drive control part of the ink tank containing the type of ink that is specified according to a position of the carriage, and causes an attachment position determining unit to determine whether or not the ink tank containing the type of ink specified by the lighting command is attached in the correct attachment part based on a light receiving result by the light receiving part in association with sending the lighting command, and (ii) cause an ink tank state informing unit, which provides information by controlling emission of light from the light emitting parts, to provide information based on a determination result by the attachment position determining unit and a detection result by the ink remaining amount detecting unit, and wherein a peak sensitivity wavelength range of the light receiving part is within a range of not less than 760 nm and not more than 1100 nm, and wherein a peak emission wavelength of at least one of the plurality of light emitting elements is not less than 760 nm, and a peak emission wavelength of at least one of the plurality of light emitting elements is within a range not of less than 400 nm and not more than 760 nm, and wherein the drive control part of each of said plurality of ink tanks is further configured to (i) control light emission from the at least one light emitting element having the peak emission wavelength not less than 760 nm when the attachment position determining unit determines whether or not the ink tank containing the type of ink specified by the lighting command is attached in the correct attachment part and (ii) control light emission from the at least one light emitting element having the peak emission wavelength within a range of not less than 400 nm and not more than 760 nm when the ink tank state informing unit provides information based on the determination result by the attachment position determining unit and the detection result by the ink remaining amount detecting unit.

3. The ink jet printing apparatus as claimed in claim 2, wherein the plurality of light emitting elements are constructed to include one light emitting element having the peak emission wavelength of not less than 760 nm and two or more light emitting elements having the peak emission wavelength in the range of not less than 400 nm and not more than 760.

4. The ink jet printing apparatus as claimed in claim 2, wherein the drive control part is configured to control the plurality of light emitting elements at a same time, and controls emission of light from all of the light emitting elements at a time when a determination is made by the attachment position determining unit and when providing information is made by the ink tank state informing unit.

5. The ink jet printing apparatus as claimed in claim 2, wherein the peak sensitivity wavelength range of the light receiving part is within a range of not less than 780 nm and not more than 950 nm.

6. The ink jet printing apparatus as claimed in claim 2, wherein the at least one light emitting element, from which light emission is controlled when a determination is made by the attachment position determining unit, has the peak emission wavelength in the range of not less than 760 nm and not more than 1100 nm.

7. The ink jet printing apparatus as claimed in claim 2, wherein the at least one light emitting element, from which light emission the driving of which is controlled when a determination is made by the attachment position determining unit, has the peak emission wavelength in the range of not less than 780 nm and not more than 950 nm.

8. The ink jet printing apparatus as claimed in claim 2, wherein the at least one light emitting element, from which light emission is controlled when providing information is made by the ink tank state informing unit, has the peak emission wavelength in the range of not less than 470 nm and not more than 660 nm.

9. An ink tank attached to a carriage of an ink jet printing apparatus main body, the ink tank comprising:

a first light emitting element; and a second light emitting element, wherein the ink jet printing apparatus main body includes:

a light receiving part configured to receive light from said first light emitting element;

a determining unit configured to determine whether or not an attachment position of the ink tank is correct, on the basis of a light reception state of the light receiving part, when only light emission from said first light emitting element is controlled and emitted to the light receiving part; and an informing unit configured to provide information relating to a state of the ink tank based on light emitted from said second light emitting element, at a time when only light emission from said second light emitting element is controlled, wherein a peak sensitivity wavelength range of the light receiving part is within a range of not less than 760 nm and not more than 1100 nm, and wherein a peak emission wavelength of said first emitting element is not less than 760 nm, and a peak emission wavelength of said second emitting element is within a range of not less than 400 nm and not more than 760 nm.

10. An ink tank attached to a carriage of an ink jet printing apparatus main body that is provided with the carriage that is provided with an attachment part, of a plurality of attachment parts, to which the ink tank is detachably attached, the carriage is moved in a reciprocated manner in a direction in which the plurality of the attachment parts are arranged, said ink tank comprising:

a light emitting part having a plurality of light emitting elements;

a drive control part for controlling driving of said light emitting part; and a memory part that stores ink information showing a type of ink contained in the ink tank, wherein the ink jet printing apparatus main body includes:

an apparatus side control part electrically connected to said drive control part through a common wiring; and a light receiving part that is arranged so that a positional relationship of the light receiving part with each of the plurality of attachment parts changes according to the movement of the carriage and is adapted to receive light from said light emitting part, wherein said drive control part causes a light emitting element of said light emitting part to emit light in a case that said drive control part receives a lighting command which specifies the type of ink shown by the ink information stored in the memory part, from the apparatus side control part, said drive control part is further configured to control the plurality of light emitting elements individually, and wherein the apparatus side control part is configured to:

(i) send through the common wiring the lighting command for said drive control part of the ink tank containing the type of ink that is specified according to a position of the carriage, and causes an attachment position determining unit to determine whether or not the ink tank containing the type of ink specified by the lighting command is attached in the correct attachment part based on a light receiving result by the light receiving part in association with sending the lighting command, and (ii) cause an ink tank state informing unit, which provides information by controlling emission of light from said light emitting part, to provide information based on a determination result by the attachment position determining unit and a detection result by an ink remaining amount detecting unit, and wherein a peak sensitivity wavelength range of the light receiving part is within a range of not less than 760 nm and not more than 1100 nm, and wherein a peak emission wavelength of at least one of the plurality of emitting elements is not less than 760 nm, and a peak emission wavelength of at least one of the plurality of emitting elements is within a range of not less than 400 nm and not more than 760 nm, and wherein said drive control part is further configured to (i) control light emission from the at least one light emitting element having the peak emission wavelength not less than 760 nm when the attachment position determining unit determines whether or not the ink tank containing the type of ink specified by the lighting command is attached in the correct attachment part and (ii) control light emission from the at least one light emitting element having the peak emission wavelength within a range of not less than 400 nm and not more than 760 nm when the ink tank state informing unit provides information based on the determination result by the attachment position determining unit and the detection result by the ink remaining amount detecting unit.

11. The ink tank as claimed in claim 10, wherein the plurality of light emitting elements are constructed to include one light emitting element having the peak emission wavelength of not less than 760 nm and two or more light emitting elements having the peak emission wavelength in the range of not less than 400 nm and not more than 760.

12. The ink tank as claimed in claim 10, wherein said drive control part is configured to control all of the plurality of light emitting elements at a same time, and control emission of light from all of the light emitting elements at a time when a determination is made by the attachment position determining unit and when providing information is made by the ink tank state informing unit.

13. The ink tank as claimed in claim 10, wherein the at least one light emitting element, from which light emission is controlled when a determination is made by the attachment position determining unit, has the peak emission wavelength in the range of not less than 760 nm and not more than 1100 nm.

14. The ink tank as claimed in claim 10, wherein the at least one light emitting element, from which light emission is controlled when a determination is made by the attachment position determining unit, has the peak emission wavelength in the range of not less than 780 nm and not more than 950 nm.

15. The ink tank as claimed in claim 11, wherein the at least one light emitting element, from which light emission is controlled when providing information is made by the ink tank state informing unit, has the peak emission wavelength in the range of not less than 470 nm and not more than 660 nm.

* * * * *